US008129294B2

(12) United States Patent
Khokar

(10) Patent No.: US 8,129,294 B2
(45) Date of Patent: Mar. 6, 2012

(54) WOVEN MATERIAL COMPRISING TAPE-LIKE WARP AND WEFT, AND AN APPARATUS AND METHOD FOR WEAVING THEREOF

(75) Inventor: Nandan Khokar, Gothenburg (SE)

(73) Assignee: Tape Weaving Sweden AB, Vastra Frolunda (SE)

( * ) Notice: Subject to any disclaimer, the term of this patent is extended or adjusted under 35 U.S.C. 154(b) by 845 days.

(21) Appl. No.: 11/795,375

(22) PCT Filed: Jan. 17, 2006

(86) PCT No.: PCT/SE2006/000062
§ 371 (c)(1),
(2), (4) Date: Apr. 17, 2008

(87) PCT Pub. No.: WO2006/075962
PCT Pub. Date: Jul. 20, 2006

(65) Prior Publication Data

US 2009/0007981 A1 Jan. 8, 2009

(30) Foreign Application Priority Data

Jan. 17, 2005 (SE) ..... 0500114

(51) Int. Cl.
*D03D 15/00* (2006.01)
*D03D 13/00* (2006.01)

(52) U.S. Cl. ..... 442/186; 442/185; 442/187; 442/189; 442/199; 442/239

(58) Field of Classification Search ..... 442/185, 442/186, 187, 189, 199, 239
See application file for complete search history.

(56) References Cited

U.S. PATENT DOCUMENTS 2,619,705 A * 12/1952 Foster ..... 428/219
(Continued)

FOREIGN PATENT DOCUMENTS

DE 177 163 11/1906
(Continued)

OTHER PUBLICATIONS

English translation of Office Action for corresponding Chinese Patent Application No. 200680002468.8 dated Mar. 24, 2010.

(Continued)

*Primary Examiner* — Andrew T Piziali
(74) *Attorney, Agent, or Firm* — Harness, Dickey & Pierce, P.L.C.

(57) ABSTRACT

Novel woven materials, producible by a new weaving method, are described that comprise single or doubled warps and wefts in the form of tapes that are preferably partially stabilized type of fibrous tape. These fibres are caused to occur in a non-linear arrangement during the weaving process. The non-linear fibres can be subsequently straightened by pulling the tape longitudinally. The doubled warps and wefts comprise disconnected tapes. Such separateness of constituent tapes of doubled warp and weft tapes enables them to be slid/slipped relative to each other by pulling longitudinally and laterally without causing any alteration in the woven structure. These novel fabrics solve the problem of uneven fibre distribution and orientation arising from crumples/wrinkles due to compression and stretches due to extension, at the inner and outer sides respectively, when tape-woven fabrics are curved into shapes. Further, by using doubled warps and wefts fabrics with relatively flat/planar sections and thicker/raised wide rib sections can be also created that resemble a bit like a profiled material in its cross-section. Other fabrics like those comprising slant/oblique weft tapes, shaped warp and weft tapes, formed shape within its body are also producible.

20 Claims, 30 Drawing Sheets

U.S. PATENT DOCUMENTS

| | | | | | |
|---|---|---|---|---|---|
| 3,342,220 | A | | 9/1967 | Bartosek et al. | |
| 3,481,370 | A | | 12/1969 | Bonnard | |
| 3,503,106 | A | | 3/1970 | Port et al. | |
| 3,587,661 | A | | 6/1971 | Golobart | |
| 3,918,501 | A | | 11/1975 | Wolstencroft | |
| 3,919,028 | A | | 11/1975 | Lewis et al. | |
| 3,930,091 | A | | 12/1975 | Lewis et al. | |
| 4,587,998 | A | | 5/1986 | Egloff et al. | |
| 4,671,841 | A | * | 6/1987 | Stephens | 156/292 |
| 4,693,771 | A | | 9/1987 | Payet et al. | |
| 4,714,642 | A | * | 12/1987 | McAliley et al. | 428/113 |
| 4,816,327 | A | | 3/1989 | Binnersley et al. | |
| 4,906,506 | A | * | 3/1990 | Nishimura et al. | 428/113 |
| 4,947,897 | A | | 8/1990 | Binnersley et al. | |
| 4,980,227 | A | | 12/1990 | Sekiguchi et al. | |
| 5,395,665 | A | | 3/1995 | Planeta | |
| 5,396,932 | A | | 3/1995 | Homma et al. | |
| 5,455,107 | A | | 10/1995 | Homma et al. | |
| 5,538,049 | A | | 7/1996 | Homma et al. | |
| 5,617,902 | A | * | 4/1997 | Farley | 139/1 R |
| 5,662,146 | A | | 9/1997 | Homma et al. | |
| 5,763,069 | A | | 6/1998 | Jordan | |
| 5,783,278 | A | | 7/1998 | Nishimura et al. | |
| 6,186,185 | B1 | | 2/2001 | Khokar | |
| 6,338,367 | B1 | | 1/2002 | Khokar | |
| 6,367,513 | B1 | | 4/2002 | Cain | |
| 6,431,222 | B1 | | 8/2002 | Khokar | |
| 6,450,208 | B1 | | 9/2002 | Khokar | |
| 6,494,235 | B1 | | 12/2002 | Bruyere et al. | |
| 6,539,983 | B2 | | 4/2003 | Khokar | |
| 7,132,376 | B2 | | 11/2006 | Rashed | |
| 7,264,023 | B2 | | 9/2007 | Jackson | |
| 2002/0124900 | A1 | | 9/2002 | Khokar | |
| 2003/0116218 | A1 | | 6/2003 | Khokar | |

FOREIGN PATENT DOCUMENTS

| | | |
|---|---|---|
| DE | 908 477 | 4/1954 |
| EP | 0 589 286 | 3/1994 |
| FR | 2 142 934 | 2/1973 |
| FR | 2 522 341 | 9/1983 |
| FR | 2848227 | 6/2004 |
| GB | 1 392 329 | 4/1975 |
| JP | 01-040632 | 2/1989 |
| JP | 07-300739 | 11/1995 |
| JP | 2001-164441 | 6/2001 |
| JP | 2001-520709 | 10/2001 |
| JP | 2002-249957 | 9/2002 |
| WO | WO 97/13899 | 4/1997 |
| WO | WO 9846817 | 10/1998 |

OTHER PUBLICATIONS

International Search Report PCT/ISA/210.
International Preliminary Report PCT/IPEA/409.
English translation of Office Action mailed Jan. 4, 2001 for corresponding Japanese Patent Application No. 2007-551223.

* cited by examiner

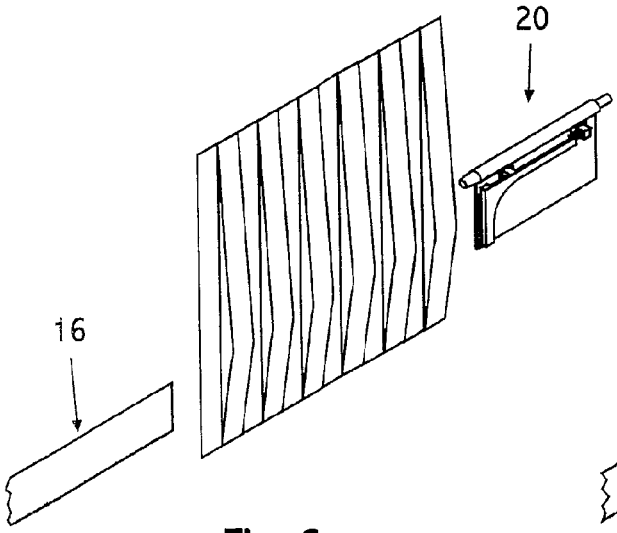
Fig. 6a
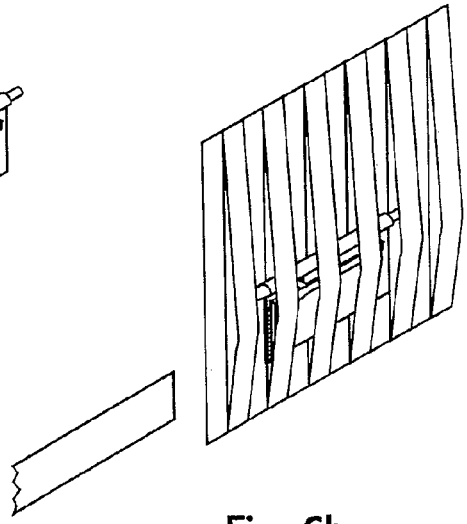
Fig. 6b
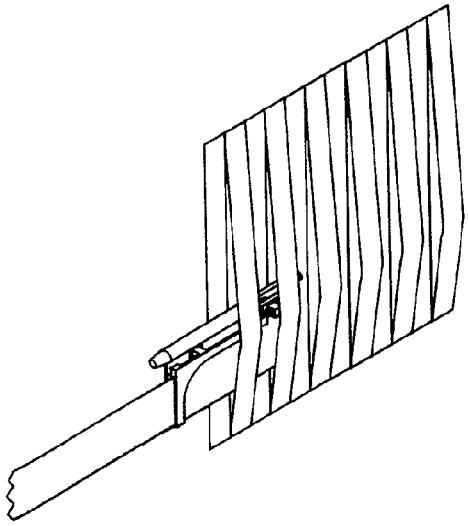
Fig. 6c
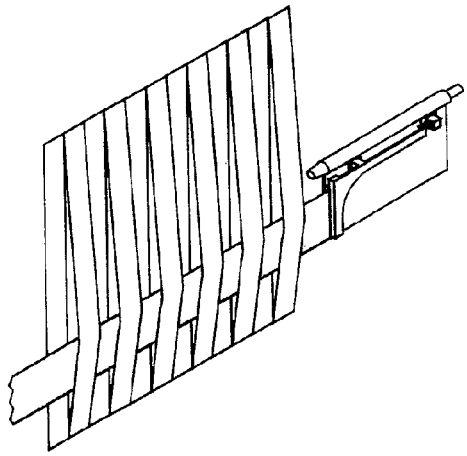
Fig. 6d
Fig. 6

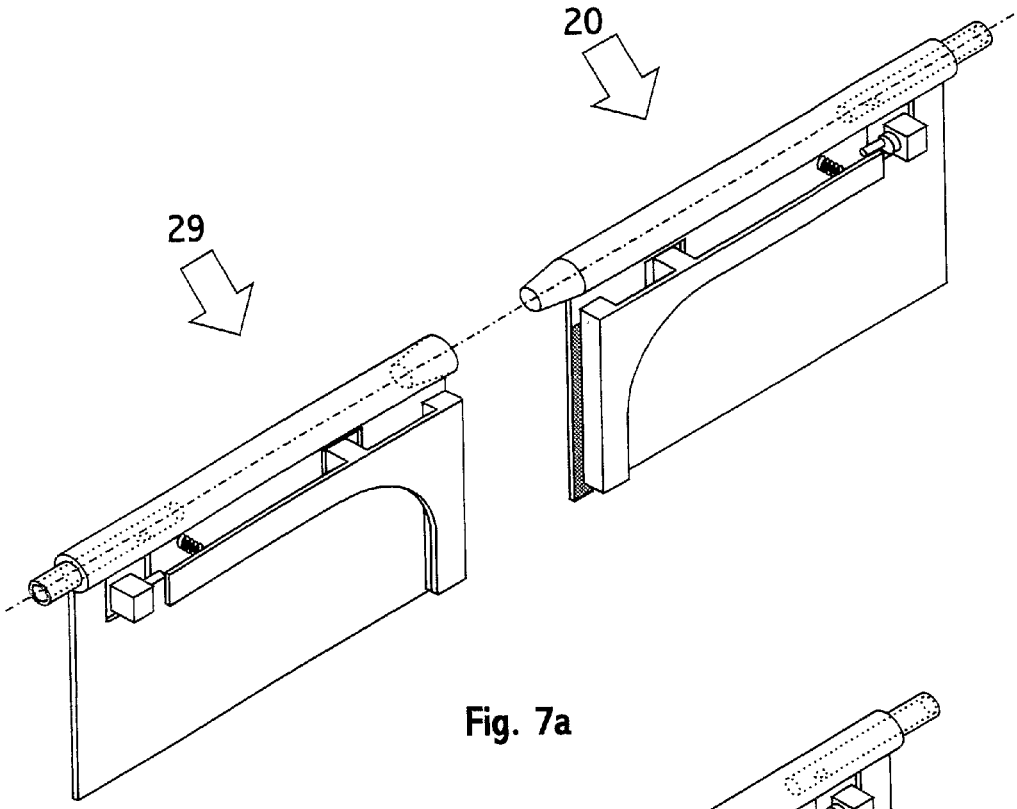
Fig. 7a
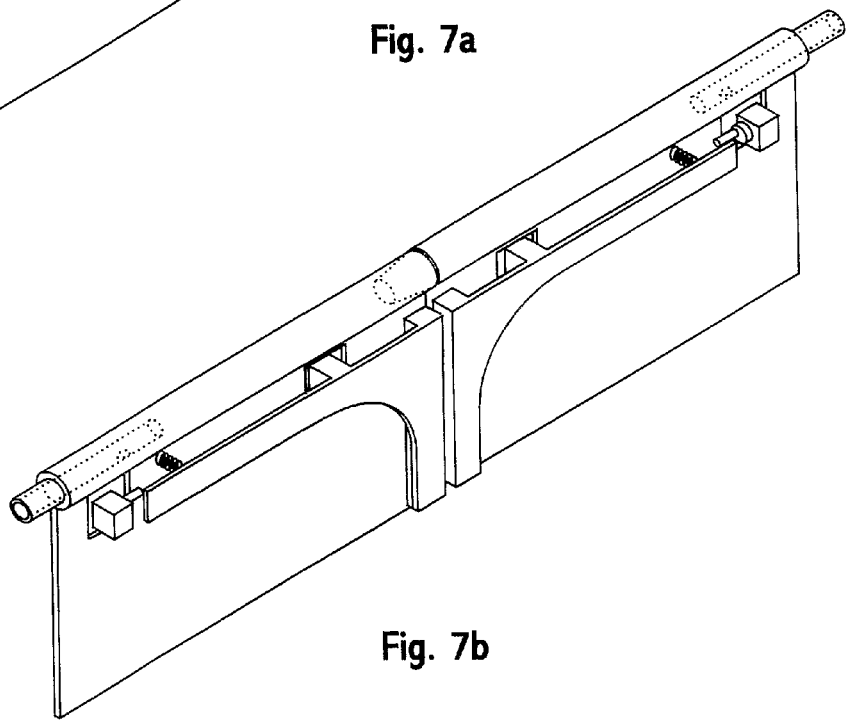
Fig. 7b
Fig. 7

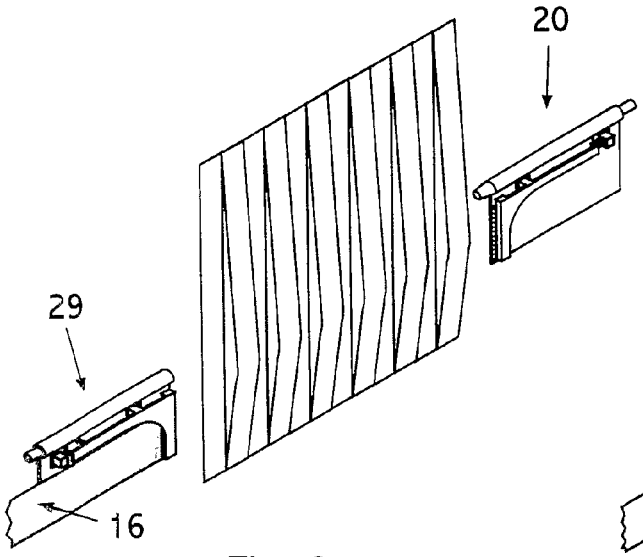
Fig. 8a
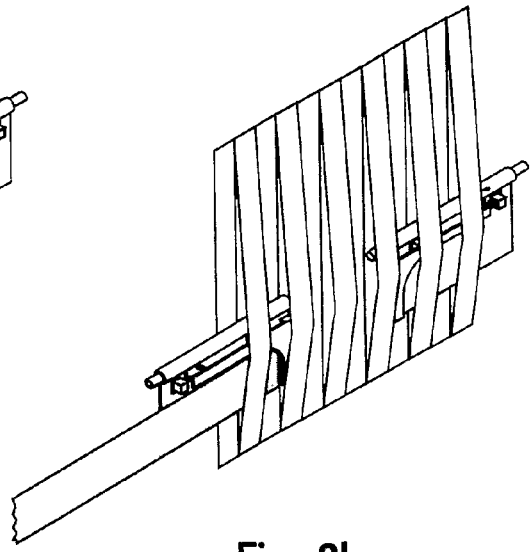
Fig. 8b
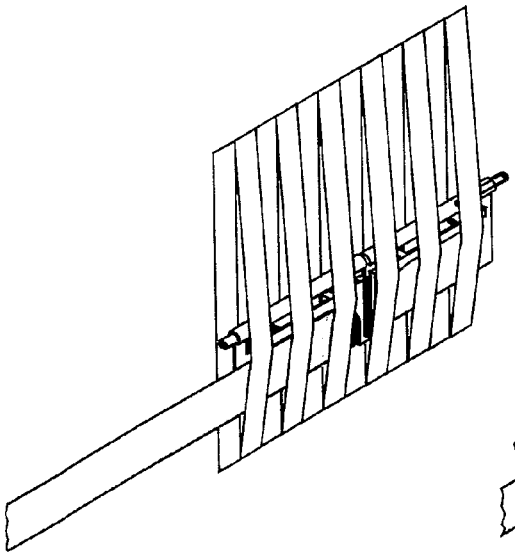
Fig. 8c
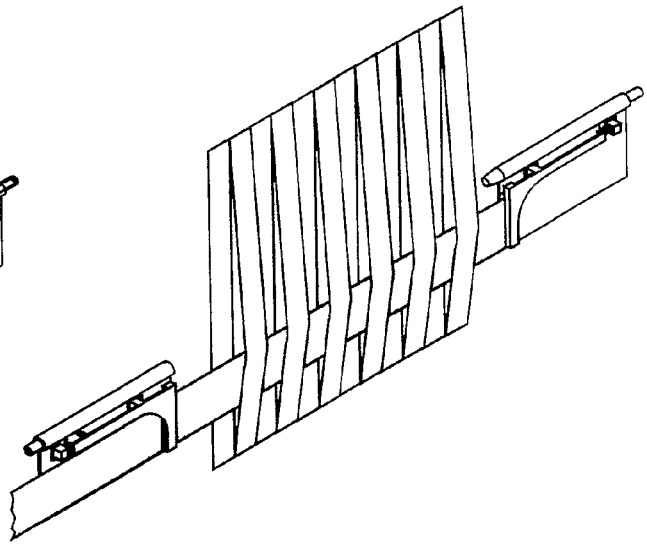
Fig. 8d
Fig. 8

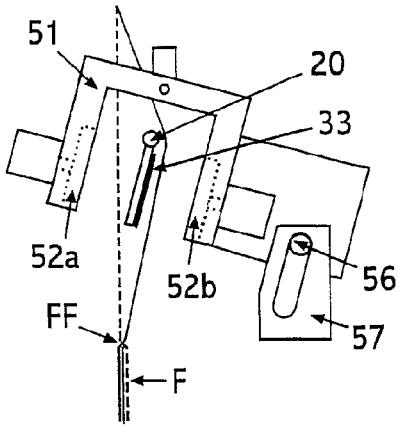
Fig. 12a
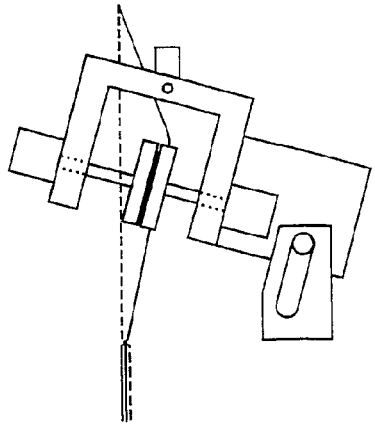
Fig. 12b
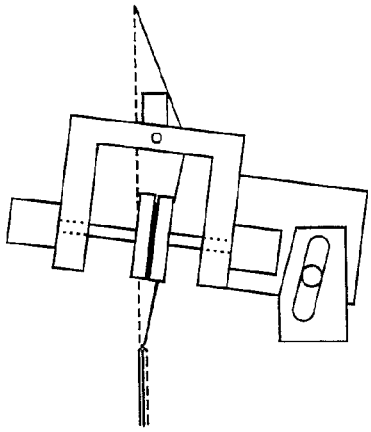
Fig. 12c
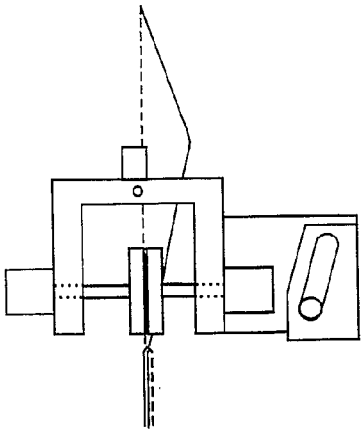
Fig. 12d
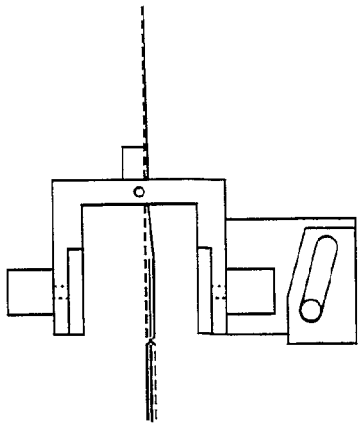
Fig. 12e
Fig. 12

WOVEN MATERIAL COMPRISING TAPE-LIKE WARP AND WEFT, AND AN APPARATUS AND METHOD FOR WEAVING THEREOF

TECHNICAL FIELD AND GENERAL DISCUSSION OF THE INVENTION

The present invention relates in general to weaving. In particular, it concerns a novel method for weaving wherein warp and weft are supplied in the form of tapes, and not yarns. This method, which is preferably carried out in vertical format, can comprise the operations of feeding positively flat tensionless warp for shedding and taking-up; selecting, feeding positively and inserting weft tapes of different widths and thickness in an untwisted flat condition; depositing inserted weft at fabric-fell in a flat condition without beating-up; and taking-up the woven material that comprises either same or different widths of flat wefts.

The warp and weft tapes are preferably of partially stabilized fibrous type. Such tapes have their fibres discontinuously connected by a suitable stiff/rigid or elastomeric/rubber-like binding agent in a way that only some fibres across the tape width are held while leaving some others free, such as represented by a broken or dashed line, which may be straight or curved, across tape width. The positions of such binding agent across the tape width at one part could be different from the positions of the adjacent but separated binding agents in width and length directions of the fibrous tape. Alternatively, the fibrous tapes could be also partially stabilized using elastomeric or rubber-like binding agent that runs continuously, such as represented by an unbroken line that may be straight or curved, across the tape width whereby the binding agent across the tape width at one part is mostly separated from the adjacent ones in the length direction of the fibrous tape. By using elastomeric binding agent there are the advantages of expanding or shrinking (for example by heating) the width of the fibrous tape and such a fibrous tape could be also sheared longitudinally, while the integrated structure/arrangement of the fibrous tape is more or less maintained. Such fibrous tapes partially stabilized with stiff or elastomeric or their combinations are henceforth collectively referred to as partially stabilized tape or partially stabilized fibrous tape. It may be noted that a partially stabilized tape can be characterized by similar or different types of binding agents, or discontinuous—continuous types of bindings, or such bindings existing on either one or both sides of a fibrous tape, or comprise straight fibres or pre-waved/pre-textured fibres or their combinations as well. Use of partially stabilized tapes is considered advantageous over known non-stabilized and wholly stabilized fibrous tapes because they can be overfed in a positive and controlled manner to make the constituent fibres occur non-linearly in the form of waves/textures during weaving. The non-linear fibres can be subsequently straightened in the woven fabric by pulling the tapes longitudinally to achieve improved fabric properties.

Further, extra warps and wefts of partially stabilized tapes can be also fed simultaneously by supplying them in tandem whereby the warps and wefts become composed of two or more unconnected, mutually slipping, flat tapes in a loose stacked arrangement (herein after called doubled warp or weft tape, or just doubled tape). Each of these doubled warps and wefts function effectively as a unit warp and weft during weaving and in the fabric. The separateness of constituent tapes of each of doubled warp and weft enables them to be slid/slipped relative to other in the longitudinal and lateral directions of the tapes without causing any alteration in the woven structure. Use of such doubled tapes helps to solve the problems of uneven fibre distribution and orientation arising from crumples/wrinkles due to compression and stretches due to extension, at the inner and outer sides respectively of a curve, and in covering undesirable openings or gaps that occur when tape-woven fabrics are curved into shapes. Thus such fabrics would conform to curved shapes effectively. Further, by using doubled warps and wefts fabrics with relatively flat/planar sections and thicker/raised wide rib sections can be also created that resemble a bit like a profiled material in its cross-section. Use of such doubled warps and wefts gives flexibility in producing directly woven fabrics with variable weight per unit area. The method also enables production of other woven materials such as those comprising weft tapes obliquely or slant in relation to the warp tapes; a formed shape within its body; and warp and weft tapes of shaped edges matched in either close or open fit configuration. The method is operable by a programme.

BACKGROUND

A method for weaving tape-like warps and wefts, and not yarns, is described in U.S. Pat. No. 6,450,208. This method describes a novel rotor type of shedding system for manipulating the tape-like warps and a method to align the laid-in tape-like weft at the fabric-fell using a set of rollers, and not the reed. Details relating to warp feeding; weft selecting, feeding and inserting; selvedge forming; and the taking-up of the woven material are however not available. The possibility of supplying warp and weft tapes of partially stabilized fibrous type in singles or in tandem to obtain doubled warp and weft tapes and overfeeding of the same to introduce non-linearity or waves/textures in the arrangement of the fibres in the tapes are also not known from this patent. The described method of aligning the laid weft tape with rolls is adequate when the weft tapes are of sandwich/bonded/laminated type, i.e. of a joint construction. Weft aligning with such rolls cannot be achieved satisfactorily when doubled wefts are inserted because the constituent tapes of the doubled weft, which exist loose or disconnected, are free to slide relative to each other. When the rolls turn, they contact and align the facing tape as it gets laterally slipped past the rear tapes. Another drawback with the use of rolls for weft aligning is that unbounded fibres get pulled out from partially stabilized and non-stabilized types of fibrous tapes. Such weft aligning rolls are also incapable of depositing weft tapes in a slant or oblique orientation in relation to the warp tapes. Further, the fabric described therein uses warps and wefts that are of sandwich/bonded/laminated type and hence the constituent tapes are not free to slide relative to each other. Also, the fibres in the fibrous tapes are unidirectionally or linearly orientated in the longitudinal direction of the tape. The described sandwich/bonded/laminated tapes are also not composed of any tapes that comprise pre-waved/textured arrangement of fibrous materials that could be straightened by pulling the tape longitudinally to re-establish fibre linearity. Consequently such a fabric does not drape effectively when formed into curved shapes, such as a cone, pyramid, barrel, helmet etc., due to crumples/wrinkles at the inner side and stretches at the outer side respectively of the curved part. Also, openings or gaps are created between adjacent tapes. Such tape-woven fabrics thus cause uneven fibre orientation and density when the fabric is curved into a shape due to different extensibilities of the constituent materials and radii of curvatures. Also, the described fabric is flat and does not comprise sections that are relatively flat/planar and thicker/raised wide ribs resembling somewhat like a profiled material in its cross-section. Further, fabrics like those comprising slant or oblique wefts in relation to warp tapes, a formed shape within its body, and warp and weft tapes of shaped edges matched in either close or open fit configuration are not known from this patent.

A method for weaving 'flat carbon fibre yarn' as warp and weft is also described in U.S. Pat. No. 5,455,107. As is apparent, this modified weaving method is based on horizontal format and traditional approach that is designed for processing yarns. Consequently it has certain limitations. For example, the described method does not appear to process tape widths greater than 16 mm; it cannot feed positively variable lengths of warps in a tensionless condition; it cannot process warp and weft tapes of different widths, constructions and materials in the same fabric; it cannot take-up fabric with variable widths of wefts; there is no selvedge formation carried out, making fabric handling difficult; its working actions, especially that of beating-up with reed and taking-up fabric with so many frictional and compression points are deleterious to the warp and weft tapes of many kinds and hence adversely affect the properties and quality of the woven materials.

Further, this method processes warps and wefts of only fibrous tapes that are either wholly unglued (i.e. non-stabilized) or wholly glued (i.e. stabilized) with a sizing agent, are very thin and of relatively small widths. As a consequence, the wholly unglued fibres in the tapes are vulnerable to lateral shifting causing their bunching in some places and openings in the other. The wholly sized or stabilized fibres on the other hand are not flexible and therefore such rigid fibres cannot be overfed positively to create non-linearity in their arrangement such as waves/textures within the tape as and when required during weaving. It may be pointed out that the orientation of fibres in both stabilized and non-stabilized types used therein is unidirectional along tape length. The use of partially stabilized fibrous tapes has not been considered.

When plied wholly sized tapes are woven as described in it and the fabric curved into a shape, the plied tapes do not take corresponding different radii of curvatures to produce the shape smoothly. Crumples and stretches are produced. A further related problem with the described woven material is that the plied warps and wefts cannot slide relative to each other when formed into a curved shape because they get clutched in their positions due to the relatively frequent interlacements from the use of relatively small widths of tapes that are processed under tension and also due to the frictional forces and adherence caused by the sizing agent in the tape. This problem gets further compounded because the sizing agent on these wholly sized tapes cracks easily when curving the fabric into a shape. These cracks occur at random locations. As a consequence, the cracking of the sizing agent also causes small bunches of glued fibres to shift laterally within the tape to create openings or gaps in the shaped fabric, and sometimes even fibre breakages. Using force to slide a clutched tape that is also randomly cracked across its width results in the bunched groups of stuck fibres to shift further in lateral directions and thereby create even wider gaps/openings in the fabric. The openings created in the fabric due to separation of the glued fibres also leads to uneven fibre distribution and orientation and thereby the performance level of the woven material gets lowered. This described phenomenon also occurs when non-stabilized or wholly unsized fibrous tapes are pulled because the fibres are free and get immediately bunched or roped creating gaps and openings in the fabric. As can be understood now, it is not advantageous to use wholly stabilized fibrous tapes and non-stabilized fibrous tapes for certain applications.

Another disadvantage of the method according to U.S. Pat. No. 5,455,107 that may be mentioned here is that because no selvedge formation is carried out, handling of the woven material is rendered difficult. Without the selvedges the wholly stabilized fibrous tapes constituting the woven material are prone to come loose at the selvedge sides easily and thereby initiate the neighbouring tapes to also shift out. The lack of selvedges has an even more adverse effect when the fabric is woven with non-stabilized fibrous tapes because then fibre-bunching or roping effect is caused at slightest deformation during handling. Undesirable gaps/openings in the fabric are immediately created in the woven material.

Further, this method cannot introduce non-linearity or waves/textures in the fibres, even when weaving with non-stabilized fibrous tapes, because there is no arrangement for overfeeding the tapes and also because the method inherently requires maintaining of tensions in warps and wefts at all times to carry out weaving. Also this method cannot produce a woven material wherein the weft tapes are incorporated obliquely or slant in relation to the warp tapes. Further, the described fabric is flat and does not comprise sections that are relatively flat/planar and thicker/raised wide ribs resembling somewhat like a profiled material in its cross-section. Also, a material that has a formed shape within its body and a material made using tapes of shaped edges are not known from this patent.

The tape constructions described in, for example, U.S. Pat. No. 5,763,069 and U.S. Pat. No. 5,395,665 are also of sandwich/laminated/bonded type in construction and their constituent stacked components cannot slide relative to each other. These tapes also do not have shaped edges.

Accordingly, there is therefore a need for an improved method and means for producing woven materials of tape-like warps and wefts, and for improving such materials. For example, it is now desirable to have a method whereby a woven fabric is produced using preferably partially stabilized fibrous type of tapes to conform smoothly with the required shape during shaping. Additionally use of doubled tapes would help to cover created gaps and also obtain fabrics of variable weight per unit area. It is also desirable to have the said features in a woven material wherein the weft tapes are incorporated not only at 90° to warp tapes but obliquely or slant as well. Further, it is also desirable to produce a form in the fabric body and a fabric with tapes of shaped edges.

The unsuitability of the conventional weaving operations and also those relating to the referred patents in the context of the present invention are considered individually in the section Description of the Preferred Embodiments.

OBJECTIVES OF PRESENT INVENTION

It is therefore an object of the present invention to provide a new method and means for producing a woven material, as well as such a produced material, which alleviates at least a part of the problems related to the prior art, as discussed in the foregoing as well as in relation to the invention in the following.

In the context of this application, partially stabilized fibrous tape is used to indicate a tape where the fibres are discontinuously connected by a binding agent in such a way that only some fibres across the tape width are held while leaving some others free. Preferably, these tapes have similar, and preferably identical, properties on both sides. Further, the material composition is preferably similar, and preferably identical, either throughout the thickness and/or at least one of the surfaces of the tapes.

Further, in the context of this application, non-linear arrangement of fibres within a tape is used to indicate fibres extending tensionless and non-linearly within the tapes, and specifically fibres at least partially extending in other directions, including out of plane, other than in the length direction of the tape. Hereby, the tapes are free in a controlled way to undergo reorientation when the tapes are bended or stretched.

As would be apparent from the provided background information, a flexible weaving process is required that can process different types of tape materials, and preferably all types of tape materials to produce woven materials for a variety of technical applications like ballistic protection, transportation belts, fluid draining sheets, geo-textiles, thermal and electricity guiding sheets, wall and roof coverings etc., and not only for composite materials application. For these and many other applications use of warps and wefts in tape form enables engineering a high performance fabric like never before. The present invention provides a method and apparatus for weaving tape-like warps and wefts in preferably vertical format and some novel fabric constructions to satisfy the varied requirements. The present invention preferably aims to provide at least some, and preferably all, of the following:

- A warp let-off device that feeds positively tensionless and constant length of tape-like warp of different widths and shapes in a flat condition for shedding,
- A warp let-off device that is equally employable to positively feed in a flat condition constant or variable lengths of tensionless tape-like warp for fabric take-up to correspond with different widths of tape-like wefts woven in a material,
- A warp let-off device that can overfeed warp lengths in a controlled way to cause non-linearity in the fibres of partially stabilized and non-stabilized types of tapes,
- A warp let-off device that can overfeed warp tapes selectively in a controlled way to enable production of a fabric that has formed shape within its body,
- A warp let-off device that can feed fibrous and non-fibrous tapes comprising pre-arranged non-linear fibres and expandable folds respectively,
- A weft feeding device that is equally employable to select and feed positively tapes of different widths, shapes materials and constructions in a flat condition and in required length,
- A weft inserting gripper that is equally employable to insert wefts of different widths, materials, shapes and constructions in the same fabric by gripping the width direction fore part of the weft tape flatly,
- A weft inserting gripper that can be driven either positively or negatively
- A weft feeding device that can overfeed weft lengths in a controlled way to cause non-linearity linearity in the fibres of the partially stabilized weft tapes,
- A weft feeding device that can overfeed weft tapes to enable production of a fabric that has formed shape within its body,
- A weft feeding device that can feed fibrous and non-fibrous tapes comprising pre-arranged non-linear fibres and expandable folds respectively,
- A weft depositing device that is equally employable to place in a flat condition tape-like wefts of different widths, shapes, materials and constructions at the fabric-fell,
- A weft depositing device that is equally employable to place tape-like wefts in either 90° or oblique/slant orientation relative to tape-like warps,
- A weft depositing device that is equally employable to place tapes that have shaped edges in either close or open matching fits with the adjacent tape,
- A selvedge forming device that is equally employable to fix in a flat condition the extending ends of wefts of either same or different widths, materials and constructions,
- A fabric take-up device that is equally employable to wind-up woven material comprising wefts of either same or different widths,
- An arrangement for supplying extra warp and weft tapes in tandem to obtain doubled warps and wefts and to cause controlled waving/texturing of the fibres in the respective tapes that are of partially stabilized type by overfeeding them as and when required,
- A woven material comprising at least some warp and weft tapes that are preferably of partially stabilized fibrous tapes,
- A woven material comprising at least some single warps and wefts that are of preferably partially stabilized type of fibrous tapes whereby the constituent fibres have non-linear or waved/textured arrangement,
- A woven material comprising at least some doubled warps and wefts wherein the unconnected tapes constituting each of such doubled warps and wefts could be slid/slipped relative to each other longitudinally and laterally by pulling, and at least one of the tapes constituting the doubled tape is of either partially stabilized or non-stabilized types of fibrous tapes that when overfed causes non-linearity in the fibres by way of waves/textures,
- A woven material comprising non-linear fibres that can be straightened by pulling in the longitudinal direction to re-establish fibre linearity in the tapes without altering the woven structure to achieve uniform fibre distribution and orientation,
- A woven material comprising either at least some single or doubled warps and wefts such that the fabric resembles a bit like a profiled material in its cross-section and thus have a variable weight per unit area,
- A woven material comprising slant/oblique weft tapes relative to the warp tapes,
- A woven material that has a formed shape within its body, and
- A woven material comprising warp and/or weft tapes of shaped edges.

BRIEF DESCRIPTION OF THE DRAWINGS

The present invention is described in reference to the following drawings:

FIG. 6 exemplifies a sequence of events for inserting weft tape using a single rapier device.

FIG. 7 exemplifies the gripper heads of the double rapier device for inserting weft tapes.

FIG. 8 exemplifies a sequence of events for inserting weft tape using a double rapier device.

FIG. 12 exemplifies the working sequences of weft tape's deposition at the fabric-fell position.

DESCRIPTION OF THE PREFERRED EMBODIMENTS

Figure 1:
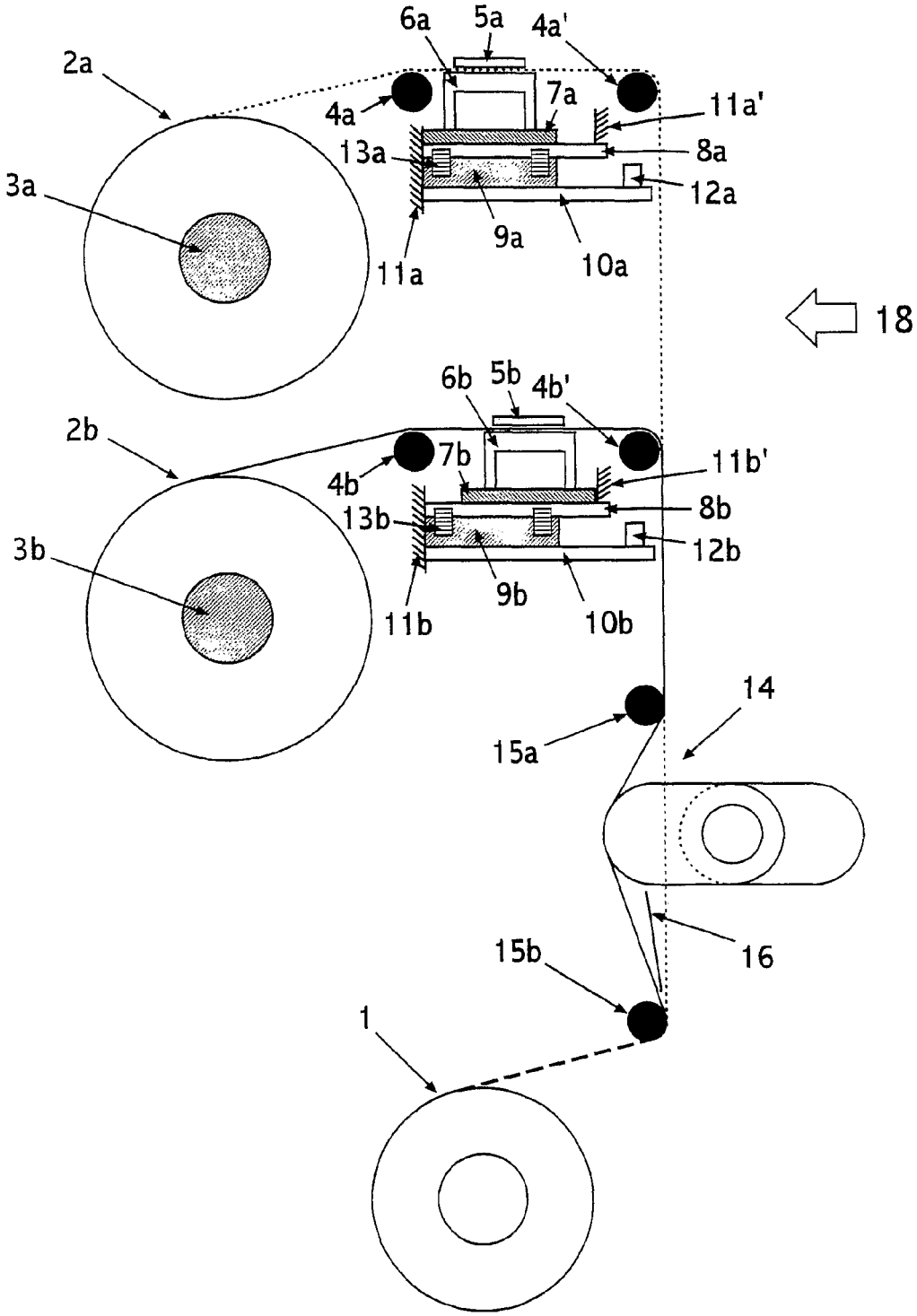
FIG. 1 exemplifies the side view arrangement for feeding positively tensionless warp for shedding.

The various embodiments of the present invention are described individually now. Production of plain weave material is exemplified to describe the spirit of invention although any other weave could be as well produced. To present the invention in the right context an introductory reference to the relevant background aspects of each of the operative systems is individually described.

(a) Device for Feeding Tensionless Warp for Shedding and Fabric Taking-Up:

In traditional weaving the warp yarns are usually collectively wound on the warp beam and supplied horizontally to the weaving apparatus by the warp let-off system. For weaving most materials one warp beam is used. In the case of terry weaving two warp beams are used: one for producing the loops and the other to produce the ground fabric. Multiple beams are also employed, for example when weaving relatively thick materials like conveyor belting cloth. In manufacturing certain special products individual warp yarns are also drawn from bobbins in a creel and fed to the weaving apparatus.

Notwithstanding these different arrangements, the warp yarns are maintained under high tensions all the time for the purposes of (1) creating a clear shed for unhindered weft insertion, (2) achieving satisfactory beating-up and (3) winding-up satisfactorily the produced fabric. While warp tensioning is a necessary condition for processing yarns, it is not desirable when processing tapes. This is because a tape, especially the fibrous type, tends to shear and deform or bunch together easily under tension during their interaction with various machine elements during weaving and thereby lose their form. It is therefore advantageous to have a weaving method wherein it is possible to feed and process tape-like warps in a tensionless state. To achieve this it is preferable to carry out weaving in a vertical format because this way the sagging of warps and wefts due to gravity is significantly reduced.

The existing warp let-off devices, which are of either negative or positive types, are designed for supplying yarns. Because maintaining tension in warp yarns is indispensable in conventional weaving, the existing let-off systems cannot perform overfeeding of warp yarns to cause their controlled waving/texturing. They also do not feed tensionless warp to the shedding system to ease the tensions when the shed is opening and retract them back subsequently to close the shed each time. Apparently it cannot overfeed warp yarns. It is thus relevant to mention here that the warp let-off device employed in the method according to U.S. Pat. No. 5,455,107 is of the negative type, as its design requires the yarns to be pulled by the fabric take-up system. The warp is thus always under tension.

Further, the warp yarns making up the top and bottom sheets/layers of the shed cannot be controlled individually and alternately (e.g. when producing plain weave) by either of the conventional warp let-off systems. The positive warp feeding system also cannot overfeed warp yarns and it basically functions to release a preset length of warps for every weft insertion to uniformly space the wefts in the fabric during take-up and at the same time maintain the required high tensions throughout fabric production. Such a regular weft density in the fabric is achieved by the positive let-off system, which regulates the surface speed of the warp beam throughout weaving because the warp beam diameter decreases as the warp beam gets depleted. Through this system a constant length of warp is released regularly for take-up.

The high tensions created in traditional weaving methods, especially during shed opening, are to a large extent absorbed by the elasticity of the warp yarn material itself and the relative arrangement of the distances between the positions of the back roll over which the warp yarns are drawn from the warp beam, the shedding healds and the fabric-fell. Further, these warp let-off devices are incapable of subjecting the warp yarns of different materials to correspondingly different tensions at the same time during shedding operation because the extensibility of materials varies. Apparently, warps of fibrous materials having highly different elastic properties are difficult to process.

The practical consequences of working with high tensions are well known: breakages of warp yarns, high wear and tear of components concerned and the unevenly tensioned construction of the woven material. Notwithstanding the required meticulous preparation of the warp and the robust construction of the machine, the cost-to-performance of the final product eventually matters significantly.

Another important point here concerns the relationship between warp let-off and cloth take-up to regulate the pick or weft spacing. It is established knowledge that for a given fabric construction, the pick spacing is controlled by fabric take-up operation, which is set in advance and is invariable during fabric production. It means that only a certain width (diameter) of weft can be processed. In other words, the existing warp let-off systems cannot give out variable lengths in case if tape-like wefts of significant variation in its width (e.g. preferably 20 and 50 mm) are to be woven within the same fabric.

The existing warp let-off devices are unsuitable for processing tape-like warps for other reasons as well. Because the tapes are manufactured and supplied in rolls, they offer the advantage of being used directly without conversion into the usual warp beam. The possibility of using rolls directly saves not only time and effort but also eliminates the risk of contaminating the fibres, which are usually expensive high-performance materials. The direct use of rolls helps in maintaining the delivered tensions. Avoidance of rewinding tape rolls also preserves the properties to the fullest possible level by preventing fibre damage. Deformation of tape, either permanent or temporary, especially like metallic foils, fibrous tapes of boron, carbon, and synthetic materials, polymeric films, or their combinations etc. is also avoided.

Finally, these existing warp let-off devices cannot supply warp yarns in a stacked arrangement (i.e. doubled warp) to enable production of a woven material that correspondingly comprises warp yarns in a stacked arrangement.

From the foregoing presentation it would be clear that when weaving with tape-like warps, especially partially stabilized fibrous tapes, they should be fed positively in a constant length and tensionless condition for shedding and preservation of properties, fed positively in variable or constant lengths and tensionless condition for enabling take-up of woven material when tape-like wefts of varying or constant widths are woven in the same fabric material, and overfed positively in a controlled manner to cause non-linearity in fibres. The warp feeding device or system according to present invention achieves these objectives and is described in reference to FIG. 1 and FIG. 2 respectively.

A unique characteristic feature of the present device is that to produce woven material (1), the warp tapes are supplied vertically and in a split arrangement (18) wherein the warp rolls are divided into two groups (2*a*, 2*b*) each of which alternately identifies itself with the top and bottom sheets/layers of the formed shed. Each of the tape rolls of groups (2*a*, 2*b*), which have a hollow centre (3*a*, 3*b*), can be mounted directly on the respective stationary supports by sliding them from one end. A split mounting arrangement is desirable because the warp tape rolls (or roll of any material for that matter) can never be built with flat or smooth sides. Putting uneven surfaced warp tape rolls adjacent to each other will cause friction between rolls and hence their improper rotation and varied tensioning of warp tapes throughout the weaving process. By employing the split arrangement the tape rolls can be placed separated from each other and thereby friction between them can be avoided to enable their proper and free rotation. Such an arrangement also offers the advantage of using large and small diameter rolls at the same time as might happen when processing a fixed length of relatively thicker and thinner tapes.

The main parts of warp feeding device (18) designed to supply constant length of tensionless warp for shedding, includes tables (6*a*, 6*b*) fixed on plates (7*a*, 7*b*) and clamping units (5*a*, 5*b*) mounted on tables (6*a*, 6*b*). The arrangement is such that the tables (6*a*, 6*b*) together with the mounted clamping units (5*a*, 5*b*) can be reciprocated between fixed points (11*a*, 11*a*' and 11*b*, 11*b*') by sliding plates (7*a*, 7*b*) over slide plates (8*a*, 8*b*).

To control feeding warp of different lengths for fabric taking-up such as when weft tapes of different widths are used in the same fabric, in addition to the parts mentioned above, the following parts are involved. Blocks (9*a*, 9*b*) are fixed to slides (8*a*, 8*b*) through connectors (13*a*, 13*b*) and movable stop-blocks (12*a*, 12*b*) are fixed on slide plates (10*a*, 10*b*). This set up allows reciprocation of blocks (9*a*, 9*b*) between the points (11*a*, 12*a* and 11*b*, 12*b*). It may be noted that the position of blocks (12*a*, 12*b*) can be changed on slide plates (10*a*, 10*b*). As the tables (6*a*, 6*b*) with clamping units (5*a*, 5*b*) are connected to the blocks (9*a*, 9*b*) through the plate (7*a*, 7*b*) and the slides (8*a*, 8*b*) by connectors (13*a*, 13*b*), reciprocation of blocks (9*a*, 9*b*) will also cause reciprocation of all the parts connected to it. Through this split arrangement the warp tapes (2*a*, 2*b*) clamped between (5*a*, 6*a* and 5*b*, 6*b*) can be reciprocated independently by moving either plates (7*a*, 7*b*) for shedding purpose and blocks (9*a*, 9*b*) for fabric taking-up purpose.

The working of the novel warp feeding device (18) is described now. Warp tapes corresponding to the two groups (2*a*, 2*b*) are drawn out from their rolls and guided over respective pairs of guide rolls (4*a*, 4*a*' and 4*b*, 4*b*'). The level of the guide rolls (4*a*, 4*a*' and 4*b*, 4*b*') is preferably kept such that when the warp tapes are passing tangentially straight over them, the top surfaces of the tables (6*a*, 6*b*) are more or less in contact with the underside of the tapes. The guide rolls (4*a*, 4*a*' and 4*b*, 4*b*') can be provided with spacer rings, if required, to accommodate warp tapes between them. These spacer rings will maintain each of the warp tapes in their respective assigned positions through out the weaving process.

The clamping plates (5*a*, 5*b*) occur over the warp tapes. These clamping plates (5*a*, 5*b*) can be pressed on to the respective tables (6*a*, 6*b*) by any suitable mechanical means to exert required pressure on the warp tapes (2*a*, 2*b*) to achieve the desired clamping action. To avoid causing damage to the constituent fibres of the tapes, the area of plates (5*a*, 5*b*) coming in contact with the tapes (2*a*, 2*b*) is preferably made using smooth, soft and low-frictional material. Alternatively, cylindrical bars can replace each of the plates (5*a*, 5*b*) to achieve the same purpose.

Figure 2:
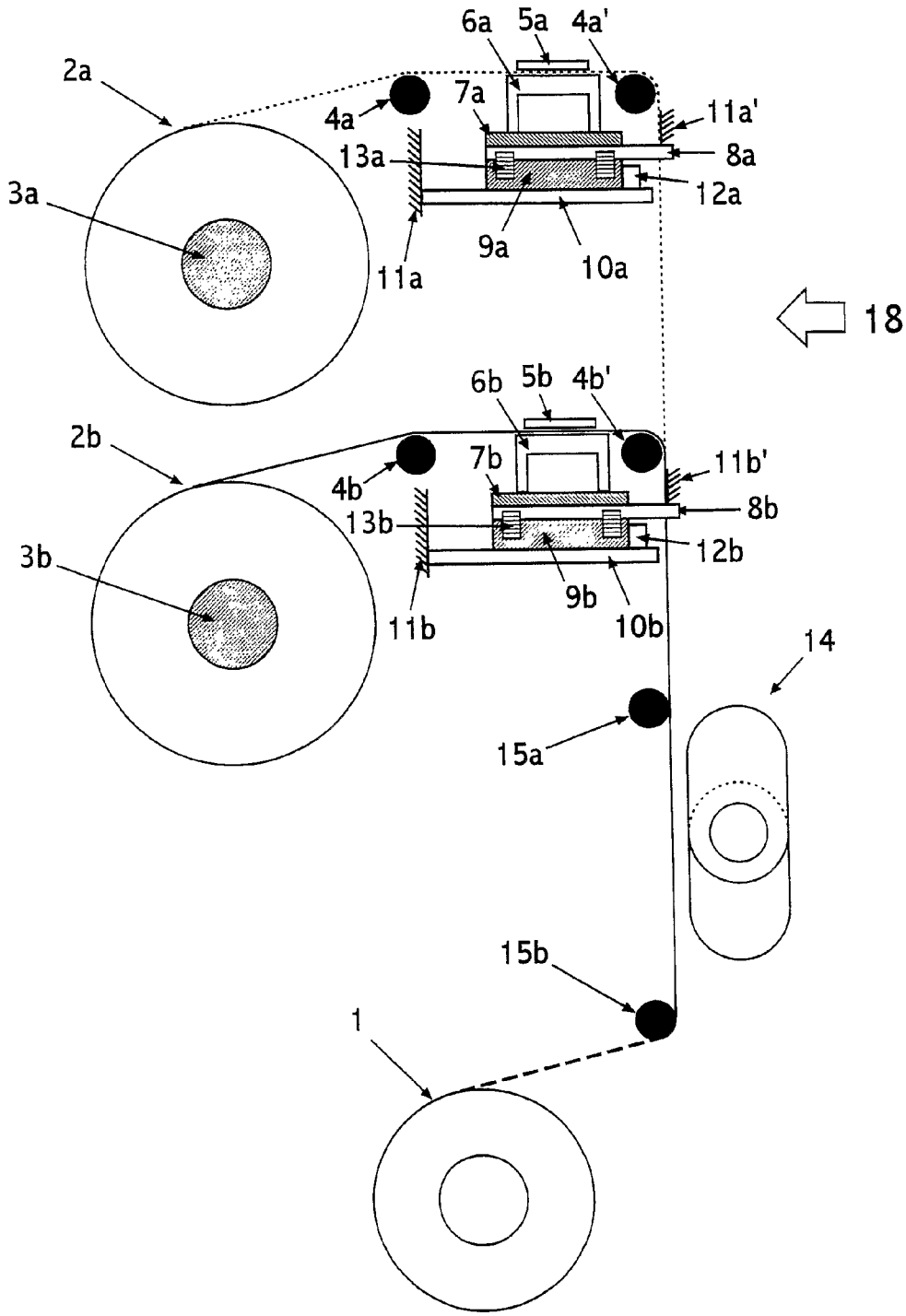
FIG. 2 exemplifies the side view arrangement for feeding positively tensionless warp for fabric take-up.

While warp tapes (2*a*, 2*b*) are under the clamping action of plates (5*a*, 5*b*) and tables (6*a*, 6*b*), one of the warp groups, e.g. the lower group shown in FIG. 1, is moved towards the front position (11*b*') by sliding plate (7*b*). This way a precise constant length of warp (2*b*) in flat condition is fed positively toward the shedding zone just when the shedding operation occurs and thereby tensionless warp is delivered to the shedding system (14) to form the shed between the points 15*a* and 15*b*. To close the shed after insertion of weft (16), the sliding plate (7*b*) is simultaneously moved to its back position (11*b*) when the shedding system also reverts to its level position (as indicated in FIG. 2). This way the warp tapes, which are under clamping action, are pulled back in a flat condition to close the shed when the warp also levels.

The same procedure is repeated again for the next cycle when the top warp group is moved forward to deliver tensionless warp in flat condition for shed formation. The motion of this tensionless warp supplying device is synchronized with that of the shedding operation. It may be pointed out here that the warp rolls do not have to be reciprocated during feeding and retraction; they remain mounted on their stationary or non-reciprocating supports but are free to turn axially. Also, the described arrangement could be installed such that the tables (6*a*, 6*b*) are incorporated vertically and not necessarily as indicated in FIGS. 1 and 2. Through such an organisation the partially stabilized and non-stabilized fibrous tapes when overfed would acquire relatively greater non-linearity of fibres in the tapes.

It may be noted here that the warp length fed under tensionless condition for shedding is always constant for a given shedding system and depends on the shed height created by the particular design of the employed shedding system (14). Depending on the type of means for shedding employed, either one or both sheets/layers of tape-like warps that form the shed are possible to be supplied individually to the shedding system. FIG. 1 shows the shed formed by feeding only one warp sheet/layer to the shedding zone while the other is not fed and maintained straight in its level position. The described tensionless warp feeding device or system is advantageous in that it is independent of the warp widths and thickness used and suitable for any material and without requiring any changes in its settings. Further, a vertical tensionless warp feeding system also enables controlled overfeeding of partially stabilized fibrous tapes and non-stabilized fibrous tapes to cause waving/texturing of the fibres within the tape. As warp tapes are always delivered in a flat and under tensionless conditions for shedding, the structure and properties of warp tape material are preserved.

The warp feeding device (18) for enabling fabric take-up is described now. Referring to FIG. 2, after the weft has been inserted and placed at the fabric-fell position, and the shed is levelled, both groups of warp tapes (2*a*, 2*b*), which are under the clamping action of (5*a*, 6*a* and 5*b*, 6*b*), are moved from their back positions (11*a*, 11*b*) to the front positions defined by the location of stop blocks (12*a*, 12*b*) by moving blocks (9*a*, 9*b*) towards stop blocks (12*a*, 12*b*) and thereby feed warp tapes positively in a flat and tensionless condition. At the same time, the take-up device is activated and the delivered length of tensionless warp (and fabric) is wound onto the fabric roll (1) and the fabric-fell position established again for the next weaving cycle.

The length of warp required to be delivered every cycle, especially when a fabric is required to be woven with different widths of tape-like wefts is described now. This is controlled by altering the position of the stop blocks (12*a*, 12*b*) on the slides (10*a*, 10*b*) as and when required. By changing the positions of the stop block (12*a*, 12*b*), the distance of reciprocation of blocks (9*a*, 9*b*) is correspondingly altered and the reciprocating blocks (9*a*, 9*b*) can be halted at the desired specific point. This way it becomes possible to weave a fabric in which weft tapes could vary substantially from one to the next (e.g. using 20 and 50 mm wide tapes).

The stop blocks (12*a*, 12*b*) can be moved to any desired position on slides (10*a*, 10*b*) by, for example, having the stop block (12*a*, 12*b*) controlled by a suitable threaded rod. The threaded rod's direction of turning will increase and reduce the distance between the blocks (9*a*, 9*b*) and stop blocks (12*a*, 12*b*). Its direction and period of turning can be controlled using suitable motors. Through such an arrangement the reciprocating distance of the blocks (9*a*, 9*b*) can be precisely controlled and thereby the length of warp to be delivered for taking-up, including that required for overfeeding of warp tapes.

As the length of warp required to be delivered every cycle is directly dependent on the width of the inserted tape-like weft, suitable sensors can determine the width of weft tape either directly or indirectly, and either before or after weft insertion. Once the width of the weft is determined, the threaded rod can be activated automatically at the proper moment to alter the position of the stop blocks (12*a*, 12*b*) accordingly. By moving the blocks (9*a*, 9*b*) toward the positioned stop block (12*a*, 12*b*), the warp tapes of specific length from both groups (2*a*, 2*b*) can be fed simultaneously without tension for taking-up.

After the fabric has been taken-up, the clamp plates (5*a*, 5*b*) are released from its pressure source and the blocks (9*a*, 9*b*) reverted to their back positions (11*a*, 11*b*) so as to be ready for action in the next cycle. It may be mentioned here that the weight of plates (5*a*, 5*b*) (or if rollers are used instead) is chosen to just exert minimum pressure on the warp tapes to keep them flat to ensure precise measuring and feeding of tensionless warp tapes for both shedding and taking-up activities.

The described device (18) for feeding positively warps without tension and in a vertical format for shedding and taking-up can be achieved mechanically, electrically/electronically, pneumatically or by their combinations etc. and operated using a computer programme.

It will be apparent that the idea described above can be applied for both collective and individual feeding of tensionless warps for shedding and taking-up fabric. It can be also employed for processing partially stabilized, non-stabilized and stabilized types of fibrous tapes, rigid and flexible types of warp tapes as well as tapes of different widths, materials and constructions. As a tape-like warp is many times greater than the width (diameter) of yarns, it also becomes possible to incorporate several relatively compact feeding units adjacent to each other by suitably constructing the arrangement according to the described principle and thereby control individual tape-like warps equally well, for example when producing a fabric material that has a formed shape within its body. When warp tapes are supplied with a protective film/paper between layers, a system to continually remove and collect the waste film/paper can be included. This waste film/paper can be removed and collected separately and directly near the supply rolls, as the waste film/paper does not have to be passed through the clamping arrangement (5*a*, 6*a* and 5*b*, 6*b*). Such a waste remover and collector could be in principle similar to the type that will be described next for collecting waste paper/film from the weft supply roll.

Additional warp feeding devices or systems like the one described above can be also arranged to supply extra warp tapes in tandem so that two or more tapes occur stacked one above the other. Each of these additional feeding systems can be controlled to positively overfeed each of the partially stabilized type of fibrous tapes constituting the doubled warp tapes differently and thereby cause the fibres therein to get correspondingly differently waved/textured. A tandem supply as described also helps in producing a woven material comprising relatively thicker, stiffer and heavier warp tapes because through the split warp feeding supply is made of individual warp tapes, which are relatively thinner, pliable and lighter before being combined together into one doubled warp tape. The positive overfeeding is achieved by moving the tables (6*a*, 6*b*) of each extra-arranged unit with the warp tapes clamped on it to slightly different reciprocating lengths by altering the positions 11*a*' and 11*b*' correspondingly of each unit. Because the warp is fed vertically and positively in a tensionless condition the created waves/textures of fibres in the tapes remain non-stretched when getting interlaced. Overfeeding of the warp tapes can be carried out as and when required and not necessarily during every feed.

By this vertical arrangement of tensionless warp feeding in a controlled and positive manner the constituent tapes of doubled warp, which are neither physically joined nor chemically bonded, function effectively together as a unit warp for shedding and inclusion in the fabric. Accordingly, the constituent tapes of such a doubled warp are free to slide past relative to each other when pulled. Also, at the same time the waved/textured fibres get extended uniformly due to the fibrous tapes being correspondingly differently overfed. An important feature of such a fabric construction is that the woven structure is not altered when a tape constituting the doubled warp is pulled and slipped or slid relative to other.

A tandem supply of tape-like warps as just described is not employable when using yarns because two or more yarns are not possible to be stacked. Through the described tandem supply of required warp tapes it becomes possible to produce a woven material with doubled warps that has sections of relatively thicker/raised wide ribs in the fabric length direction. Such a fabric, which resembles somewhat like a 'profiled' material across its width direction, possesses a variable weight per unit area. Such profiled fabrics could be also produced using relatively thicker and thinner single tapes. This profiled fabric and also some other fabric constructions will be described later.

Such novel woven materials can be produced using tapes that are of either partially stabilized or non-stabilized types of fibrous tapes and made from one or more variety of fibres from a selection of thermoplastic/polymeric/synthetic, metallic, organic, inorganic, natural vegetable and animal fibres, carbon, boron, ceramic, glass, optical etc. A combination of some of them together with stabilized type of fibrous tapes and non-fibrous tapes of said materials that are flat solid, profiled on one side and flat on the other, shaped at edges, perforated, embossed, corrugated, tapered, smooth, rough, transparent, opaque, translucent, coloured, colourless, adhesive bearing, and their combinations are equally well usable according to end-application needs.

(b) Devices for Inserting, Feeding, Selecting Wefts

Inserting Weft

The second half of last century brought forth many advances in weaving aimed primarily at increasing the production speed. All these advances can be ascribed to the development of novel weft insertion systems and subsequent supportive development of weft measuring and feeding devices. Today it is possible to insert wefts at high speeds (m/s) and insertion rates (cycles/min). Shuttles, projectiles, rapiers and fluid jets are all well known in the field. Weft insertion by frictional drive is also known. The common feature among all these devices and methods is that they have been devised for handling yarns. They are not suitable if the weft is in the form of a wide tape, for example preferably in the range 20 to 50 mm. Apparently they will be also not suitable if different widths and thickness/areal weights of weft tapes are to be woven within the same material and if rigid and delicate tapes too are to be handled.

When processing yarns there is not much difference between its width and thickness because the yarn is more or less considered circular in cross-section. However, when processing tapes there is a significant difference. Weft tape sags or bends down when inserted horizontally due to gravity. This problem is considerably overcome by inserting weft tape upright or vertically as the bending stiffness or resistance increases because the moment of area is greater than that of thickness. Inserting weft tapes in a sagging condition is of course not desirable. Suffice to say that a new device or system is required for handling tape-like wefts composed of different widths, thickness/areal weight, materials and constructions. Knowing also that the constructions of yarn and fibrous tapes are different, horizontal weft insertion methods employing shuttle, projectile, fluid jets cannot be considered at present when weaving of tape-like warp and weft has just begun to evolve. Inserting tape-like weft using frictional drive could be an option, but it will fail when these tapes are of only fibrous nature (just as the earlier idea did not succeed practically with propelling yarn) and of delicate, fragile, flimsy and brittle construction. Frictional drive method could be employed with suitable modifications when tape-like wefts are of rigid/stiff nature. However, use of such a device would substantially limit the flexibility of the weaving device because non-rigid tape-like wefts cannot be inserted.

In the circumstances, the rapier and projectile methods of weft insertion appear to be possibilities. The main difference between them is that the former inserts weft under positive control (weft gripper remains connected to its driving source through the carrying band/rod) and the latter under negative control (weft gripper is not connected to its driving source because it is propelled). The two types of rapier gripper systems that exist are the loop transfer and the 'tip' transfer. While the former refers to unfolding a looped/doubled/hairpin-like weft yarn half way in the shed, the latter concerns drawing in the weft yarn singly by hooking the looped fore part of the yarn which gets unfolded during release from the gripper at the exit side of the shed. In any case both these rapier type grippers require a weft feeding system that positions the weft yarn such that it can be gripped by hooking. The bending deformation in a yarn due to hooking is too minute to be noticeable and of no consequence to quality aspect. On the other hand, the bending deformation in tapes, especially fibrous types, causes structural collapse and hence quality and appearance. It is neither possible for these grippers to grip directly a yarn nor grip the tip or fore part of the yarn without looping. To enable hooking and gripping of the weft yarns, these grippers require the weft yarn to be fed/positioned at an angle with respect to the longitudinal axis and in a suitable plane of the gripper to form a loop or bend for engagement. If a fibrous tape-like weft is fed at an angle to such grippers they tend to crumple/deform not only because of hooking action but also due to shear deformation caused by the pulling force of the rapier which is not parallel with the longitudinal axis of the weft tape owing to angular feeding of the weft tape. Accordingly, these rapier grippers cannot receive directly and grip flatly the tape-like weft. They cannot also pull the tape-like wefts in a way that the longitudinal axes of the tape-like weft and the rapier gripper movement are nearly parallel and in the same plane to prevent shear deformation of weft tape. Further these rapier and projectile grippers cannot transport a weft tape whose one of the longitudinal edges passing through the shed remains entirely facing the fabric-fell. With the rapier system the fore part of a tape gets bent when looping for gripping and hence its longitudinal edge does not entirely face the fabric-fell.

Similarly the projectile type gripper cannot be employed to insert tapes because they cannot grip the entire weft width that could be many times its thickness and hence cannot transport a weft tape wider than its thickness through its guiding channel. Its relatively small gripping area is also not suitable for fibrous tapes because the gripped fibres/filaments can be easily pulled out from rest of the tape. Also, the projectile gripper cannot grip by itself the tip or fore part of weft yarn directly. The leading end of a weft length is held by an external feeder to position the yarn between the opened tongs of the gripper for engagement. Further, with the projectile gripper the weft tape would be inserted with its longitudinal edge facing/turned away from the fabric-fell. As a consequence, the weft tape, especially of the fibrous type, cannot be incorporated flatly in the fabric and abutting with the fabric-fell because it would get deformed when the warp or shed closes. Inclusion of deformed weft tapes would adversely affect the fabric performance and appearance.

It is important to note that although the rapier and projectile grippers grip the weft indirectly, they are not interchangeable, i.e. a rapier gripper cannot be taken off its driving band/rod and propelled into the shed like a projectile gripper. Similarly a projectile gripper cannot replace a rapier gripper. Therefore, it would be advantageous to have a gripper that can be commonly used with the rapier and projectile systems. It could be either latched onto driving bands/rods to function like rapier system or just propelled to function like a projectile through correspondingly suitable constructional changes and driving arrangements.

Clearly, to transport tape-like wefts a new gripper is required. In particular, it would be advantageous if the new gripper possesses at least one, and preferably all, of the following features: (1) it can itself directly receive the fore part of the tape-like weft without the use of a weft feeder, (2) it grips the entire width of tape-like weft in a flat condition without causing bending deformation, (3) it has the longitudinal axis of the gripped/clamped tape-like weft essentially in its plane and nearly parallel with its own longitudinal axis such that no shear deformation is caused in tape-like wefts when pulled by the gripper, and (4) it enables transportation of the tape-like weft with one of the longitudinal edges entirely facing the fabric-fell. It is also desirable that such a gripper is employable to function either with rapier bands/rods or like a projectile. Such a gripper should be also suitable for inserting tapes of different widths, thickness, materials and constructions.

It is relevant to refer again to U.S. Pat. No. 5,455,107 wherein a single horizontal rapier gripper system of the so-called 'tip' transfer type is employed for inserting 'flat carbon fiber yarn'. Such a conventional horizontal system could be adequate when the width of the tape-like wefts is relatively small, such as up to about 16 mm, to loop it for hooking. As described in this patent, the rapier gripper requires that the 'flat yarn' weft tape be passed cross-wise over it to enable hooking. However, cross-wise presentation of the weft tape causes the tape's fore looped part to undergo bending deformation (crumpling) immediately when the rapier hooks and shear deformation (bunching of fibres) of some tape length when the tensioned weft tape is pulled into the shed due to the non-parallel axes of the tape and the gripper. The 'flat carbon fibre yarn' weft thus looses its flat form, if not wholly then at least for a considerable length, which consequently is wastage of material. Also, even if a sizing agent is applied to a 'flat weft yarn' tape to maintain its flatness, the cross-wise hooking by the rapier gripper causes cracking of sizing agent and pleating/wrinkling of the tape at the hooking area. Further, the described rapier gripper can neither grip the entire width of the weft tape and handle tape-like wefts of relatively greater widths and thickness in a flat condition nor handle rigid tape-like weft materials and tapes made from metallic foils, polymeric films and stabilized fibrous tapes without deforming them, which would be unacceptable from quality point of view. They are also not capable of inserting different widths of weft tapes in the production of same woven material as evidenced by the absence of a selector for presenting weft tapes of different widths. Also, this weft yarn gripping arrangement does not enable insertion of the entire longitudinal edge of the weft tape facing the fabric-fell because the fore part of the tape is looped for hooking. Likewise, the grippers indicated in, for example U.S. Pat. No. 4,947,897 and U.S. Pat. No. 3,587,661, have same shortcomings because they are of same kind and work like the one described in U.S. Pat. No. 5,455,107.

As can be seen now, to maintain complete flatness of the weft tape, the weft tape is preferably inserted by a gripper that grips the entire width of the weft tape directly and flatly, (i.e. without the aid of any device and without crossing the tape over the gripper for hooking to prevent crumpling). The gripper should also preferably include the longitudinal axis of the weft tape in its plane and maintain it nearly parallel to its own longitudinal axis to prevent tape's shear deformation. Furthermore the gripper should preferably transport the tape-like weft with one of its longitudinal edges entirely facing the fabric-fell. There appears to be no gripper available that satisfies the requirements just stated.

Therefore, a suitable type of rapier device, and in particular a gripper device to be incorporated in or used with such a rapier device, is now provided that is capable of inserting tape-like wefts of different widths, thickness, materials and constructions in a flat and non-deformable condition in the same fabric. It grips directly the entire width at the fore part of the tape in a flat condition and maintains its longitudinal axis parallel to that of the tape-like weft. This gripper also enables one of the longitudinal edges of the weft tape to entirely face the fabric-fell during its transportation through the shed. Further, such a gripper can be used either with rapier band/rod or as a projectile gripper for transporting tape-like wefts. The novel gripper according to present invention for use with rapier is described first followed by weft feeding and selecting devices.

Figure 3:
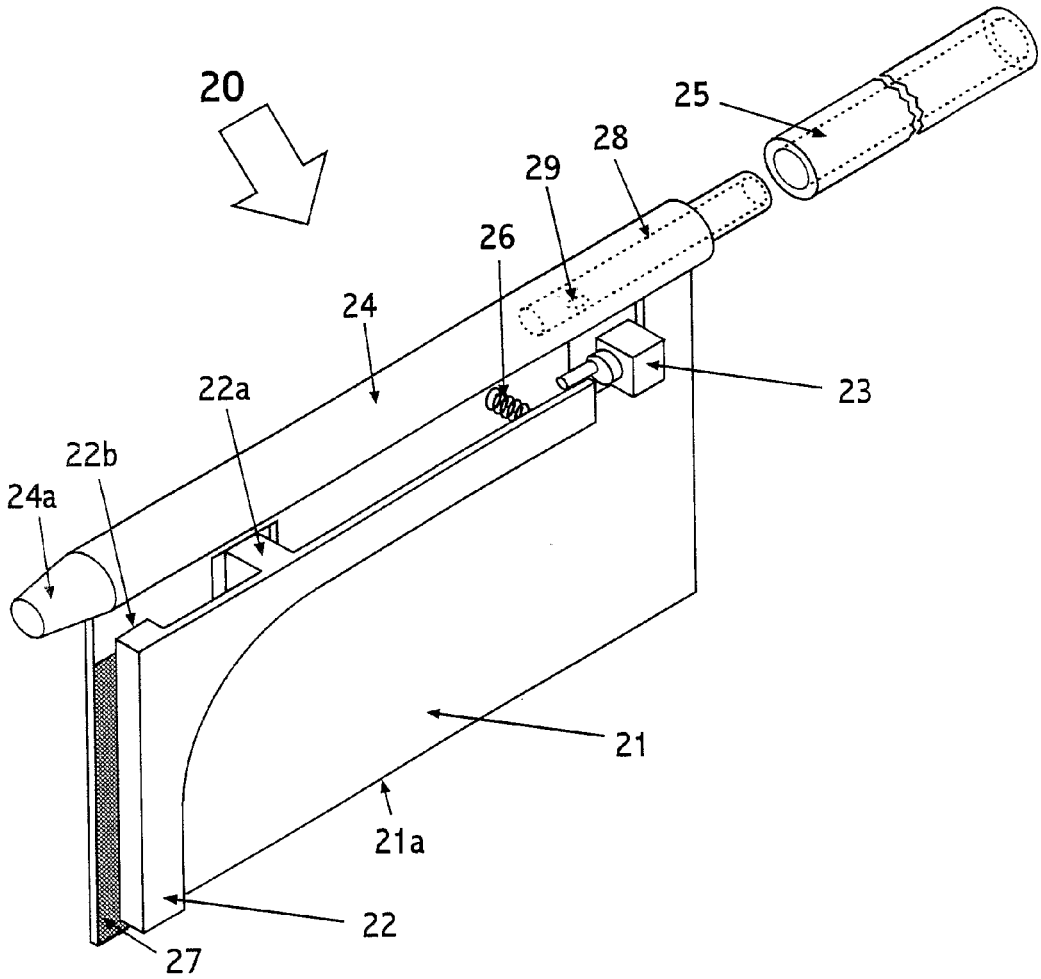
FIG. 3 exemplifies the constructional scheme of the gripper head for gripping the width direction fore part of different widths of weft tapes in a flat condition.

FIG. 3 shows the main parts of the rapier gripper (20), which is composed of a base plate (21), a gripping clamp (22), a gripping clamp activator (23), a drive connector (24) and a drive-transmitting member (25) that is coupled to a suitable driving arrangement details of which are not relevant to the present invention.

The gripping clamp (22), pivoted at (22*a*), is activated to its open and close positions through the gripping clamp activator (23) by either mechanical, electrical, pneumatic means, or a suitable combination of some of them. A suitable spring (26) can be included to aid gripping clamp's (22) either closing or opening depending on how the gripping clamp activator (23) controls the up/down movement of gripping clamp (22). Such an arrangement allows the gripping mouth to open widely and hence the entire width of the fore part of the weft tape can be taken in directly and flatly without crumpling it when the open mouthed gripper moves toward the positioned stationary weft tape. No aid of any feeding device is required. The base plate (21) not only carries all the required working components on board but also functions as a part of the clamping device. The plate (21) could be regarded the lower lip and the gripping clamp (22) the upper lip of the gripper's (20) mouth. Together with the gripping clamp (22), the base plate (21) thus ensures that the weft tape is always clamped flatly and that the tape's longitudinal axis lies parallel in its plane and with its own longitudinal axis, while one of the tape's longitudinal edges entirely faces the fabric-fell.

The gripping clamp activator (23), although located on the base plate (21) as described above, could be also had externally in a different arrangement, such as behind the warp tapes, in which case suitable fingers can extend out from behind warps to operate the gripping clamp (22). Such fingers will emerge from the open spaces created by the raised warp tapes during shedding. To achieve gripping clamp's (22) operation this way, suitable openings can be provided on the base plate (21) for the fingers to engage the gripping clamp (22) at a suitable position.

The front floor part of the base plate (21) is preferably provided with serrations or channels or grooves (27) to aid reliable gripping of the tape-like weft by the gripping clamp (22). Similarly, the under portion (22*b*) of gripping clamp (22) is also provided with serrations/channels/projections to reliably grip the tape-like weft. Such an arrangement also ensures gripping of the entire width of the rigid and flexible types of weft tapes' fore part in a flat condition and prevents its bunching, crumpling, bending, creasing etc.

The drive connector (24) of the novel gripper (20) is preferably located at one side of the base plate (21) to support it. The drive connector (24) can be constructed to have a suitable cross-sectional profile to match with that of the shedding system (not indicated) so that the gripper head (20) can be guided linearly and reliably into and out of the shed. Such a drive connector (24) could have suitable cavity (28) to conduct electrical wires, air, mechanical link etc., through base opening (29) to the gripping clamp activator (23). This way the gripping clamp activator (23) can be in connection with its drive initiator (not shown) through the drive-transmitting member (25). The fore end (24*a*) of drive connector (24) is a projection to guide the gripper head (20) through the shed. It could be also devised to engage with a matching 'female' part when such gripper head (20) is used in a double rapier device so that a full alignment between giver and taker gripper heads is always maintained when transference of weft tape is to happen.

The drive-transmitting member (25) could be of either flexible or rigid type and of tubular, perforated or solid constructions. The member (25), when of tubular construction, could conduct pressurized air, contain electrical wires or mechanical links etc. When such a member (25) of solid construction is used it could as well be constructed to conduct electricity or function as a mechanical element.

Figure 4:
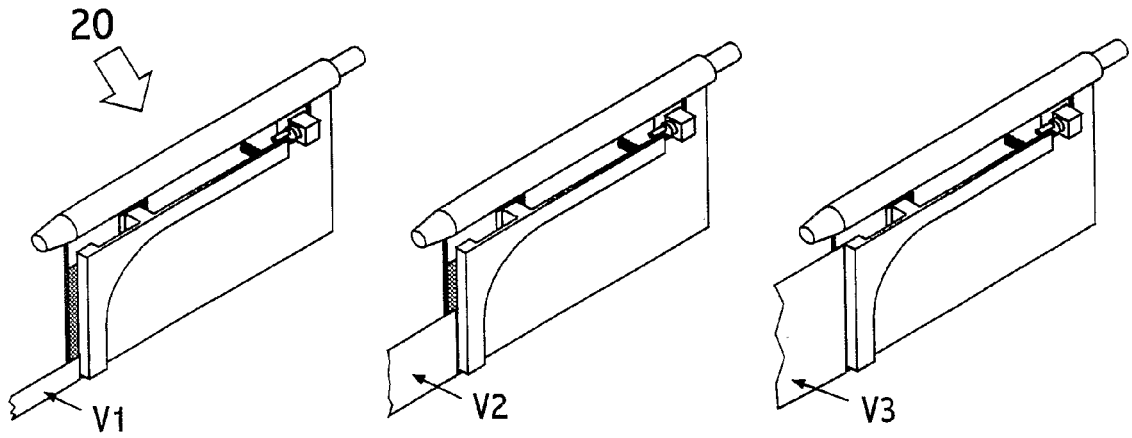
FIG. 4 exemplifies suitability of the novel gripper head in gripping weft tapes of different widths.

By locating the drive connector (24) at one side of the base plate (21) as indicated and joining it to drive transmitting member (25), it becomes possible for the gripper (20) to receive directly the entire width of the tape-like wefts in a flat condition and of any width containable within the base plate's (21) design. For practical usefulness the gripper (20) should be able to receive weft tape widths preferably in the range 3 to 50 mm although other desired widths could be also considered. As illustrated in FIG. 4, the same vertical type gripper head (20) can be employed to grip the entire width of different widths of wefts (v1-v3). The longitudinal axis of weft tapes of any width that is clamped in gripper (20) will thus lie in the plane of the gripper (20) and be parallel to the gripper's (20) longitudinal axis. Further, for advantageous reasons to be described, it is also preferable to receive the tape-like weft in the gripper head (20) such that the tape's lower longitudinal edge is in line with the unsupported or free side (21*a*) of the base plate (21) while the other edge of weft tape faces the drive connector (24) side of the base plate (21). This way one of the longitudinal edges of the tape-like weft and the free longitudinal edge of the gripper plate (21*a*) occur nearly in the same plane. By doing so the longitudinal axes of the weft tape and the gripper (20) are always maintained parallel and the tape-like weft will not undergo shear deformation when pulled by gripper (20). Also, the edge of any width of weft tape will always occur entirely at a constant distance from and facing the fabric-fell. By this arrangement the distance required to place the weft of any width at the fabric-fell will thus be always constant. As a result, the time for depositing weft tapes of different widths at fabric-fell reduces and production tends to increase while the flatness or non-deformation of the weft tape is fully maintained.

Also, on the base plate (21), preferably at the underside (21*a*), a wire of suitable flexibility and shape (such as 'U') could be attached such that the bottom curve of the wire gently skims over the fabric-fell when the gripper head (20) is moving through the shed. Such an action would help making the shed clearer, especially when loose fibres protruding from adjacent warp tapes are entangled, and hence prepare a clear shed for the subsequent unhindered deposition of weft at the fabric-fell.

Figure 5:
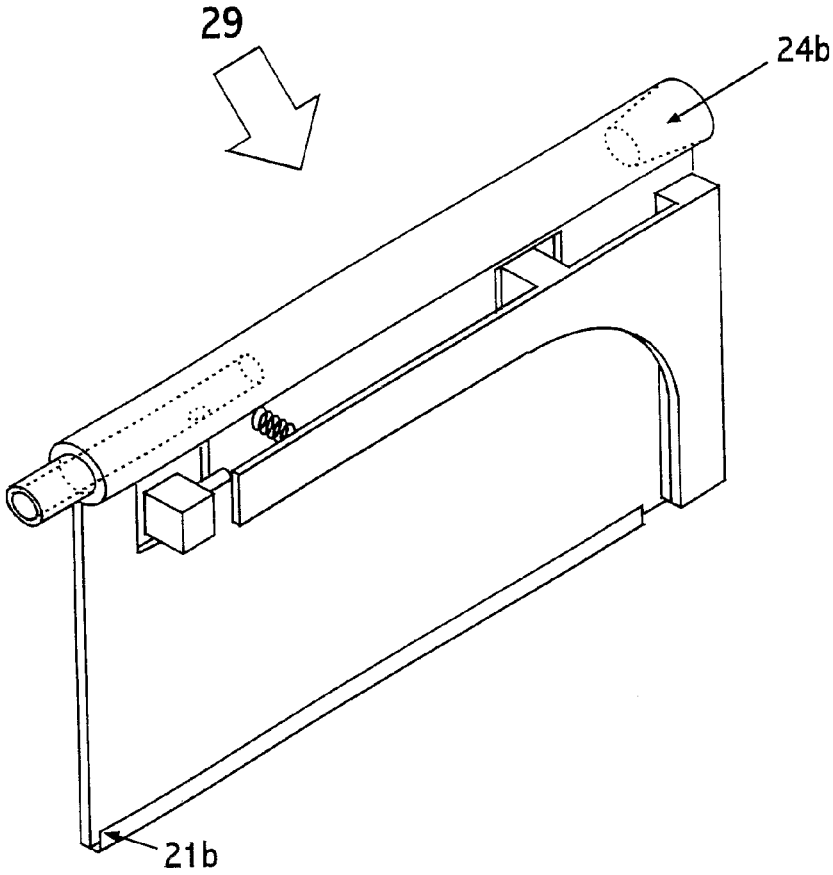
FIG. 5 exemplifies the constructional scheme of the gripper head for use in double rapier device.

The gripper head (20) described above is employable in both single and double types of rapier devices and in vertical and horizontal workings without major constructional changes. Whereas in the former type only one gripper head (20) is needed, the latter type will require two gripper heads—one will be the 'giver' and the other 'taker'. The gripper head (20) can work as 'giver' and 'taker' with only minor constructional changes as shown in FIG. 5. The alternative gripper head (29) shown in FIG. 5 differs from the gripper head (20) in only having a matching cavity (24*b*) at its fore end to achieve alignment with the other gripper's (20) fore end (24*a*) when they mate for transference of weft tape from one to the other. The other difference, which is optional, is the attachment of a support (21*b*) at base of plate (21) for supporting the weft tape during tape transference.

When using the single rapier device, the gripper head (20) will emerge out from the shed to grip the weft tape. FIG. 6 shows a sequence of events relating to the use of single vertical gripper head (20). For clarity in representation only the chief events are shown. FIG. 6*a* shows the single gripper head (20) entering into the open shed from one end to the opposite where weft tape (16) is held in position; FIG. 6*b* shows the gripper head (20) traversing in the shed towards the weft tape (16); FIG. 6*c* shows the emergent gripper head (20) gripping the fore part of the weft tape (16) in a flat condition to draw it in the shed; FIG. 6*d* shows weft tape's (16) insertion in the shed and the gripper head (20) out of the shed.

When using double rapier device, two gripper heads (20, 29) will meet in the shed wherein the fore part of the weft tape brought in by the giver-head (29) will be transferred to the taker-head (20), which will then grip it and draw out the weft tape from the shed to complete weft insertion. In FIG. 7*a* is indicated the 'giver' and 'taker' gripper heads (29, 20) approaching each other and in FIG. 7*b* is shown their aligned meeting for weft transfer. A sequence of events relating to the use of double gripper heads (29, 20) for weft insertion is shown in FIG. 8. Again, for clarity in representation only the main events are shown. FIG. 8*a* shows the gripper heads (29, 20) entering into the open shed from respective ends with head (29) holding and drawing in the vertical weft (16); FIG. 8*b* shows the gripper heads (29, 20) traversing in the shed towards each other; FIG. 8*c* shows the gripper heads (29, 20) meeting at the predetermined position in the shed with head (29) keeping the weft tape (16) in position for the head (20) to grip it; FIG. 8*d* shows the two heads (29, 20) out of the shed with the weft tape (16) inserted in the shed. Needless to mention that the timing of opening and closing of the gripping clamps (22) of heads (29, 20) in the shed for weft transference will be such that the gripping of weft tape's fore part by gripper head (20) and release of the same by gripper head (29) is satisfactorily achieved.

It may be noted that it is possible to keep the weft (16) in a flat vertical condition and perpetually 'threaded' or contained in the gripper head (29) all through the insertion cycle, when weft tape of same width is to be continually inserted, to make the working simpler. To achieve such a perpetual 'threading', the gripping clamp (22) of gripper (29) will remain open when the gripper (29) is being drawn out of the shed and it will close prior to the gripper (29) entering the shed during the subsequent cycle.

As is well known, use of double rapiers will halve the weft insertion time relative to the time required with the use of single rapier head.

It may be pointed out here that it is also possible to employ the rapier gripper (29) singly for weft insertion just like the rapier gripper (20). In this case the gripper (29) will take along the weft tape through the shed length and upon exiting the shed the fore part of the flatly held tape would be presented to a stationary gripper to grip it. The rapier gripper (29) would then be retracted 'empty'. Needless to state that the weft tape would remain 'threaded' in the rapier gripper (29) all the while.

While the above descriptions of novel rapier type gripper (20) relates to its use with driving bands/rods, it may be pointed out that the same gripper head (20) could be used as a projectile, i.e. without attaching it to any driving bands/rods, in which case it would be propelled. For example, the drive connector (24) could be slightly modified at its ends to receive strike, at either one or both ends, from a striking source. As a consequence, the gripper head (20) when struck by a suitable mechanism would be propelled into the shed like a projectile through correspondingly two different working arrangements. In the first system several grippers (20) could be used in series to insert successive weft tapes from one side of the shed when drive connector (24) is struck from only one side. In the other arrangement the same projectile type gripper (20) could be struck at both ends of drive connector (24) to propel it through the shed just like a conventional shuttle. In this case the gripper (20) could be further modified to grip weft tapes at both ends of plate (21) by way of providing two gripping clamps (22). By such arrangement the gripper (20) could grip and insert weft tapes supplied from both sides of the open shed. By this way the weaving efficiency would almost double even with the use of a single gripper (20).

As can be understood now, the described novel gripper (20) is unlike the existing rapier and projectile grippers in that it requires neither cross feeding of tapes for hooking nor a feeder to place the weft tape in the mouth of the gripper (20) defined by plate (21) (lower lip) and gripping clamp (22) (upper lip). The gripper (20) directly receives the entire width of the weft tape's fore part in its mouth and clamps it flatly. This way most part of the lateral and either one or both longitudinal edges of the weft tape of any width rest in the gripper's (20) plane. This direct way of clamping the weft tape eliminates the tape's bending deformation as no looping and hooking of tape happens and the tape remains in a flat condition. Also, the longitudinal axes of the weft tape and the gripper (20) are maintained substantially parallel by having the free side (21*a*) of base plate (21) and the longitudinal edge of the weft tape facing the fabric-fell in nearly the same plane during receiving and transporting the weft tape. Such arrangement eliminates shear deformation of the weft tape. Also, the same gripper (20) can be used for clamping and transporting weft tapes of different widths. Further, the gripper (20) is unique in that it is suitable for use with positively driven rapier system and the negatively driven projectile system.

Feeding and Selecting Wefts

To enable efficient insertion of tape-like weft, a suitable feeding and selection device can be employed. The main purposes of such a device or system would be to supply twist free and tensionless length of weft tapes in a vertical and flat condition continually for every weaving cycle and handle partially stabilized, non-stabilized, stabilized fibrous tapes, rigid and flexible types of tapes and also tapes of different widths, thickness, materials and constructions.

Another new demand of a weft tape feeder is the continuous removal and collection of plastic/paper tape that is included between the layers of fibrous tapes when making spools. Such plastic/paper tapes are particularly included with fibrous tapes to prevent the fibres and applied sizing from adhering with each other when unwinding.

Existing weft feeders cannot be employed in the present case because they are designed for handling yarns, and not tape-like wefts. The method according to U.S. Pat. No. 5,455,107 cannot be implemented for delivering a variety of weft tape constructions and also wefts tapes of different widths and thickness because no selector system is incorporated. It is also unable to supply weft tapes in a straight line, vertically and in tensionless condition. Overfeeding by such a device would cause snarling and thereby bunching of fibres and sagging resulting in improper delivery. There is also no means to remove waste paper/plastic from the supplied rolls. Therefore a new device for delivering the weft tapes is required. The method according to the present invention is described hereunder.

Figure 9:
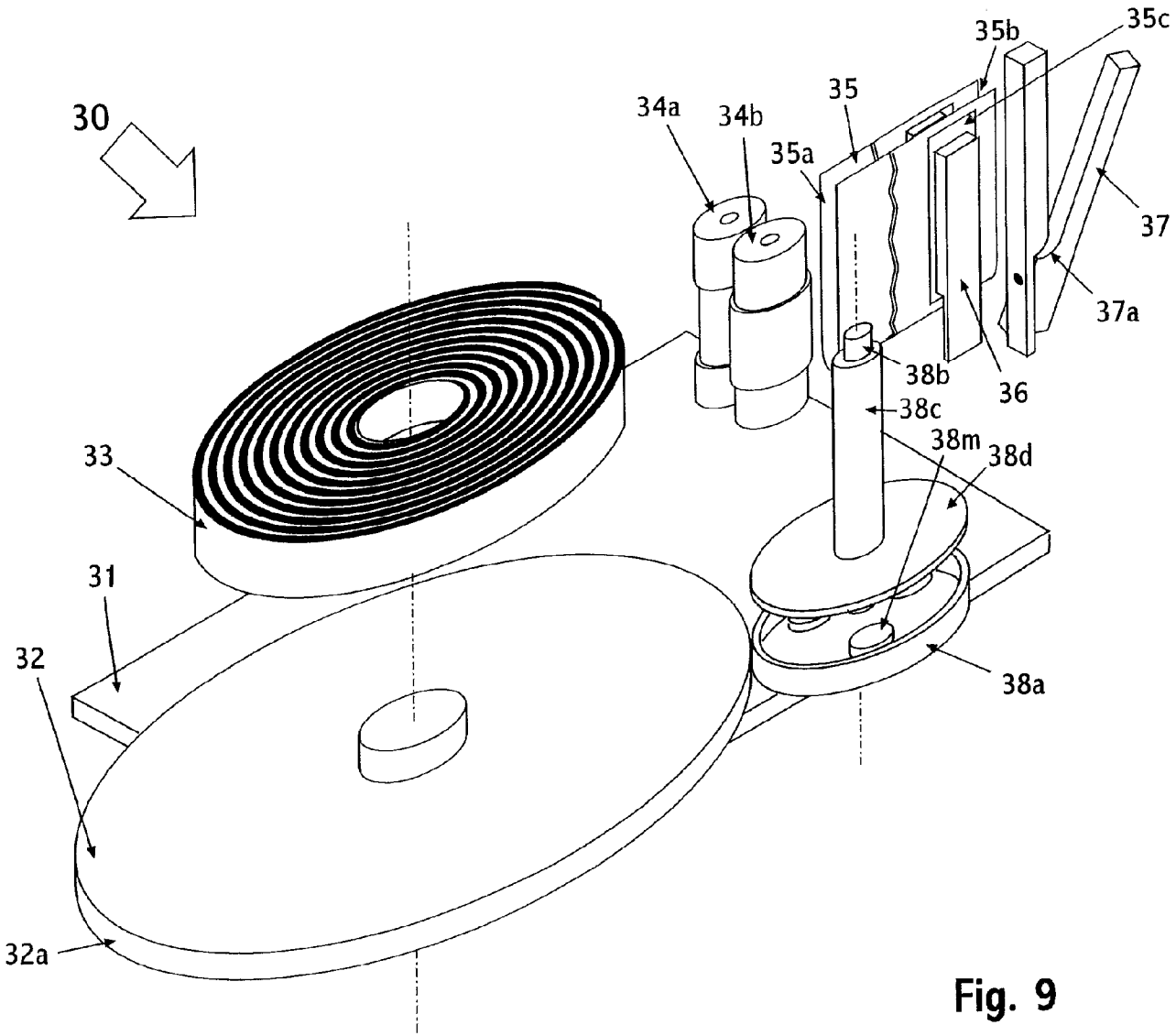
FIG. 9 exemplifies the device for feeding positively tensionless weft tape.

The tape-like weft feeder unit (30) for feeding weft tapes directly from a spool or roll in a vertical/upright manner is shown in FIG. 9. It mainly comprises a base (31), a turntable (32) on which a weft package spool (33) can be received almost concentrically and supported, at least a pair of guiding-driving rolls (34*a*, 34*b*) for handling the tape-like weft, a channel (35) suitably pivoted at its weft inlet end (35*a*) to support and guide the tape-like weft (33) in a flat and vertical condition, a clamping unit (36) close to the channel's (35) outlet end (35*b*) to hold the leading end of the weft tape (33) in a flat condition, a pair of shears (37*a*, 37*b*) to cut weft (33), and a split-spindle arrangement (38*a*, 38*b*) for collecting waste plastic/paper tape released from the weft package spool (33).

The turntable (32) is driven positively by a motor (not shown) in the required increments. The motor's rate of turning can be self-regulatory through a sensor that monitors the diameter or rate of depletion of the weft tape package spool (33). The turntable (32) has its side (32*a*) equipped with a frictional surface such as that produced by serrations, knurls, cork, chemical formulation or any suitable material. The turntable (32) can be moved axially up and down relative to the base plate (31) and locked in the desired position after achieving a proper alignment of the bottom edge of the weft tape (33) and the base of the channel (35). Such an arrangement for adjustment is required because the width of the waste paper/film included in the spool (33) can vary from one lot to another even if the width of the weft tape is the same between different lots.

The pair of guiding-driving rollers (34*a*, 34*b*), of the tongue-and-groove type is included. The height of the tongue and groove parts of the rollers (34*a*, 34*b*) corresponds with the width of the weft tape (33) they are required to receive and drive to ensure weft tape's reliable vertical guidance into the channel (35). The surfaces of the tongue-and-groove parts of the rollers (34*a*, 34*b*) is preferably made such that the weft tape (33) does not slip from its nip, the fibres and chemical sizing from the weft tape (33) do not adhere to them and they do not deform and damage the weft tape (33). Further, either one or both rollers (34*a*, 34*b*) are capable of being driven positively, in clockwise and anticlockwise directions, and in desired steps by suitable motor/s (not shown). This way the weft tape (33) can be overfed into the channel (35) by frictional drive in a flat and vertical condition and controlled for tensionless insertion without twisting. The rollers (34*a*, 34*b*)

could also be used for taking up slackness without tensioning the tape to enable proper alignment of weft at the fabric-fell. It may be pointed out that when overfeeding the weft tape in vertical form its sagging is substantially reduced.

The channel (35) is preferably of U cross-section and made from a thin, lightweight, smooth, low-friction, hardwearing and non-sticky material. It is preferred that the rollers (34*a*, 34*b*) and channel (35) do not generate static electricity. Such a channel (35) is provided with suitable windows or openings to monitor and attend to the weft if need be. A tape in it would not twist but remain always vertical, straight and flat.

The channel (35) is also provided with windows (35*c*) towards its outlet end to access the weft tape for gripping by the clamp (36). Such a clamping of the weft tape is required for keeping the weft positioned for cutting after its insertion in the shed and for maintaining the fore part of the weft tape (33) in position and in a flat condition for supplying to the gripper head (29 or 20) in the next cycle. The gripping surfaces of the clamp (36) is characterised by suitable serrations or grooves to ensure slip-free gripping of the weft tape (33) when held in between them and that neither the fibres and chemical sizing from the weft tape adhere to them nor do they deform and damage the weft tape.

While a usual cutter could be employed to cut the tape-like weft (33), it is preferable that according to this invention the pair of shears (37) has its blades designed in a specific rounded profile (37*a*) in that no corner is created in the tape, especially not at the side that will face the fabric-fell. Such a rounded or corner-less cut reduces the risk of interference between the weft tape and the warp tapes when passing through the shed. The edges of the shear (37) blades can be produced with desired micro serrations for cutting weft tape materials of all kinds, including aramid. The pair of shears (37) is mounted in a way that it can be moved up and down when required so as to provide sufficient clearance for the gripper heads (29, 20) to move without hindrance.

The split-spindle arrangement (38*a*, 38*b*) for removing and collecting the waste film/paper from the weft supply package (33) is in principle constructed of two parts, the driving removal unit (38*a*) with an upright spindle (38*b*) and the collecting unit (38*c*) with a base (38*d*). The driving removal unit (38*a*) has its side surface equipped with a frictional surface such as that produced by serrations, knurls, cork, chemical formulation or any suitable material. The driving unit (38*a*) is always maintained in contact with the turntable (32) by suitable spring pressure to get reliably driven by the turntable (32). A recess is provided on the topside of the driving unit (38*a*) in which preferably magnets (38*m*) are fixed. The collecting unit comprises a tube (38*c*) fastened to the base (38*d*), which is preferably made of steel so that magnets (38*m*) can hold it when the assembly is placed concentrically over the driving unit (38*a*). Such an arrangement, wherein the unit's (38*a*) diameter is smaller than that of the tunitable's (32), ensures speedier rotation of the unit (38*c*) to wind on itself the removed waste film/paper coming from the weft supply package (33). At the same time, the base (38*d*) can also slip over the magnets (38*m*) when the tension builds up and thereby prevent removal or drawing off any excess of waste film/paper and alter tension in the weft tape.

It may be mentioned here that the principle of waste removal and collection method described above is employable in the warp feeding device described earlier by suitably modifying the construction to remove and collect film/paper waste coming from the warp tape rolls.

The tape-like weft feeding arrangement (30) described above is suitable for processing one given width of the weft tape (33). Nonetheless, it is possible to change the pair of rollers (34*a*, 34*b*) to correspond with the width of weft tape to be processed. However, if more than one or different widths of the weft tapes are required to be woven into the same fabric, then corresponding number of similar units can be had. In such a situation a selection arrangement to position the outlet end of the channels for presenting the desired weft tape to the gripper head becomes a necessity. A weft selecting arrangement for this purpose is described next.

Figure 10:
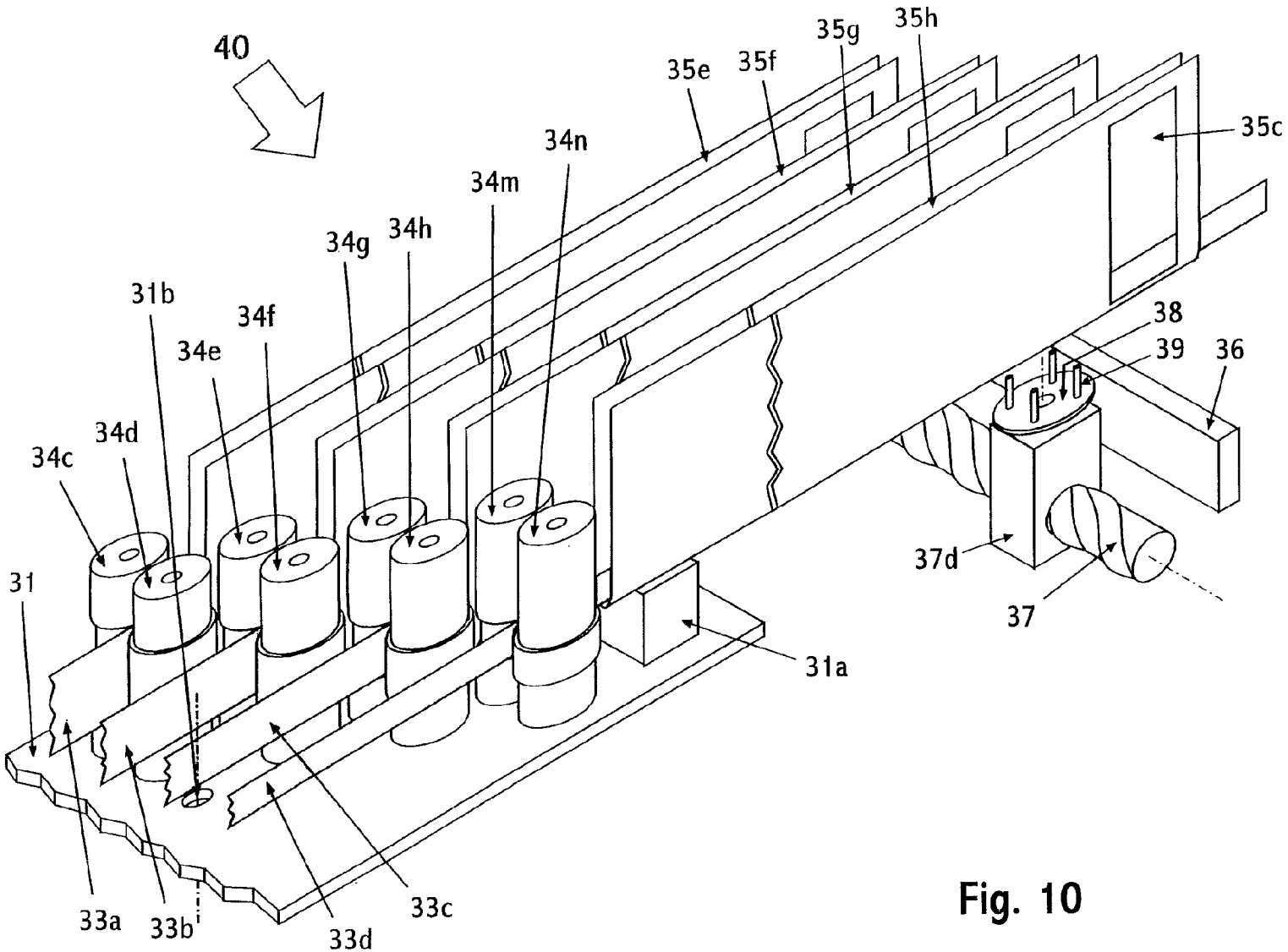
FIG. 10 exemplifies the arrangement for selecting different widths of weft tapes.

For exemplification, an arrangement (40) for controlling four different widths (or materials and constructions) of tape-like wefts (33*a*-33*d*) for selection is shown in FIG. 10. The basic set up of the feeder unit (40) remains same as described in the foregoing and hence some parts of it are not shown in FIG. 10. As different widths of weft tapes (33*a*-33*d*) are required to be selected, the heights of each pair of the tongue-and-groove parts of the rollers (34*c*-34*d*, 34*e*-34*f*, 34*g*-34*h*, 34*m*-34*n*) are different and correspond with the desired weft tape widths to be received and driven. The four channels (35*e*-35*h*), supported at the entry end on a block (31*a*) attached to table (31), can be arranged either parallel as shown in FIG. 10 or in an open hand-fan manner. The entire set up is pivoted at (31*b*) so that the assembly could be swung about it in the horizontal plane. When arranging the channels (35*e*-35*h*) in the open hand-fan manner, the inlet ends of the four channels will be closer to each other than the outlet ends. Further, the four outlet end parts of the channel (35*e*-35*h*) are commonly rested on a sliding block (36). The distances between the four channels are maintained constant through spacers at suitable places. As will be apparent now, this assembly can be moved in an arc and any one of the four outlet ends of channels (35*e*-35*h*) can be brought into a single position every time to feed the desired weft tape to the rapier gripper head (20).

Selection of one of the desired channels (35*e*-35*h*) can be predefined by a programme and carried out by activating a screw-like shaft (37) coupled to a step motor (not shown in FIG. 10). The shaft (37) carries four special spaced apart nuts (37*a*-37*d*) (in FIG. 10 only nut 37*d* is shown). The topside of each nut (37*a*-37*d*) has a pivoted table (38*a*-38*d*) to swivel in horizontal plane for self-aligning and required pairs of upright pins (39) are fixed on it. Each of the channels (35*e*-35*h*) sits on respective tables (38*a*-38*d*) with the upright pair of pins (39) supporting each of the channels (35*e*-35*h*) from both sides. Such nuts (37*a*-37*d*), tables (38*a*-38*d*) and pins (39) are preferably made from a low-friction material. Alternatively, the channels (35*e*-35*h*) could be made with a profiled bottom so that each of them remains attached to the respective table (38*a*-38*d*) while sliding in a correspondingly profiled holder fixed to the pivoted table instead of having pins (39). This way the channels (35*e*-35*h*) cannot jump up, for example due to vibrations, and cause misalignment during feeding of weft tape to the gripper head.

The working of the weft tape selecting device (40) is initiated by turning the screw-like shaft (37) in the required clockwise/anticlockwise direction. The nuts (37*a*-37*d*) can thus be traversed back and forth along the axial direction of the shaft (37). The nuts (37*a*-37*d*) bearing the pivoted tables (38*a*-38*d*) with the projecting pins (39) thus cause the set of channels (35*e*-35*h*) to move in an arc while at the same time the channels (35*e*-35*h*) slide over their respective tables (38*a*-38*d*) and between pairs of pins (39). Precise degree of turning of shaft (37) ensures positioning any of the desired channels (35*e*-35*h*) in alignment with the gripper head (29 or 20) (not shown in FIG. 10) and thereby selection of the desired width of the weft tapes (33*a*-33*d*) can be supplied from one position.

It may be pointed out here that the described weft feeder (40) according to this invention can be advantageous in that it can be utilized to drive in rigid type of tape-like wefts directly into the shed by the guiding-driving rolls (34*c*-34*n*).

Similar to the supply of warp tapes in tandem described earlier, additional weft feeding devices like the one described above could be also arranged to supply doubled weft tapes in tandem so that two or more tapes occur stacked one beside the other. Each of these additional devices can be controlled to positively overfeed partially stabilized type of fibrous tapes constituting the doubled weft tapes differently and thereby cause correspondingly different waving/texturing of the fibres therein. The positive overfeeding is achieved by turning the rollers (34*a*, 34*b* etc.) slightly differently faster in each extra arranged unit. Further each of these tapes is passed through a longitudinally partitioned channel (35) so that the fore ends of these tapes are presented jointly at one position to the rapier gripper (20, 29), which can then receive doubled wefts. Because the weft is overfed positively in a tensionless condition the created waves/textures of fibres in the tapes remain in that state when getting interlaced. It may be pointed out that overfeeding of the weft tapes can be carried out as and when required and not necessarily during every feed.

By this arrangement of tensionless weft feeding in a controlled manner the constituent tapes of doubled weft, which are neither physically joined nor chemically bonded, function together effectively as a single weft during weft insertion and inclusion in the fabric. Accordingly, the constituent tapes of such a doubled weft are free to slip/slide past relative to each other when pulled. Also, at the same time the waved/textured fibres get extended uniformly due to the fibrous tapes being correspondingly differently overfed. An important feature of such a fabric construction is that the woven structure is not altered when a tape constituting the doubled weft is pulled or slid/slipped relative to other. A tandem supply of tape-like wefts as just described is not possible when using yarns because two or more yarns are not possible to be stacked one beside the other. Therefore, through such a tandem supply of some weft tapes it becomes possible to produce a woven material with doubled wefts that could have sections of relatively thicker/raised wide ribs in the fabric width direction. Such a fabric, which resembles somewhat like a 'profiled' material across its length direction, possesses a variable weight per unit area. Such profiled fabrics could also be produced using relatively thicker and thinner single tapes. This profiled fabric and also some other fabric constructions will be described later.

It may be pointed out here that the described weft supplying device can be also employed advantageously to make available continually wefts without the need to stop the weaving machine such as when one spool exhausts another fresh spool is brought into operation. The exhaustion of weft tape on a spool can be detected by a sensor at a predefined level, such as the minimum diameter of the exhausting spool, to initiate the supply from a fresh weft spool. Through this arrangement continuous production is maintained, weaving efficiency improves and the productivity increases without requiring any constructional changes.

As with the use of warp tapes supplied in tandem, novel woven materials can be also produced by supplying weft tapes in tandem using tapes that are of either partially stabilized or non-stabilized types of fibrous tapes and made from one or more variety of fibres from a selection of thermoplastic/polymeric/synthetic, metallic, organic, inorganic, natural vegetable and animal fibres, carbon, boron, ceramic, glass, optical etc. A combination of some of them together with stabilized type of fibrous tapes and non-fibrous tapes of said materials that are flat solid, profiled on one side and flat on the other, shaped at edges, perforated, embossed, corrugated, tapered, smooth, rough, transparent, opaque, translucent, coloured, colourless, adhesive bearing, and a combination of them are equally well usable according to end-application requirements.

(c) Device for Depositing Weft at the Fabric-Fell

Conventionally the beating-up operation is carried out to deposit the laid weft yarn at the fabric-fell by pushing it with a reed. However, when a tape-like weft is used instead of yarn, a reed cannot be used satisfactorily because its action would cause lateral deformation of the weft tape. The method according to U.S. Pat. No. 5,455,107 however employs it. A disadvantage with beating-up with reed is that the lateral deformation is produced not only in the weft tapes but also the warp tapes, which eventually lead to gaps or openings in the fabric. Such openings also result from the non-uniform width of the tapes. When the weft width is relatively narrower the reed is not able to push the weft completely to the fabric-fell position due to the fixed stroke length of reciprocating reed. When the weft tapes are relatively wider the beating-up action of the reed causes their deformation and jamming. Apparently the use of reed would not be advantageous if weft tapes with shaped edges are to be woven.

Another problem with the use of a beating-up reed is that it also causes abrasion and lateral deformation of the warp tapes during its reciprocation. This is because the reed is in constant contact with the edges of warp tapes and abrades them besides being a source of pressure on the warp tape's edges because the tapes get constantly displaced in its lateral directions due to shedding movements and vibrations to result in its deformation. Such deformations in the warp tapes are again a cause for openings and gaps in the fabric.

The first method known to achieve 'beating-up' without using reed has been described in U.S. Pat. No. 6,450,208 wherein a set of rolls is employed to align the laid weft tape at the fabric-fell by its turning action. As mentioned earlier, the action of such a roller type weft aligning system cannot be effective when doubled wefts are inserted because the constituent tapes of the doubled weft are free to slip/slide past each other. When the rolls turn, they will tend to contact and align only the front tape because it will laterally slide/slip past the rear tapes. Also, such a device dislodges loose fibres from their positions in a weft tape that is of non-stabilized fibrous type and hence the usefulness of such a device gets limited. Apparently, such a device would also not be suitable for depositing partially stabilized fibrous tapes.

There appears to be no suitable method available at present that can deposit tape-like wefts from outside of the shed in a vertical and flat condition and which are of the partially and non-stabilized fibrous types, stabilized fibrous type, non-fibrous type and of flimsy/delicate/fragile construction and material, of different widths and also doubled wefts. Also there is no weft depositing device known that can place the weft obliquely or slanting in relation to warp. Similarly, deposition of weft tapes having shaped edges is also not known. Further, a device that can move laterally during weft deposition is also unknown. Accordingly, a novel device to deposit tape like weft at the fabric-fell in a vertical flat condition without beating-up action is described below. As will be observed, such a device has the advantage of being utilized for depositing all types, widths and thickness of weft tapes within the same fabric.

Figure 11:
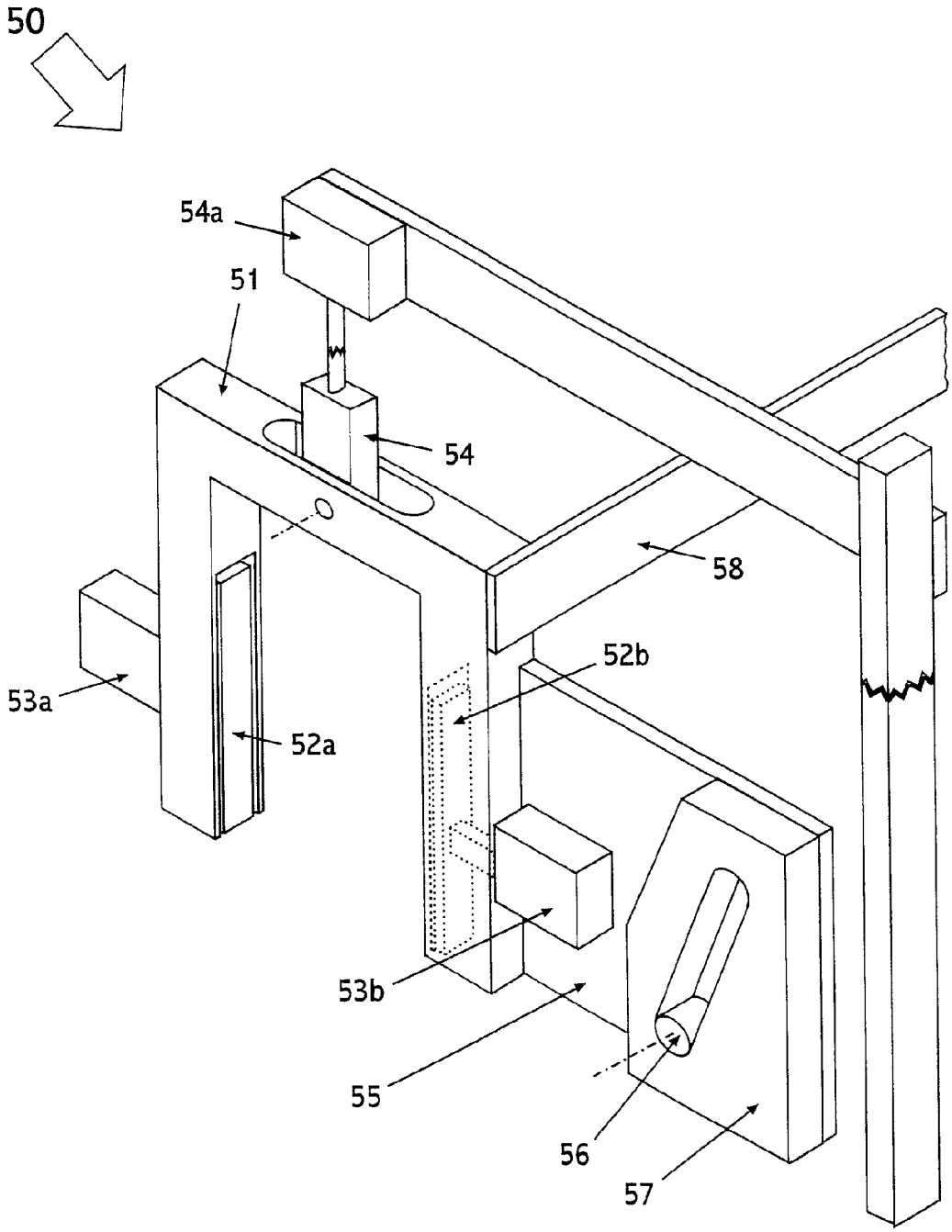
FIG. 11 exemplifies the set up for depositing the inserted weft tape at the fabric-fell position.

The main parts of the vertical weft tape depositing device (50) are shown in FIG. 11. A pair of weft tape depositing device (50) is employed to place the inserted weft tape in a flat and vertical condition at the fabric-fell. Each of the units (50) is located beside the outermost warps or the selvedge sides of the material being woven. Each unit (50) comprises a twolegged bracket (51) supporting and housing a pair of clamps (52*a*, 52*b*). The gripping surfaces of clamps (52*a*, 52*b*) are provided with suitable serrations or grooves to ensure slip-free gripping of the weft tape in a flat condition when held in between them. Their constructional material and design also ensure that neither the fibres and chemical sizing from the weft tape adhere to them nor do they deform and damage the weft tape. The clamping action is achieved by using devices (53*a*, 53*b*) which are mechanical, pneumatic, electrical or their combination etc. The height of the clamps (52*a*, 52*b*) is large enough to accommodate all widths of the tape-like wefts containable in the base plate (21) of the gripper heads (29, 20) (not shown in FIG. 11). The entire bracket (51) is supported from the top by lever (54) and from the outer leg side by lever (55) that also bears a pin (56) fixed to it. The top support lever (54) enables the bracket's (51) up and down movement through a suitable device (54*a*) fixed on suitable supports. Device (54*a*) can be mechanical, pneumatic, electrical or their combination etc. The outer leg lever (55) allows the bracket (51) to move forward and backward through the sliding fulcrum link (57) in which the pin (56) can sit and slide. Through such an arrangement the bracket (51) can be moved in an arc-like path. The stroke length of device (54*a*) would correspond with the distance the weft has to be moved for placement at the fabric-fell. This stroke length of the pair of units (50) can be made either equal or unequal to enable oblique placement of the weft in relation to the warp tapes to produce novel fabrics to be described later.

As each unit (50) is located beside the selvedge sides, the pair of units (50) is preferably linked by a connecting bar (58) to ensure the substantially separated pairs' simultaneous movements.

The working of the unit (50) is described now in reference to FIGS. 12*a*-12*e*. To explain the working, the side view of process is only shown. Although a pair of units (50) is employed and they work simultaneously, one each beside the selvedge sides, only the first visible unit (50) is shown and the one behind it is excluded for clarity in representation in FIG. 12. Also, for ease in illustrating, the weft insertion indicated pertains to the use of single rapier device.

FIG. 12*a* shows the bracket (51) held in its top most position and the clamps (52*a*, 52*b*) drawn inside their housings in the legs of bracket (51). This way the bottom side of the bracket (51) is kept open for allowing the gripper heads (20) to traverse through the shed for inserting the tape-like weft (33). After the weft is inserted, its leading part is held by the gripper head (20) and the trailing part by the clamps (36) of the feeder unit (not shown in FIG. 12). It is to be noted that the bottom edges of the clamps (52*a*, 52*b*) occur in the same plane as the bottom edge of the inserted tape-like weft (33). FIG. 12*b* shows the activated clamps (52*a*, 52*b*) projecting out from their respective housings and gripping the weft tape (33) in a flat condition between them. Subsequently, the fore part of the weft tape (33) is released by the gripper head (20) and the trailing part cut by the cutter (37) (not shown in FIG. 12). Now the entire weft tape (33) is held in a flat and vertical condition by the pair of units (50) from outside the shed. FIG. 12*c* shows the brackets (51) moving down by activation of device (54*a*) (not shown). As the bracket (51) begins to move down, it also turns anticlockwise (in reference to the direction of view shown in FIG. 12) and gets pushed towards the warp tapes that are not raised during shedding due to the sliding-fulcrum action caused by pin (56) and block (57). As a consequence, the gripped vertical weft tape (33) is also moved correspondingly in the open shed to align straight with the warp tapes that are not raised up during shedding. FIG. 12*d* shows the bracket (51) finally reaching its down most and forward most positions with the weft tape (33) still in a flat and vertical condition under the grip of the clamps (52*a*, 52*b*). The down most and front most positions of the brackets (51) are so set that the weft tape (33) held between its clamps (52*a*, 52*b*) has its bottom longitudinal edge aligned at the fabric-fell (FF) and the weft tape is also vertical/upright in a plane parallel to the warp tapes that are not raised to complete the process of weft deposition at the fabric-fell position. Immediately after weft (33) is deposited at fabric-fell, the shed begins to close. FIG. 12*e* shows the weft held in a flat condition by the closing wrap tapes after the shed levels, the clamps (52*a*, 52*b*) drawn into their housings in bracket (51) and the just-inserted weft woven into the material (F). The inserted weft (33) is now fully released from the units (50) and the woven material (F) ready to be taken-up. When the woven material (F) is subsequently taken-up, the fabric-fell position gets re-established. The brackets (51) are pulled up by respective devices (54*a*) to their top most position for the next cycle.

As will be observed from the just presented description, the bracket (51) in its top most position enables the inserted weft tape (33) to be gripped by the clamps (52*a*, 52*b*) in a way that the bottom longitudinal edges of both always occur in the same plane. Due to this possibility, tape-like weft of any width and thickness can be gripped and deposited at the fabric-fell position when the brackets (51) move to their bottom most and forward most positions. It would be appreciated now that such a gripping of weft tape of any width is inter alia made possible by having the longitudinal edge of weft tape gripped in gripper (20) facing the fabric-fell and always at the same fixed distance from the fabric-fell due to its alignment with the free side (21*a*) of gripper plate (21) described earlier. Further, the deposition of the weft tape in a flat and vertical condition at the fabric fell is achieved without causing lateral deformation of the weft tape (33). Also, no abrasion and deformation is caused to the warp tapes because it works from outside of the shed. There is no beating-up action involved in this weft depositing device. This method is equally employable for depositing doubled wefts at fabric fell as just described.

It may be indicated here that an additional weft presser may be employed to maintain the deposited weft in place until the subsequent shed is formed to prevent its slippage as might happen if very flimsy and low friction material are being woven. Such a presser would be simply pressing the just deposited and interlaced weft (together with the warps of closed shed) from front and backsides, i.e. from the fabric's body. Magnets could be used for this.

Another point that may be mentioned here is that the fabric fell position is always maintained at the same level no matter what width of weft tapes are inserted. This is achieved through the unique warp let-off device described earlier that releases variable warp lengths corresponding to the different widths of wefts inserted in combination with the new take-up device to be described further on.

While the described device pertains to depositing weft tapes at nearly 90° to the warp tapes, it may be pointed out here that through some minor constructional changes the same device is employable to deposit vertical weft tapes obliquely or slant with respect to the warp tapes. To achieve such a slant weft deposition the main things that need to be modified are: (a) the stroke lengths of devices (54*a*) of the pair of units (50) located at the two selvedge sides should be made unequal, (b) the clamps (52*a*, 52*b*) should be made to swivel about its axes supported by the devices (53*a*, 53*b*), and (c) units (50) should be made to move laterally (away from and closer to each other). The working of such a weft depositing device will remain same as described. The purpose of such a modified device is to incorporate oblique/slant weft tapes to produce novel woven materials to be described later. It may be pointed out here that the lateral movement of devices (50) can be also advantageously exploited to cause non-linearity of fibres in weft tapes by moving them toward each other. The devices (50) could be also reciprocated laterally when the weft tape is at the fabric-fell to achieve better abuttal of the tautly held weft tape with the fabric-fell, such as when warp and/or weft tapes are 'hairy' due to protruding fibres.

(d) Device for Binding Selvedges

When weaving with tape-like warps and wefts formation of selvedges by tucking-in and leno binding methods are not preferable. Also, as it is not possible to use shuttles for insertion of tape-like wefts, the normal 'shuttle' selvedge is not possible to produce. When weaving certain plastic tapes, it is possible to apply heat and fuse the tapes to form the selvedge. Application of special glues or adhesives could be considered but their use involves drying time, delivery of precise amount, handling and nozzle choking problems, risk of contaminating the warp, weft and woven material due to leakages etc. When metallic foils and fibrous tapes of carbon, ceramic, glass, boron, metal, aramid etc. are used, it is not possible to apply either heat or glue to form the selvedge. The method according to U.S. Pat. No. 5,455,107 has no selvedge binding device or system described and thereby fabric handling becomes difficult. The process of selvedge formation, when using warp and weft tapes of such materials and also vertical weft tapes of different widths and thickness within the same fabric, requires a new solution and is described below.

Figure 13A:
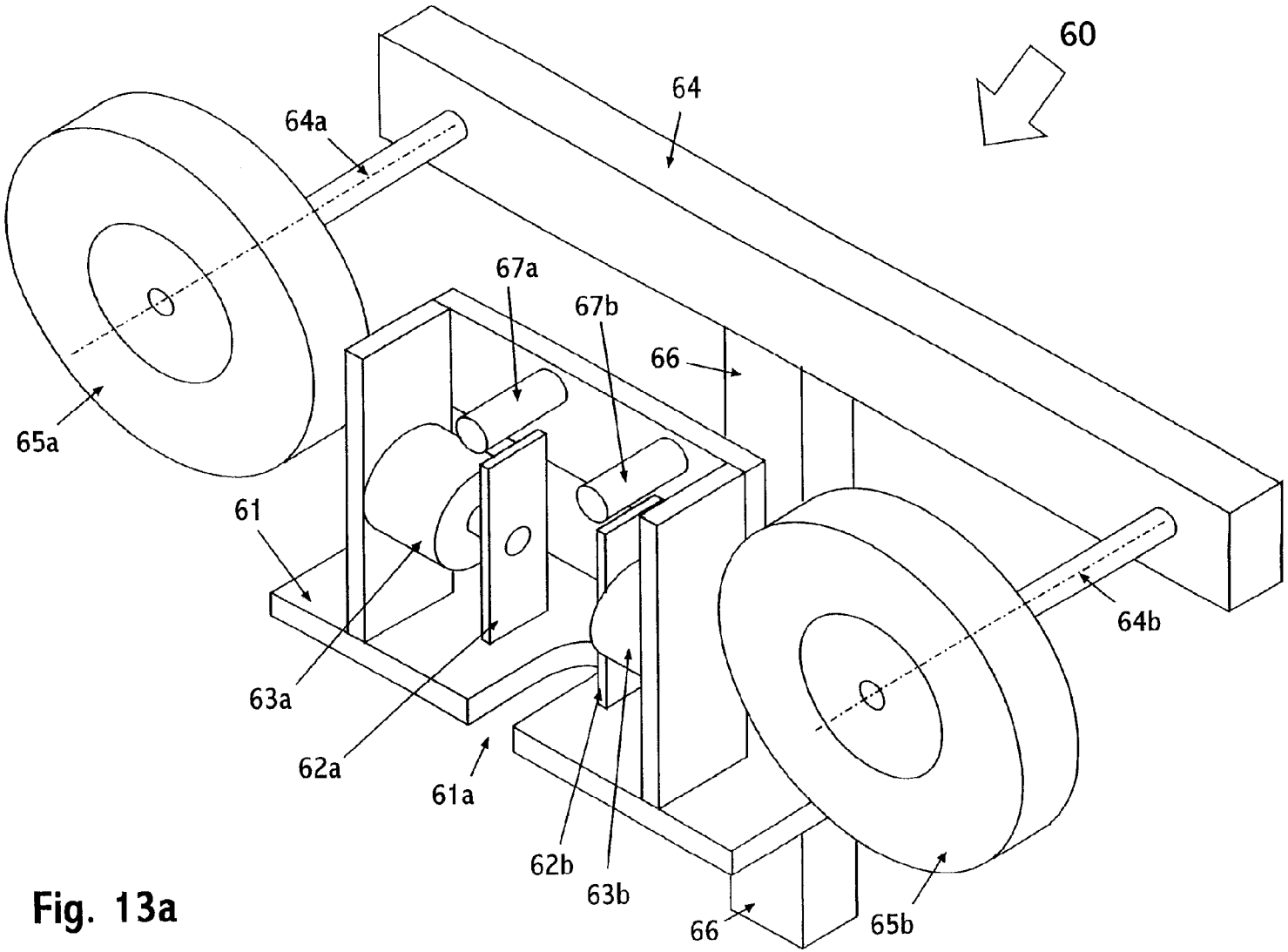
FIG. 13 exemplifies the set up of the selvedge forming unit.
Figure 13B:
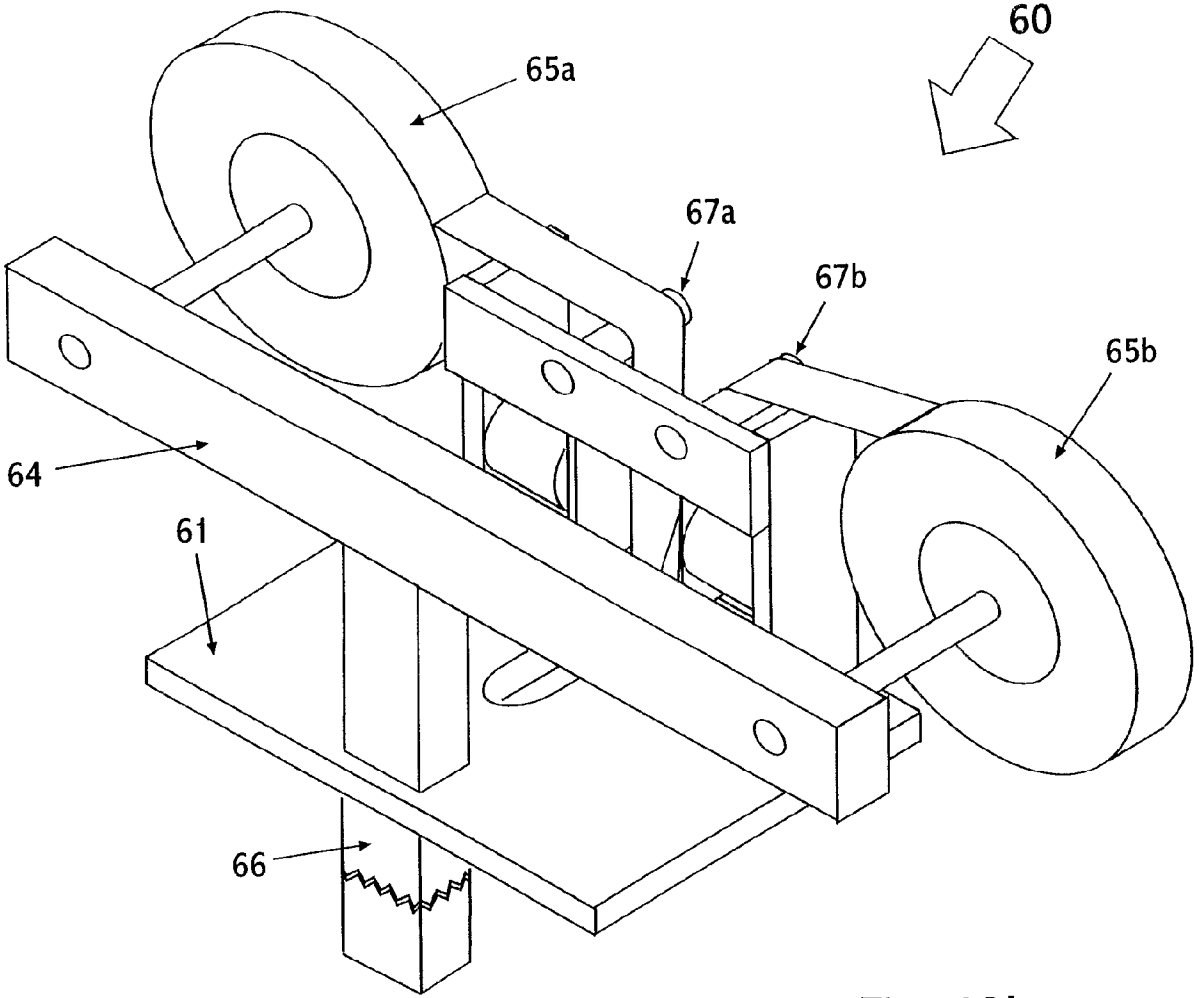

The selvedge-making unit (60) according to the present invention is shown in FIGS. 13*a*, 13*b*. It functions in four ways—(a) it supplies adhesive tapes of required lengths for binding the front and back sides of the woven material according to the different widths of wefts inserted, (b) it joins the supplied adhesive tapes to the front and back sides of the tensionless wefts in a flat condition (c) it aids release of required length of adhesive tapes for next cycle, and (d) it enables satisfactory fabric take-up.

A pair of units (60), one for producing each selvedge side, is provided. The constructions of these two units (60) are mirror images of each other as can be understood from FIGS. 13*a*, 13*b*. The unit (60) comprises mainly a base plate (61) with an opening (61*a*) at the inner side to let the outermost warp tape and the adjoining weft tapes that protrude or extend to pass through, a pair of clamping units (62*a*, 62*b*) controlled by devices (63*a*, 63*b*) respectively, a bar (64) carrying a pair of adhesive tape rolls (65*a*, 65*b*) reciprocated by bar (66).

These parts are arranged as follows. The side opening (61*a*) of the base plate (61) is located such that the outer most warp tapes pass through it in a straight path (guided by rolls which spans the whole width of the weaving machine, not shown in FIG. 13). The base plate (61) is located a few weft tapes below the fabric-fell position. At the fabric inlet side of the opening (61*a*) are located clamping plates (62*a*, 62*b*), which face each other. Both the plates (62*a*, 62*b*) will thus face the woven material; one facing the front side and the other the backside. The clamps (62*a*, 62*b*) can be closed (brought closer to each other) and opened (drawn away from each other) using devices (63*a*, 63*b*), which can be mechanical, electrical, pneumatic etc. systems. In closed position the clamping plates (62*a*, 62*b*) will press against each other and thereby hold the fabric in between them. In open position, the clamping plates (62*a*, 62*b*) have no contact with the fabric.

The base plate (61) also supports a reciprocating bar (66) as shown in FIG. 13*b*. The bar (66) reciprocates in a plane perpendicular to the base plate (61). The reciprocation of bar (66) is achieved through suitable mechanical, electrical, pneumatic systems, or their combination systems etc. and is not shown in FIGS. 13*a*, 13*b*. The bar (64), which is attached to the reciprocating bar (66), carries holders (64*a*, 64*b*) at each of its ends to hold adhesive tape rolls (65*a*, 65*b*). The rolls (65*a*, 65*b*) can turn freely on their holders (64*a*, 64*b*). Guide pins (67*a*, 67*b*) are included as shown in FIGS. 13*a*, 13*b* to direct the passage of adhesive tapes (65*a*, 65*b*) from their rolls to the selvedge forming zone. The positions of the guide pins (67*a*, 67*b*) are such that the adhesive tapes (65*a*, 65*b*) always form a 'V' opening between their sticking point and the two guide pins (67*a*, 67*b*). Such an opening is required to receive the extending or protruding ends of vertical weft tape directly into the selvedge forming zone. The stroke length of the reciprocating bar (66) can be suitably controlled for processing different widths of weft tapes. In any case the maximum stroke length of reciprocation will correspond to a little more than the widest weft tape the weaving machine has been designed to process.

Figure 15:
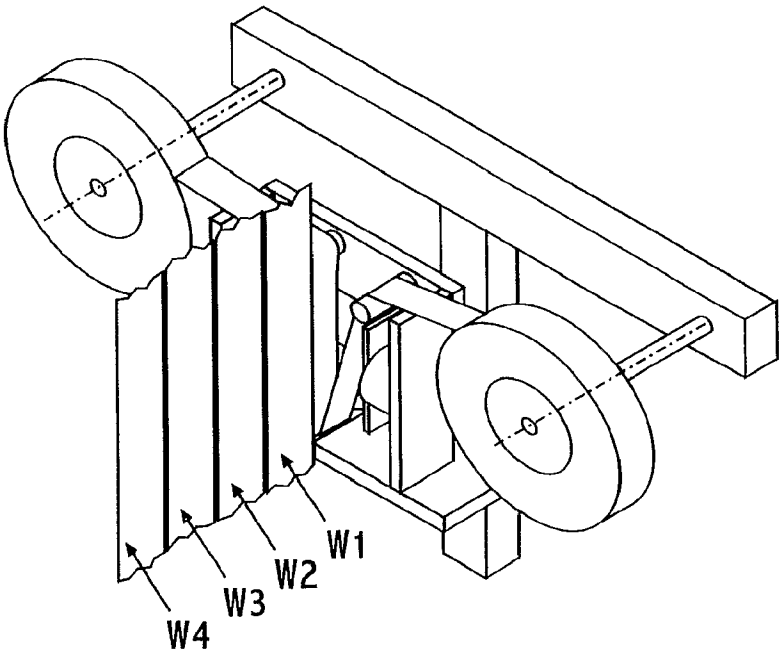
FIG. 15 exemplifies the location of the selvedge forming unit in relation to the warp tapes.
Figure 14:
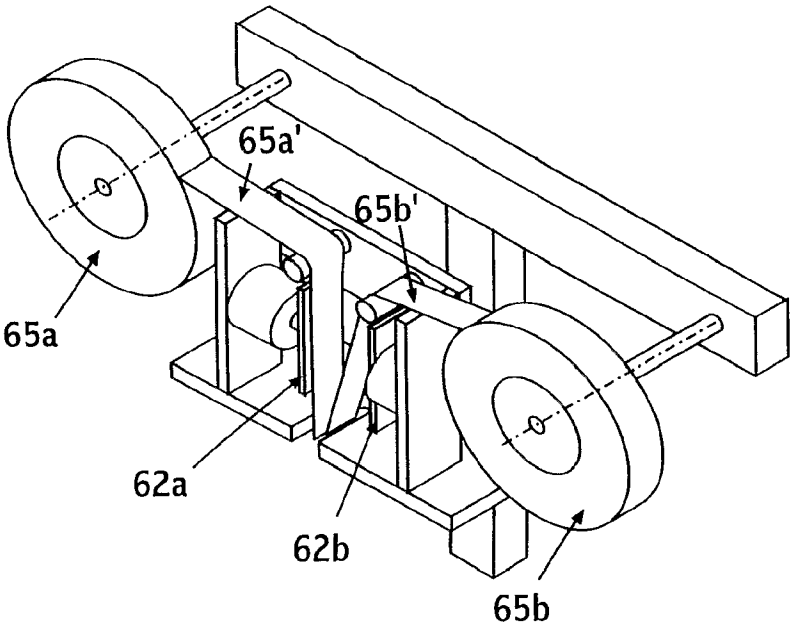
FIG. 14 exemplifies the path of the selvedge binding adhesive tapes.

Each of the pulled out part of the adhesive tapes (65*a*', 65*b*') occurs in front of the corresponding clamp plates (62*a*, 62*b*) such that the adhesive sides of the tapes (65*a*, 65*b*) face each other as shown in FIG. 14. The adhesive tape rolls (65*a*, 65*b*) are positioned on the holders (64*a*, 64*b*), such that the inner edges of the front and back adhesive rolls (65*a*, 65*b*) are closely aligned parallel with the outer edge of the outermost warp tape W1 as shown in FIG. 15. Suitable guides are incorporated to maintain alignment between the inside edges of adhesive tapes (65*a*, 65*b*) and the outside edges of outermost warp tapes.

Figure 16:
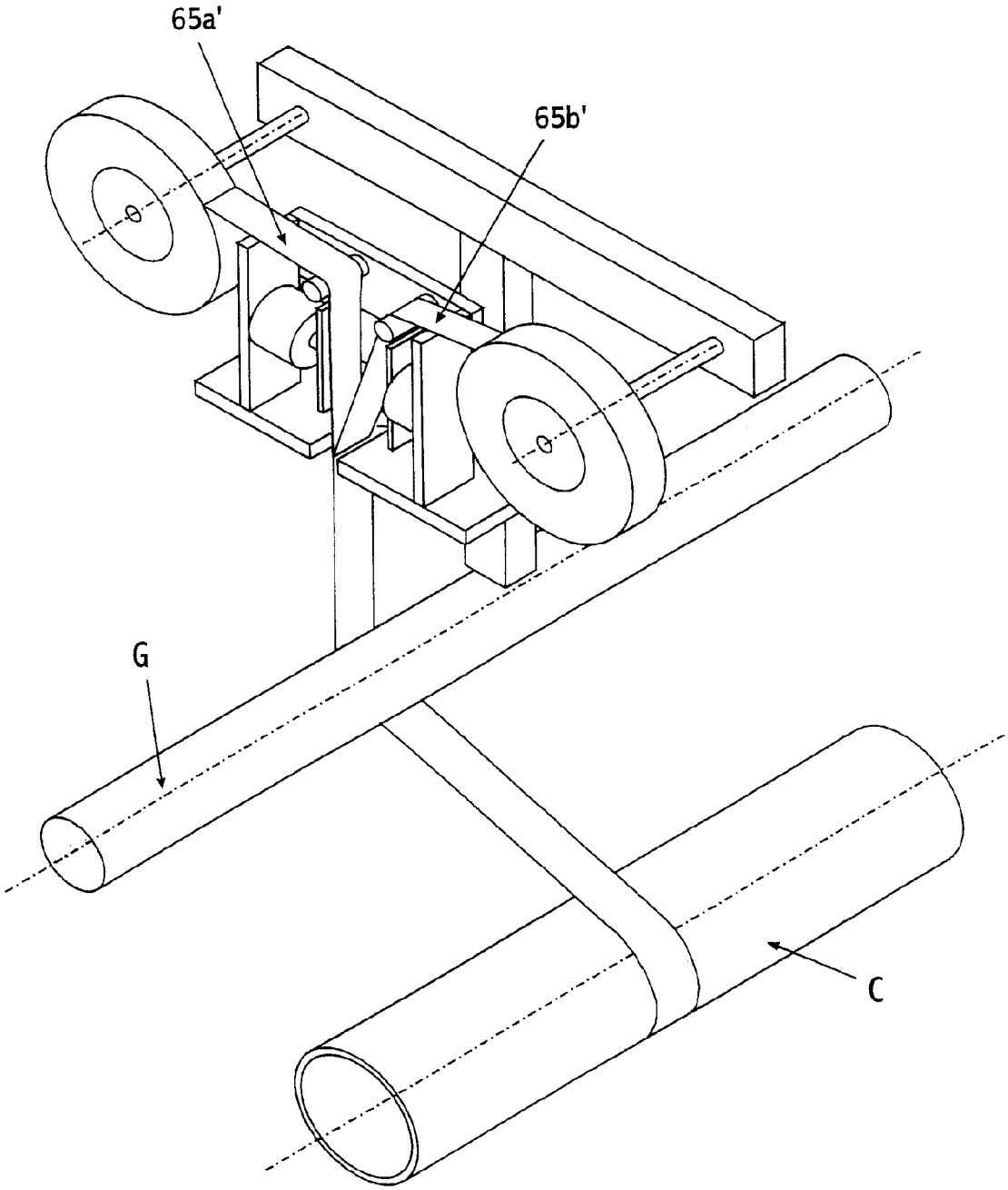
FIG. 16 exemplifies the selvedge forming adhesive tape's passage from its supply source to fabric taking-up unit.

The working of the selvedge-forming unit (60) is described now. Initially, as shown in FIG. 16, the clamps (62*a*, 62*b*) are in open position and the adhesive tape (65*b*') from the front roll (65*b*) is pulled out, guided in front of the corresponding clamp plate (62*b*), behind the machine's guide roll (G) and fixed to the core (C) on which the fabric is to be wound up. The back tape (65*a*') is also pulled out, guided in front of its clamp plate (62*a*) and joined to a reasonable length of the already guided and fixed front tape (65*b*). As the adhesive sides of the tapes (65*a*', 65*b*') face each other, a full overlapping of the two tapes (65*a*', 65*b*') is achieved by proper guiding and aligning.

Figure 17:
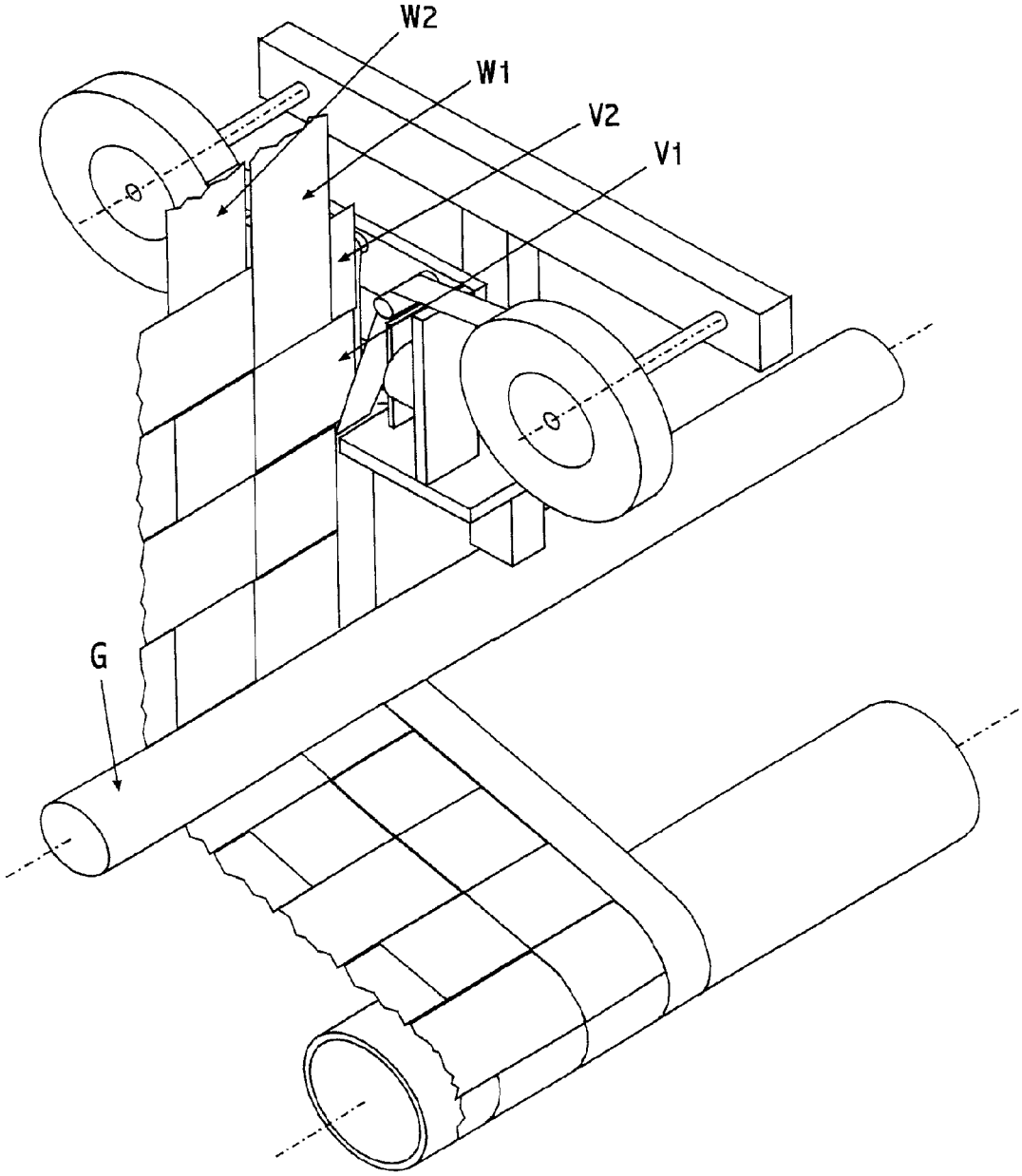
FIG. 17 exemplifies formation of the woven material's selvedge.

Referring to FIG. 17, after inserting the weft tape (V2), the clamps (62*a*, 62*b*) close gripping between them the part of a previously inserted vertical weft tape (V1) which extends in a flat condition from the outermost warp and the adhesive tapes (65*a*', 65*b*'). By this clamping action the adhesive tapes (65*a*', 65*b*') are pushed towards each other and pressed on the extending ends of the inserted weft tape (V1) from opposite sides causing fixation of the adhesive tapes (65*a*', 65*b*') at the front and back sides of the weft tape (V1) and close to the outermost warp tape W1. The continuous joining of the adhesive tapes (65*a*, 65*b*) to the extending tensionless flat weft tapes and close to the outermost warp tapes produces the selvedge parallel to the selvedge.

With the clamps (62*a*, 62*b*) still in closed position, the bar (66) is moved down towards the base plate (61) bringing down with it the bar (64) and hence the adhesive rolls (65*a*, 65*b*). This movement unwinds a length of adhesive tapes from both the rolls (65*a*, 65*b*). The length of adhesive tape (65*a*', 65*b*') to be released corresponds with the down ward stroke length of bar (66). This stroke length can vary in accordance with the width/s of weft tapes being inserted. The desired stroke length of bar (66) can be controlled through suitable sensors which determine the width of the weft being inserted and signalling the device that reciprocates the bar (66). Soon the clamps (62*a*, 62*b*) are opened and bar (66) moved upwards. The weft tape now adhering to the adhesive tapes is released from clamps (62*a*, 62*b*) and also a predetermined and equal length of front and back adhesive tapes (65*a*', 65*b*') made available for the next cycle. The woven material with the just formed selvedge length portion is now freely available for being taken-up by the taking-up device.

It may be noted here that satisfactory taking-up of woven material can be effected only if unit (60) releases adequate length of back and front adhesive tapes (65*a*', 65*b*') and also by releasing the weft tape ends from the gripping action of clamps (62*a*, 62*b*).

As the fabric is taken-up, the just inserted weft tape and the released predetermined length of the adhesive tapes (65*a*', 65*b*') are brought in front of the clamp plates (62*a*, 62*b*). The described procedure is repeated in the next cycle to form selvedges repeatedly.

The unit (60) at the other selvedge side works identically to bind the weft tape end extending from the other outer most warp tape and forms the selvedge. Through their simultaneous working, selvedges on both sides are produced continually. Employing such independent units (60) enables production of any width of woven material as one unit can be moved either closer to or away from the other. Such a selvedge binding device is equally employable when relatively thinner and thicker wefts tapes, doubled wefts are used and also when slanted/oblique wefts are incorporated in the fabric.

It may be pointed out here that the described selvedge binding device (60) can be employed with modification as well wherein the adhesive tapes (65*a*, 65*b*) are not used. Such a modified binding device is employable when the warp and weft tapes are made from either some polymeric materials or fibrous materials. To exemplify, the binding of the selvedges can be achieved by fusing the polymeric materials thermally and interlocking the fibrous materials mechanically. To carry out these binding alternatives, only the clamping units (62*a*, 62*b*) have to be modified. When processing polymeric material tapes, the clamps (62*a*, 62*b*) can be of heat-able type so that when they close the polymeric material tape between them melts and fuses with each other. The clamping plates (62*a*, 62*b*) in this case need not be of flat construction. It could be provided with suitable projections like pins and other profiles. When processing fibrous material tapes the clamps (62*a*, 62*b*) can be of the barbed needle type so that when they close some of the fibres of the tapes are pulled out in back and forth directions to produce a mechanical interlocking. In any case the working principle of these modified selvedge binding devices will be similar to the one described earlier. Alternatively, selvedge binding could be also accomplished by employing the nipping action of two rollers, instead of the clamps, such that the adhesive tapes are pressed against each other.

(e) Device for Taking-Up

To achieve satisfactory continuity in weaving it is preferred to maintain the fabric-fell position constant. This is conventionally achieved by advancing the fabric through fixed increments after every weft insertion. A take-up roller is employed commonly to perform the task. The required surface speed of the take-up roller is controlled through either a train of gears or other mechanisms that are often activated by the oscillating sley that serves to support weft insertion and effect beating-up the weft through the mounted reed. The existing conventional take-up device would be unsuitable if wefts of different widths, for example 20 and 50 mm, are to be woven either alternately or 'at will' (i.e. in any desired order) in the same fabric. Further many delicate/fragile/brittle materials and constructions are also difficult to be processed by the conventional system. It is also not possible to maintain a tensionless regulation of tape-like warp during shedding and take-up through it. Because the present invention concerns weaving tape-like warp and weft wherein no sley and reed are employed, the conventional take-up systems are not possible to be incorporated. Further, from the point of according processing safety to brittle fibrous tape materials and delicate metallic foils and polymeric films it is preferable to have the least bending, frictional and compression points between warp supply and fabric take-up. The conventional take-up system's design is such that these bending, frictional and compression points are not avoidable because the fabric is usually woven horizontally above the breast beam and it is wound up below the breast beam. It is relevant here to refer again to U.S. Pat. No. 5,455,107 wherein the conventional taking-up system is employed for handling 'flat carbon fiber yarn'. Such a conventional taking-up system, as explained, will have an adverse affect certain woven material's quality and performance, and hence such a device is not preferable for woven materials comprising tape-like warp and wefts.

Another often important requirement is the need of continuous incorporation of suitable paper or film between the layers of the woven material being rolled to avoid undesirable structural defects such as those that may arise from sticking of fabric layers due to loose fibres, sizing agents etc. when unrolling the fabric during subsequent handling and process. Inclusion of paper/film is also needed to prevent contamination such as might happen by the settling of fluff, foreign matter etc. during weaving. Inclusion of paper/film also helps in producing a ready package for further handling and protection during transportation. To process certain brittle materials it could be advantageous to roll the woven material in a way that it gets directly rolled into the paper/film without coming into contact with any machine element. Under such a condition it would be preferable to have a flexible take-up system that can be turned in both clockwise and anti-clockwise directions so that the suitable path of the woven material can be selected to avoid those elements that could cause abrasion of material. As can be seen now, a new take-up device is advantageous for weaving tape-like materials.

Figure 18:
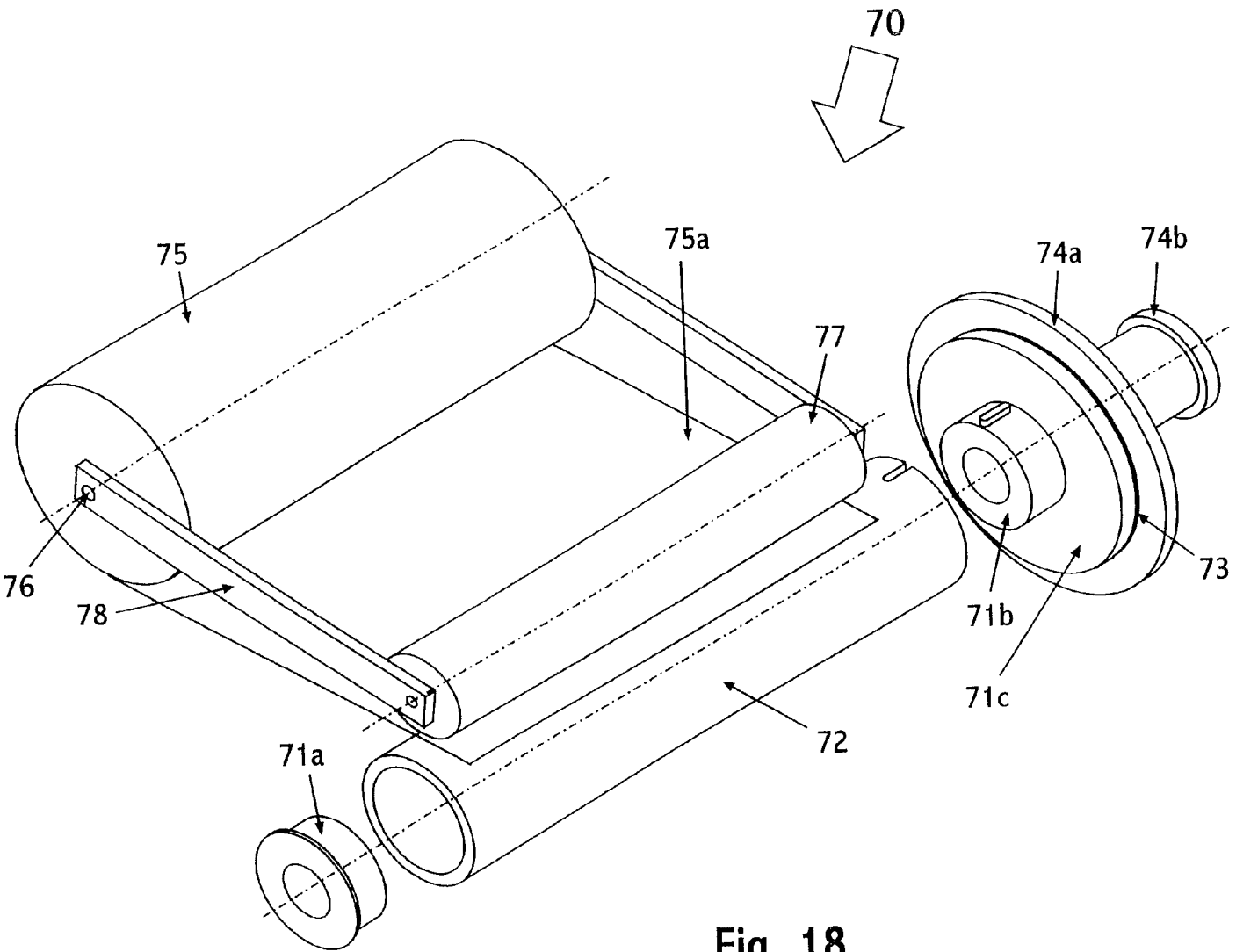
FIG. 18 exemplifies the set up for taking-up tensionless woven material along with paper/film.

The take-up device (70) according to the present invention is described in reference to FIG. 18. The main parts of this device are a cloth roll support blocks (71*a*, 71*b*), a base tube (72), a frictional liner (73), a driving unit (74*a*, 74*b*), a paper/film roll (75), and a guide-press roller (77) to prevent lateral displacement of woven material and to build a compact fabric package.

The cloth roll support blocks (71*a*, 71*b*) receive the ends of tube (72) and hold the same securely. The blocks (71*a*, 71*b*) are mounted on shafts fixed to the machine frame (not shown in FIG. 18). Block (71*a*) is free to turn but can be prevented from lateral displacement over its shaft by a stop ring. The other end of the tube (72) is located on block (71*b*) with which it locks through the keyway cut on it and the key fixed on block (71*b*). The block (71*b*) is part of a large disc (71*c*) and together they sit on a fixed support shaft. The disc (71*c*) can be turned in either direction and maintained under a braking action to prevent its undesirable reverse turning. The possibility of turning the tube (72) by the disc (71*c*) in the desired direction is advantageous as will be explained soon. The disc's (71*c*) rear wall can be of flat rough surface so that it can be driven by friction. Another disc (74*a*), which is behind disc (71*c*), has a frictional material (73) fixed at its front surface. Disc (74*a*) is coupled to a driving unit (74*b*), which can be activated intermittently at the required moment. The driving unit (74*b*) can be of either mechanical, pneumatic, electrical systems or a combination type and capable of being turned in either direction.

The paper/film roll (75) is supported on rod (76), which can receive roll of paper/film (75) of different widths to correspond with the width of the woven material being produced. When feeding paper/film (75) of relatively smaller widths, arms (78) can be fixed at either sides of the roll to prevent its lateral displacement. The rod (76) carries self-aligning bearings to support the paper/film roll (75) so that the longitudinal axis of the paper/film roll always remains parallel to that of the tube (72). This is preferable to prevent supply of skewed paper/film during fabric winding.

As woven material and paper/film are preferred to be wound simultaneously, a guide-press roll (77) is advantageously provided to produce a well-built compact package of the woven material. The guide-press roll (77) is a cylinder supported between two arms (78), which may extend from the rod (76) itself to ensure that the axes of the paper/film roll (75), guide-press roll (77) and the tube (72) are always maintained parallel. Such an arrangement enables the guide-press roll (77) to exert an even pressure over, and remain in constant uniform contact with, the entire width of the woven material and paper/film (75) being wound and keep them in their paths. Different lengths of press-guide rolls (77) can be employed to correspond with the width of the woven material being produced. The arms (78) can also be fixed in position corresponding with the width of paper/film roll (75) being employed so that the paper/film is always guided between these arms (78) to the guide-press roll (77) which enables the paper/film to move in a constant path.

It may be mentioned here that for additional control of fabric's path it is sufficient to have narrow width guiding rolls located at the selvedge sides for pressing the woven material at only the selvedge adhesive tapes outside the body of the fabric. Alternatively, these rolls could be also in the form of a needled ring. This way compression of the fabric's body can be avoided and hence no damage to the fibres of the fabric body.

Figure 19:
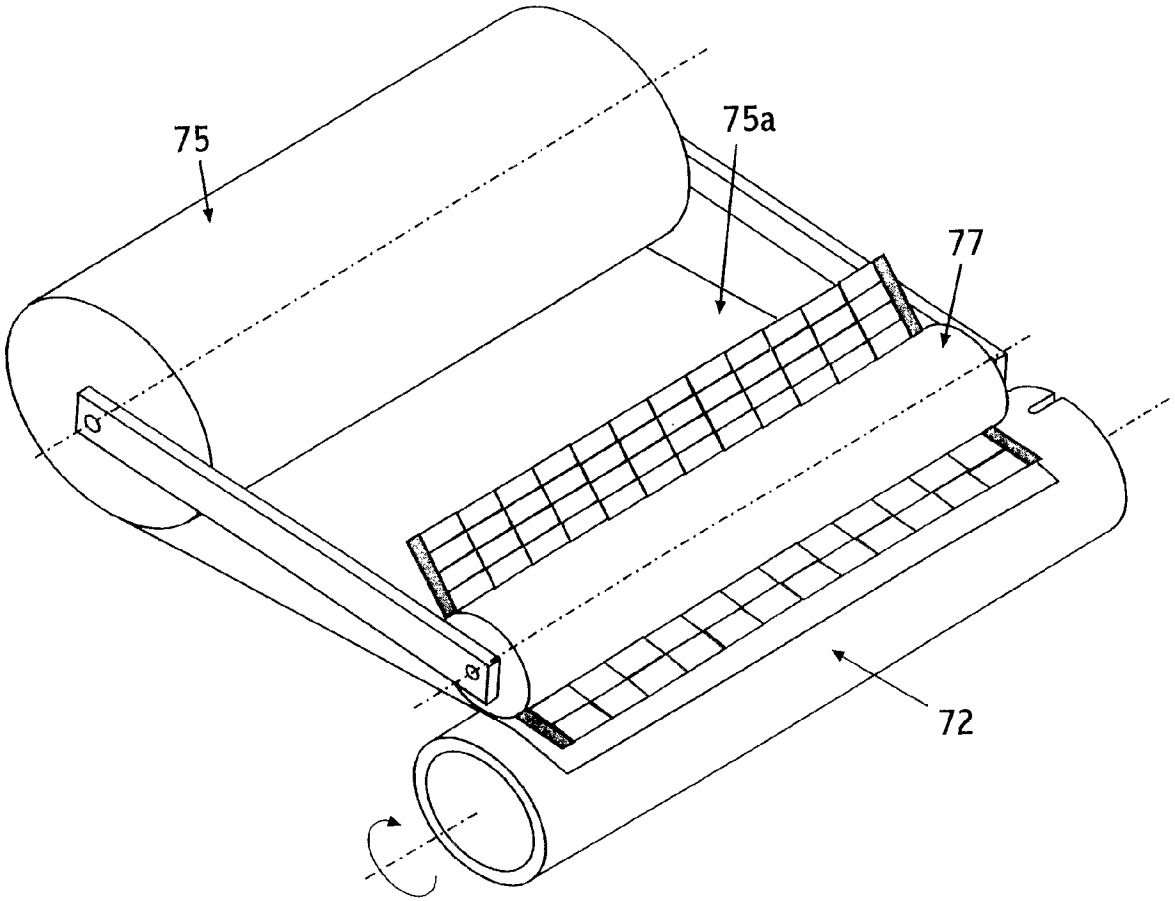
FIG. 19 exemplifies the taking-up device's possibility of winding the woven material from over the cloth roll.
Figure 20:
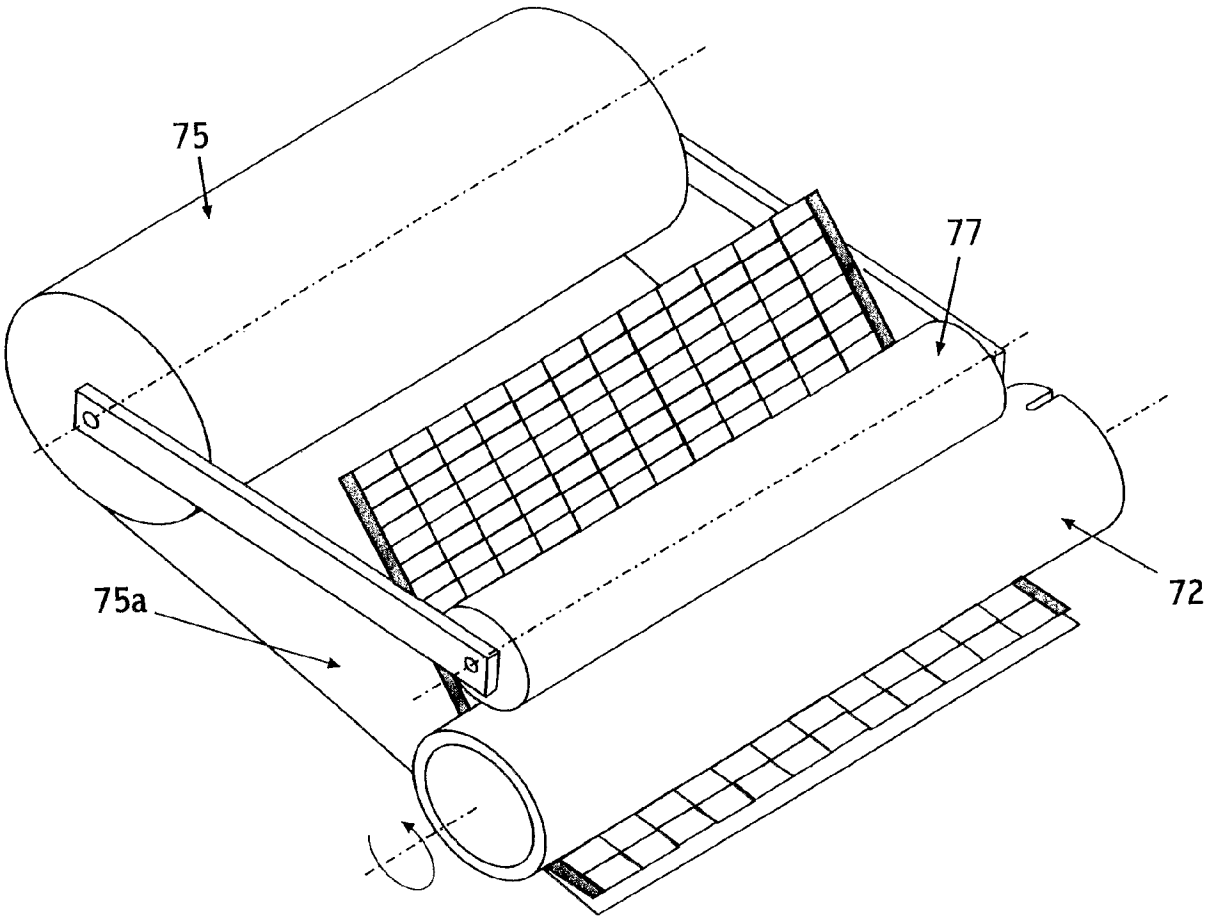
FIG. 20 exemplifies the taking up device's possibility of winding the woven material from under the cloth roll.

As mentioned earlier, the tube (72) can be turned in either direction through its driving unit (74*b*). For most woven materials, the path of paper/film (75*a*) and fabric can be over the tube (72) as shown in FIG. 19 in which case the guide-press roll (77) will turn clockwise and always have direct surface contact with the facing side of the woven material. However, when certain delicate materials are required to be woven, it might be advantageous to avoid rubbing action as might come from the surface contact between the guide-press roll (77) and the woven material. In such a situation the described arrangement is advantageous because it allows the possibility to pass the paper/film (75*a*) and woven material from under the tube (72) as shown in FIG. 20 and fed into the nip between guide-press roll (77) and tube (72) from the front side. The tube (72) in this case will be turned in the anticlockwise direction as viewed in FIG. 20. In this type of passage the guide-press roll (77) will have surface contact with the paper/film (75*a*) and not with the woven material. It may be noted that in this type of passage the woven material will also never have any surface contact with tube (72), as it will be always in contact with the paper/film (75*a*) at both faces without risk of any rubbing action.

As can be understood now, such flexibility in winding a woven material in two different paths is not possible to achieve with existing take-up devices or systems.

The working of the take-up unit (70) is described now. A plastic/cardboard core tube, (not shown in FIGS. 18-20) having a length that is a little more than the width of the material being woven, is mounted on tube (72), if required. The use of plastic/cardboard tube is beneficial for handling and transporting the woven material. The core tube is then secured firmly in place by using screws, rings etc. at both ends. The tube (72) carrying the core tube is supported between the blocks (71*a*, 71*b*) and locked in position (the key on block (71*b*) engaging with keyway on tube (72) at the right end side as can be understood from FIG. 18 and using a stop ring at the block (71*a*) side as described earlier). The required number of warp tapes for producing the given width of woven material are drawn from their respective spools and attached to the core tube. Any slackness in the warp tapes is removed. Next, the paper/film (75*a*) of corresponding width is pulled out from its supply roll (75) and attached to the core tube. The back and front selvedge binding adhesive tapes (65*a*', 65*b*') are drawn out, overlapped and attached to each other and to the core tube beside the outermost warp tapes (as described earlier in the section concerning selvedge binding). The press-guide roll (77) of corresponding length is supported between its arms (78), positioned over the area where woven material will form and rested on the core tube.

After the weft tape has been aligned at the fabric-fell and the shed closed, the warp feeding device (10) feeds the required length of tensionless warp corresponding with the width of the just inserted weft tape. Immediately the disc (71*c*) is driven in the set direction and the just fed warp length, which also corresponds with the length of the just woven material, is wound on the core tube. It may be noted that in this kind of arrangement the warp tapes and fabric are always maintained in a tensionless state but not loose/slack. The same procedure is repeated after every weft tape insertion and the woven material is continually wound. After the required length of woven material has been produced, the warp tapes and the selvedge binding tapes are cut off at a suitable place. The disc (71*c*) is driven further a few times, either manually or through its driving source, to wind up extra paper/film (75*a*) on the woven material to protect it for further handling. After sufficient paper/film has been wound, it is cut off. The screws, rings etc. securing the core tube at either ends are released. The tube (72) is disengaged from its supporting blocks (71*a*, 71*b*) and taken out and placed on a suitable stand to subsequently slip out the core tube, and hence woven material, from the tube (72). The packed woven material is ready for shipment to the subsequent task.

The described take-up device (70) works effectively because it winds up the woven material directly without subjecting it to usual compression and bending points. Also, the friction driven disc (71*c*) is always turned by a constant angle by the driving unit (74*b*) and due to the slip-and-stick action of the frictional liner (73) warp tapes cannot be tensioned or left slack during turning of the tube (72) for take-up. The same also applies for the selvedge binding adhesive tapes. This is because the warp feeding device and the selvedge binding device hold the respective tapes under their respective clamping actions while feeding a determined length of flat tensionless warp and adhesive tapes corresponding with the width of the weft tape inserted during taking-up. This way a constant tensionless condition is maintained in the warp tapes and the woven material.

Because the described take-up device is not driven by any oscillating part of the weaving machine, but directly by its driving unit (74*b*), such a take-up unit could be had either within the weaving machine or outside of it, for example when weaving very large diameter rolls of woven material.

As will be apparent now to those skilled in the art, such a take-up device or system uniquely differs from the existing systems and can be employed for taking-up a fabric that comprises same and different widths of wefts and also that which is supplied in a tensionless condition. It also eliminates the risk of causing damage to either fibres or structure because no frictional and compression points are involved as happens with the conventional take-up system.

It may be added here that the described take-up device could be modified to advance the fabric as described but instead of winding the material into a roll, the fabric is laid in folded sheets by, for example, a reciprocating guiding bar. Such a take-up device would be preferred when weaving, for example, a material the thickness of which is not the same from one selvedge side to the other as in a wedge-shaped material to be described soon.

Figure 21:
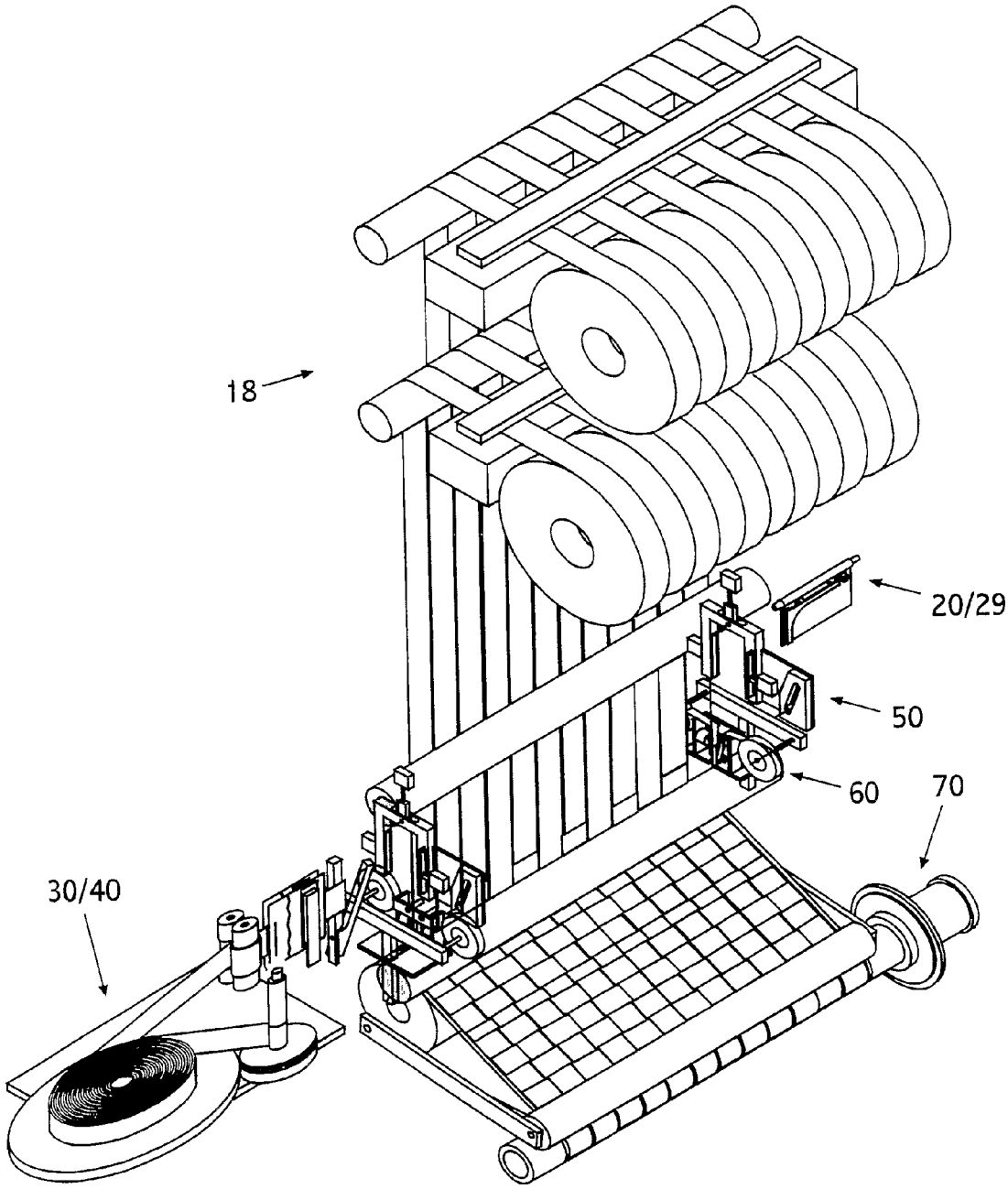
FIG. 21 exemplifies the unified representation of the locations of all the described devices for weaving tape-like warp and weft in a vertical format apparatus.

Having described in sufficient detail the method for weaving vertically tape-like warps and wefts according to present invention, a unified representation of the various units is indicated in FIG. 21. The locations of all the described devices or systems relative to each other in the apparatus are shown. Although the described devices or systems are preferable to carry out weaving vertical warps and wefts, they are also employable for horizontal and inclined formats of weaving apparatuses. Further, the presented description should not be interpreted to imply that through this process weaving of tensioned warps and wefts couldn't be carried out. By suitable control of the parts concerned it is possible to weave under tension as well. A weaving device according to the described method could be of preferably modular construction for manufacturing flexibility.

It may be noted that the described method is also employable in the manufacture of woven materials wherein the warp is composed of yarns (not tapes) and the weft is tape-like. Also, through suitable modifications it is possible to manufacture woven materials wherein the warp is tape-like and the weft is composed of yarns.

It is to be understood that in the context of this application, the terms "system", "device", "apparatus" and "unit" are used synonymously, and these terms refer to a structure comprising one or several parts, and where the parts are loosely or fixedly connected, or even non-connected parts operating together.

Programme

For automatic sequential working of these operative devices or systems a programme is advantageously provided. Taking into account that shedding operation is central to weaving, a general outline of the programme is tabled below. The indicated programme concerns one cycle of operations and the terms 'ON' and 'OFF' are only suggestive of the 'working' and 'not-working' of those operations. The reference corresponds to the Figures and the part numbers given in this document. For improved weaving efficiency, a number of steps are performed together. Secondary or sub-parts of the programme, for example those concerning selection of different weft tape widths and corresponding feed of warp lengths, are excluded because they are only sub-details of the main programme and will work similar to the main programme and in smaller loops.

Programme Outline for Weaving Tape-Like Warp and Weft

| First Half Cycle | | | Second Half Cycle | |
|---|---|---|---|---|
| Reference | Action | Steps | Reference | Action |
| 5a/6a (FIG. 1) | ON | Warp clamping | 5b/6b (FIG. 1) | ON |
| 7b (FIG. 1) | ON | Feeding tensionless warp | 7a (FIG. 1) | ON |
| 14 (FIG. 1) | ON | Shed opening | 14 (FIG. 1) | ON |
| 22/23 (FIG. 4, 6a) | ON | Gripper closing | 22/23 (FIG. 4, 6a) | ON |
| 20/29 (FIG. 6b) | ON | Gripper moving in | 22/23 (FIG. 6b) | ON |
| 22/23 (FIG. 3) | OFF | Gripper opening | 22/23 (FIG. 3) | OFF |
| 34a/34b (FIG. 9) | ON | Weft feeding | 34a/34b (FIG. 9) | ON |
| 22/23 (FIG. 6c) | ON | Gripper holding weft | 22/23 (FIG. 6c) | ON |
| 20/29 (FIG. 6d) | OFF | Gripper moving out with weft | 20/29 (FIG. 6d) | OFF |
| 52a/b (FIG. 11, 12) | ON | Weft depositor clamp closing | 52a/b (FIG. 11, 12) | ON |
| 37 (FIG. 9) | ON | Weft cutting | 37 (FIG. 9) | ON |
| 37 (FIG. 9) | OFF | Cutter opening | 37 (FIG. 9) | OFF |
| 22/23 (FIG. 3) | OFF | Gripper releasing weft | 22/23 (FIG. 3) | OFF |
| 50 (FIG. 11, 12) | ON | Aligning weft at fabric-fell | 50 (FIG. 11, 12) | ON |
| 7b (FIG. 2) | OFF | Retracting warp for levelling | 7a (FIG. 2) | OFF |
| 14 (FIG. 2) | OFF | Shed closing | 14 (FIG. 2) | OFF |
| 52a/b (FIG. 11, 12) | OFF | Weft depositor clamp opening | 52a/b (FIG. 11, 12) | OFF |
| 9a/9b (FIG. 2) | ON | Warp feeder moving forward | 9a/9b (FIG. 2) | ON |
| 72 (FIG. 18-20) | ON | Taking-up up fabric | 72 (FIG. 18-20) | ON |
| 62a/b (FIG. 13, 17) | ON | Selvedge binder clamping | 62a/b (FIG. 13, 17) | ON |
| 64/66 (FIG. 13) | OFF | Selvedge binder tape unrolling | 64/66 (FIG. 13) | OFF |
| 64/66 (FIG. 17) | ON | Selvedge binder tape feeding | 64/66 (FIG. 17) | ON |
| 62a/b (FIG. 13, 17) | OFF | Selvedge binder unclamping | 62a/b (FIG. 13, 17) | OFF |
| 50 (FIG. 11, 12) | OFF | Weft depositor moving back | 50 (FIG. 11, 12) | OFF |
| 5a/6a (FIG. 2) | OFF | Warp unclamping | 5b/6b (FIG. 2) | OFF |
| 5a/6a (FIG. 2) | OFF | Warp feeder moving backward | 5b/6b (FIG. 2) | OFF |

As can be observed the different steps described herein are interlinked for successfully weaving tape-like warps and wefts.

Novel Woven Materials

Figure 22:
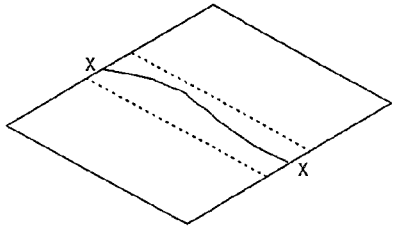
FIG. 22 exemplifies in-plane and out-of-plane non-linear arrangement of fibres in tapes.
Figure 22:
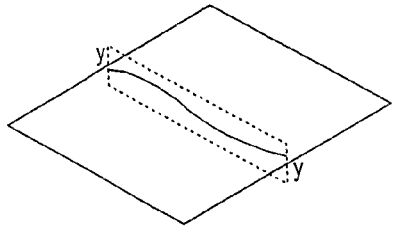
Figure 22:
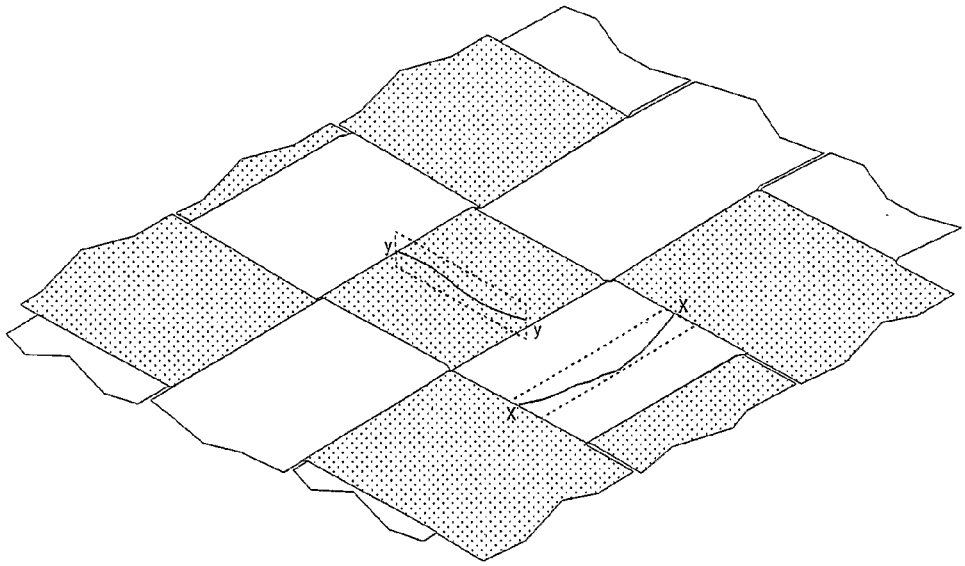

The drawbacks of the tape woven fabrics according U.S. Pat. No. 6,450,208 and U.S. Pat. No. 5,455,107 have been discussed earlier. Also, the inability of the method according to U.S. Pat. No. 5,455,107 to supply tensionless tapes of warps and wefts to cause non-linearity or waving/texturing of the constituting fibres in either wholly stabilized fibrous tapes or non-stabilized fibrous tapes has been explained. Apparently this method can neither produce a material comprising non-linear fibres nor cause non-linearity in the fibres of partially stabilized and non-stabilized types of fibrous tapes; and partially stabilized fibrous tape has not been considered a possibility therein. Accordingly the fibres constituting the woven material according to U.S. Pat. No. 5,455,107 occur linearly orientated in the longitudinal direction of the tape due to their supply under tension. They do not occur non-linearly or waved/textured in their arrangement as shown in FIG. 22, which exemplifies (a) in-plane (x-x) and (b) out-of-plane (y-y) types of non-linear orientation of a fibre in essentially the length direction of a fibrous tape. FIG. 22 (*c*) illustrates a part of a woven material incorporating the non-linear arrangements illustrated in FIGS. 22 (*a*) and (*b*). To make the point clear only one fibre of both types of non-linear orientations are shown. It may be pointed out that the non-linearity of the fibres usually occurs at the interlacing area as shown in FIG. 22 (*c*). It is important to note that this non-linear arrangement of fibres is not the crimp or undulations resulting from the weave. That fibres would occur both out-of-plane and in-plane arrangements along tape's length at different parts is understood and not necessary to show. The fibres constituting the tapes or flat yarns of U.S. Pat. No. 5,455,107 are incorporated linearly and therefore such a material lacks in its ability to conform to shapes effectively and in providing uniform fibre density and orientation as explained earlier.

While the modified horizontal format conventional weaving method according to U.S. Pat. No. 5,455,107 could be employed to weave relatively small width and very thin wholly glued and non-glued fibrous tapes, it can however not process tapes of relatively greater widths and thickness or areal weights in the same fabric. Further, the described method can neither incorporate slant/oblique wefts in relation to warp tapes nor produce a material having a form within its body and a material comprising tapes of shaped edges.

The use of wholly stabilized fibrous tapes is considered unsuitable because its impregnation with another matrix becomes either difficult or incompatible when converting them into a composite material. Similarly the use of wholly non-stabilized fibrous tapes is also unsuitable because its practical handling becomes difficult. Further, such tapes tend to bunch or rope when pulled. In the circumstances it is advantageous to use partially stabilized fibrous tapes.

The partially stabilized fibrous tapes have been defined earlier. Their constructional characteristics have also been given. As would be apparent from the foregoing descriptions, the partially stabilized tapes offer the advantages of introducing controlled non-linearity or waves/textures in the fibrous tapes during weaving, and ease of matrix impregnation because the fibres are more exposed and the scattered binding agent provides passages/channels for matrix or fluid to flow through the fibre mass. Further, a partially stabilized fibrous tape is also advantageous in that when required during shaping they can be sheared within its plane without disintegration. Such a tape of partially stabilized construction remains pliable and yet integrated and thereby the woven material comprising such tapes is easily formable into shapes.

By using partially stabilized fibrous tapes it becomes possible to introduce non-linearity or waves/textures in the arrangement of the fibres in the tapes during weaving of either single or doubled warp and/or weft tapes. Through such an arrangement it becomes possible to achieve highly uniform fibre density and orientation as the tapes of the shaped fabric can be slipped/slid laterally and longitudinally by gentle pulling without the bunching or roping effect. Such a performance is not known by the use of the woven material according to U.S. Pat. No. 5,455,107. The flexibility and the vertical processing format of the weaving method according to present invention opens up new possibilities in manufacturing some novel woven materials. Fabrics comprising non-linear fibres by use of partially stabilized and non-stabilized fibrous tapes and non-fibrous tapes of warps and wefts of either same or different widths, thickness, materials and constructions can be woven directly. Also, fabrics comprising either single layer or doubled warps and wefts of said material types can be woven. In such a fabric a constituent tape of doubled warp/weft tape can be slipped/slid relative to other by pulling without altering the fabric structure. Also, gaps/openings are closed when such tapes are pulled longitudinally and laterally to re-establish fibre linearity and effect uniform fibre density and orientation.

As described earlier, the arrangement of fibres in a partially stabilized fibrous tape can be made non-linear or waved/textured by controlled positive overfeeding of the fibrous tapes by employing a split warp and one weft feeding units. Such a fabric, comprising single layer warps and wefts, is provided with an effective shaping capability and possibility for uniform fibre distribution and density.

Figure 23:
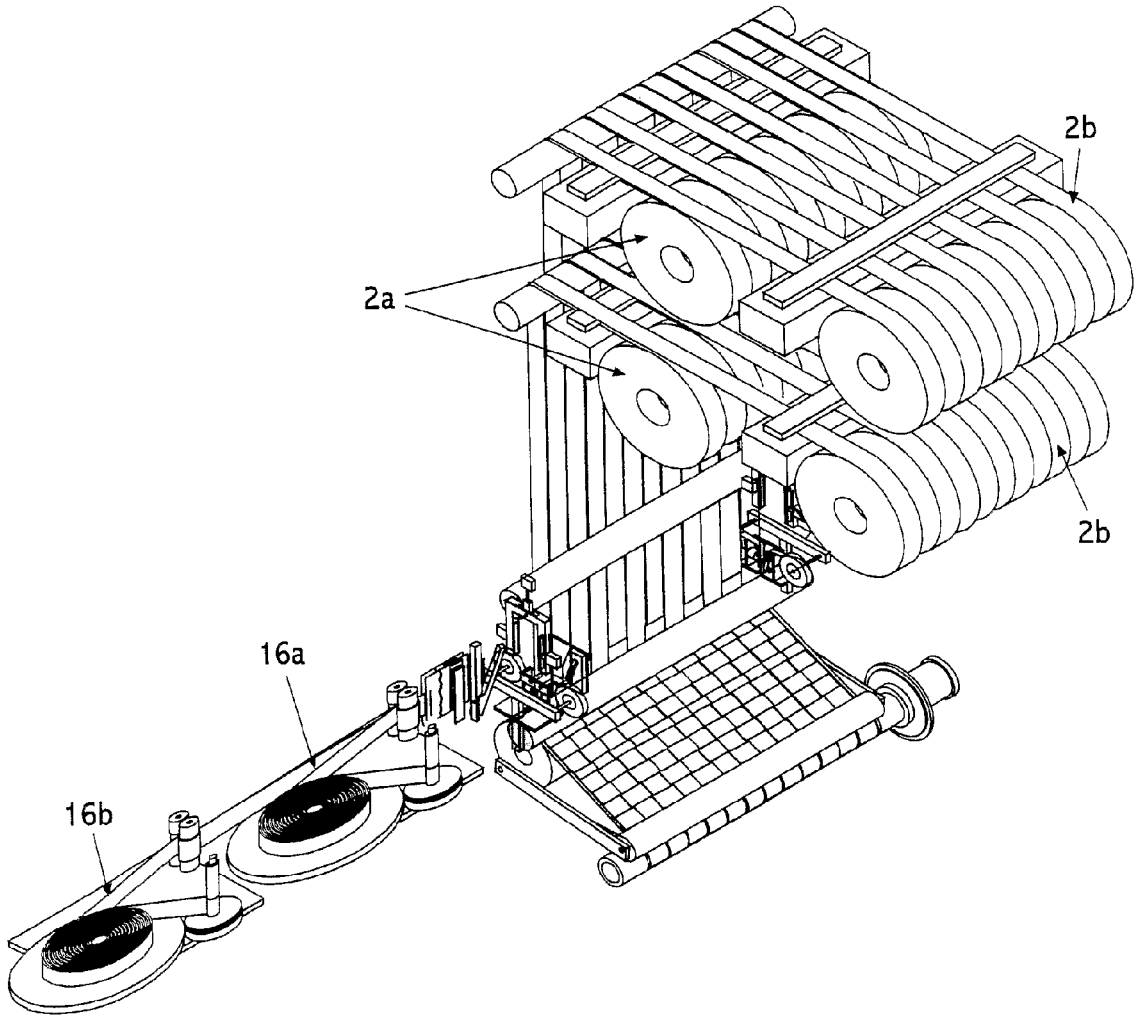
FIG. 23 exemplifies the tandem arrangement for feeding doubled warps and wefts using independent respective feeding units.
Figure 24:
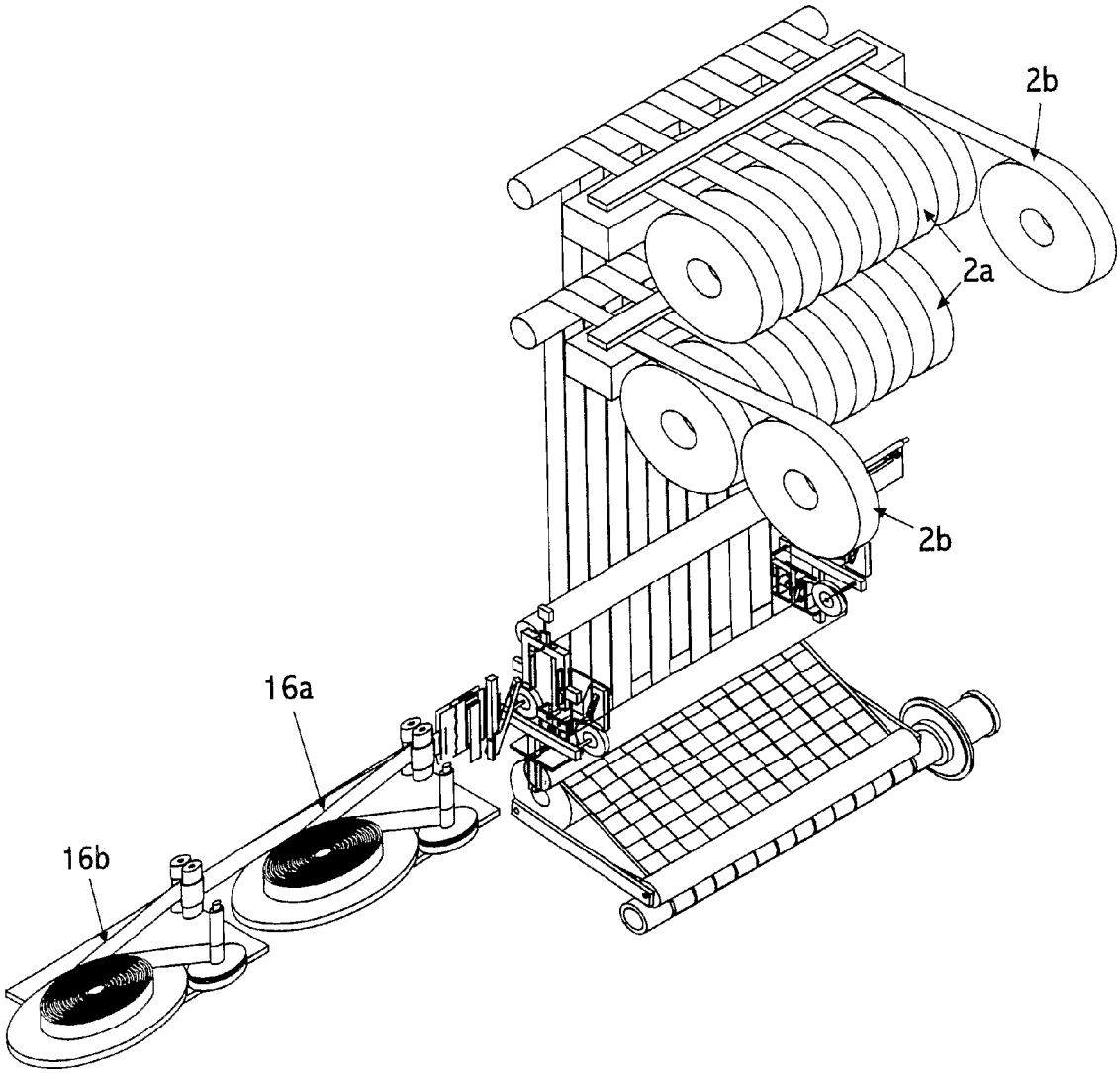
FIG. 24 exemplifies the tandem arrangement for feeding doubled warps and wefts using one respective warp and weft feeding units.

Just as single layer warp and weft can be overfed by employing one split warp feeding and one weft feeding unit, doubled warp and weft are obtained by supplying the required tapes in tandem by employing more than one of each warp and weft feeding units. This way two or more tapes occur stacked one beside the other in the doubled warps and wefts. An arrangement for producing the novel fabrics by supplying warp and weft in tandem is shown in FIGS. 23 and 24. It may be noted that these doubled wraps and wefts serve effectively as a single warp and weft during weaving and in the fabric. FIG. 23 represents supply of only one extra set of warp (2*b*) and weft (16*b*). However, more sets of warps and wefts could be as well organised similarly for achieving the desired number of tandem supplies. If only two or three very thin tapes are required to be processed for a particular application then these could be also fed positively in a tensionless condition and in tandem by employing one warp and weft feeding devices as shown in FIG. 24. While the doubled warps would be clamped and fed employing the same tables (6*a*, 6*b*) and clamps (5*a*, 5*b*), the doubled wefts would be fed employing either same or different guiding-driving rollers (34*a*, 34*b*) and same but bifurcated channel (35). For the purpose of representing such a tandem arrangement, supplies of only additional outermost warps (2*b*) are indicated in FIG. 24.

As described earlier, by controlled positive overfeeding of each fibrous tape constituting the doubled warp and weft tapes to different lengths the fibres in them get correspondingly differently non-linear or waved/textured to different levels. Because of tensionless overfeedings the produced non-linear or waved/textured fibres constituting the doubled warps and wefts continue to remain non-linear when getting interlaced. By this arrangement of feeding tensionless warps and wefts in tandem, the constituent tapes of doubled warps and wefts are neither physically joined nor chemically bonded but still function together effectively as a single warp and weft during shedding and weft insertion and inclusion in the fabric. Only the interlacements keep such doubled warps and wefts together without clutching them.

Now, because weaving is carried out in a tensionless condition, the interlacing points and the crimp level in a tape-woven material is extremely low due to the relatively very large width of the warp and weft tapes used compared with the diameter of the yarn, and the friction between the constituent fibrous tapes is very low as they need not be wholly sized for enabling their satisfactory weaving, novel fabrics are obtained that comprise either partially stabilized or non-stabilized fibrous types of tapes that are incorporated in a non-linear or waved/textured arrangement. The same also applies when processing doubled warps and wefts. These conditions thus jointly enable each of the constituent tapes of such a doubled warp and weft to slide/slip past relative to each other in lateral and longitudinal directions easily by pulling the tapes longitudinally back and forth. Such a sliding/slipping of tapes is possible when the fabric is both in flat and also in curved/shaped configurations. Also, at the same time the waved/textured fibres get re-established in a linear arrangement uniformly in the longitudinal direction. The disconnectedness of the constituent tapes of doubled warp and wefts can be also advantageously used in 'filling up' any adjacent gaps that may arise in some odd shapes by laterally shifting it during shaping operation to achieve a better product quality. The absence of said crumples and stretches means that a uniform fibre distribution and orientation is achieved when a tape-woven material is curved into a shape. An important feature of such a fabric construction is that the woven structure is not altered when a tape constituting the doubled warp/weft is pulled or slid/slipped relative to other. It follows that the important characteristic features of such a novel tape woven fabric come from the use of partially stabilized fibrous tapes and the possibility of displacing individual tapes of the doubled warps and wefts by pulling them in their longitudinal directions without altering the woven structure.

As would be seen now, when such a fabric comprising doubled tapes is curved into a shape it becomes feasible to gently pull the required tapes that are crumpled at the inner side of the curved fabric. Similarly, the tapes encountering stretch at the outer side of the curved fabric will themselves draw the extra length required to conform smoothly to the outer curved shape. Because the individual tapes of doubled warp and weft can be pulled in warp and weft directions, and the fabric can be produced using different widths of warps and wefts, the fabric can be made to conform closely to the curved shapes with uniform fibre density and orientation.

It may be added here that because the tape from a supply roll usually tends to curl inwards when unwound, half the supply rolls could be mounted relatively oppositely from that shown in FIGS. 23 and 24 to balance the directions of curls. While the tapes of one warp row/weft spool could be unwound tangentially from one side of the tape rolls (e.g. in clockwise direction), the tapes of the other warp row/weft spool could be unwound tangentially from the opposite side (anti-clockwise direction). By having about half the total number of warp and weft tape rolls arranged in an oppositely unwinding arrangement a non-curling fabric could be obtained because the curling effect of two sets of warp or weft tapes will be balanced. Such an arrangement of feeding tapes is applicable for processing warps and wefts that are single and also doubled.

As can be understood now woven materials comprising either all doubled warps and single wefts or all doubled wefts and single warps or all doubled warps and doubled wefts either throughout the fabric or in certain parts could be as well produced.

Figure 25:
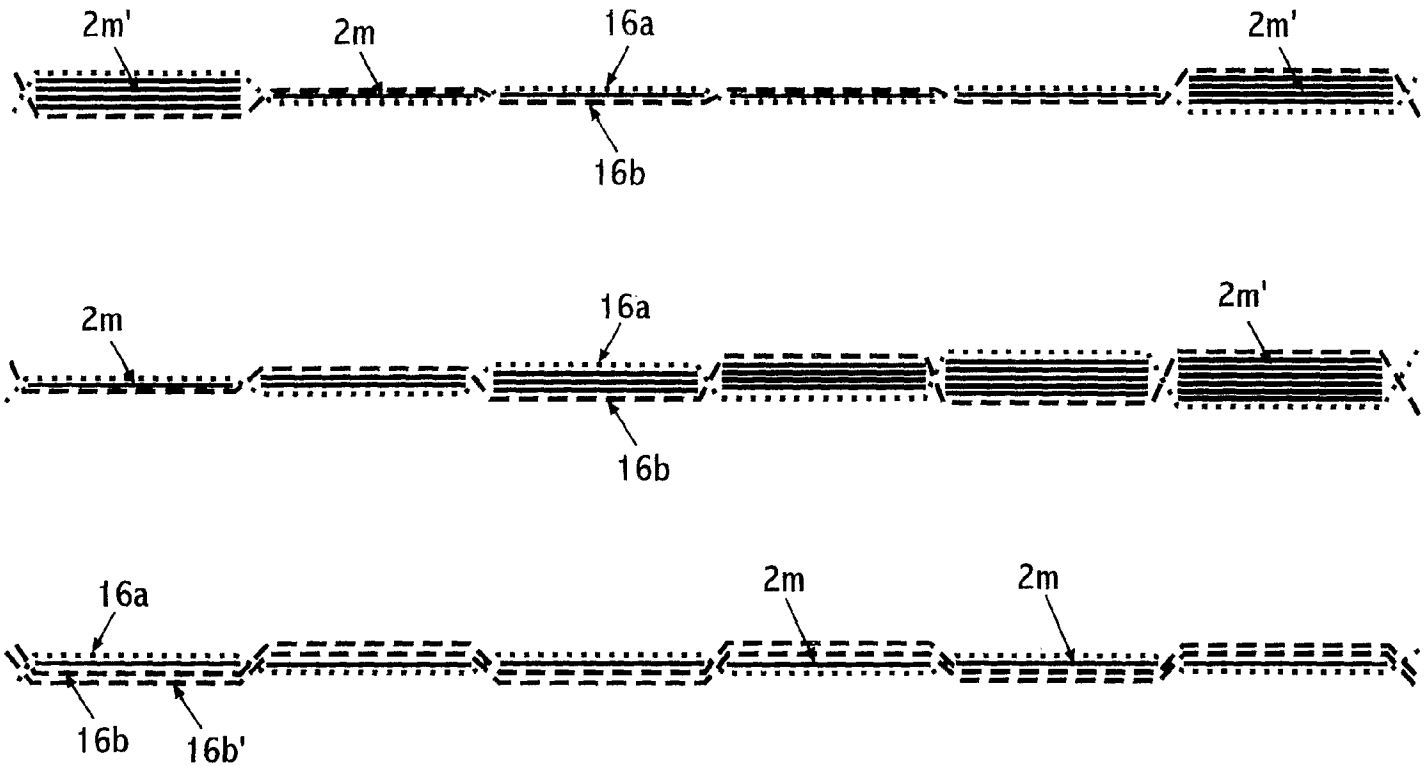
FIG. 25 exemplifies some profiled woven constructions comprising doubled warps and wefts.

Through the described tandem supply of warp and weft not only planar fabrics but also fabrics with relatively flat/planar sections and thicker/raised wide rib sections can be created as exemplified in FIG. 25. Such fabrics would resemble a bit like a profiled material in its cross-section and can be also said to possess variable weight per unit area. The possibility of slipping the constituent stacked tapes relative to each other in the doubled warp and/or weft would not alter the woven structure of such fabrics.

Figure 26:
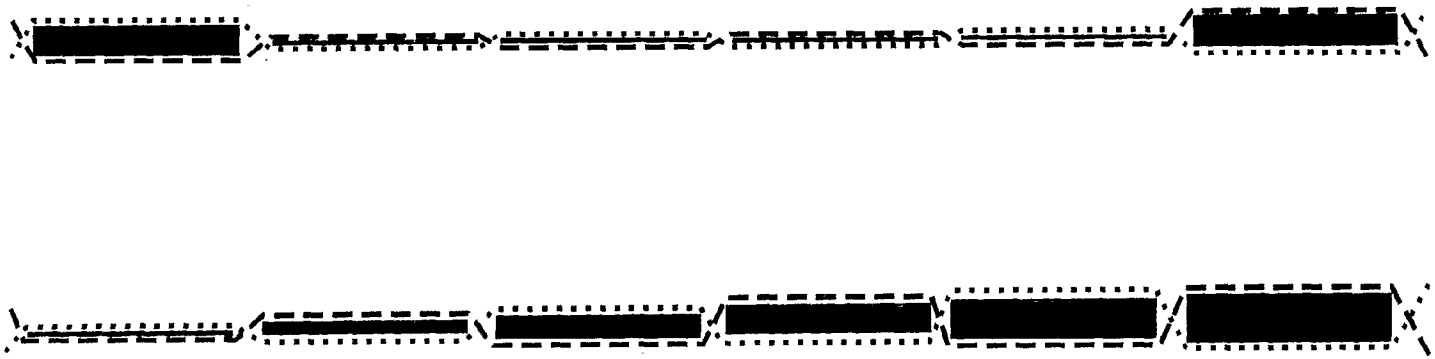
FIG. 26 exemplifies same profiled woven constructions comprising relatively thicker and thinner single warps and wefts.

These novel constructions can be used to make functional products like self-tracked conveyor belt, a sloped or wedge-like sheet to allow liquid to flow down quickly such as in food processing, a roof cover that can be anchored mechanically to the support beams without puncturing the fabric face, automobile bumpers etc. These constructions can be used in a variety of applications including rigid and flexible types of composite materials. FIG. 25(*a*) shows a fabric construction with a planar section (made using single warps 2*m* and single wefts 16*a*, 16*b*) between two raised rib sections (made using doubled warps 2*m*' and single wefts 16*a*, 16*b*). FIG. 25(*b*) shows a fabric construction made with gradually increasing number of doubled warp tapes from one side (2*m*) to the opposite (2*m*') and single weft tapes (16*a*, 16*b*) to obtain a wedge shaped or tapered fabric. FIG. 25(*c*) shows a fabric construction made using doubled weft tapes (16*b*, 16*b*') and single warp tapes (2*m*). It may be added here that these described constructions, which possess variable weight per unit area, could be also produced using suitable relatively thicker and thinner single tapes as shown in FIG. 26, wherein 26(*a*) and 26(*b*) correspond with the doubled warp tape constructions indicated in FIGS. 25(*a*) and 25(*b*) respectively.

Fabrics comprising partially stabilized tapes, especially those made with elaostomeric or rubber-like binding agents, could have their tapes laterally shrunk if exposed to relatively high temperatures. Such a woven structure could be useful to develop controlled openings in one or more areas of the fabric by exposing to relatively high temperatures. A fabric as this, while indicating an idea about the obtaining high temperature, would automatically allow warmth to escape through the created openings.

Figure 27:
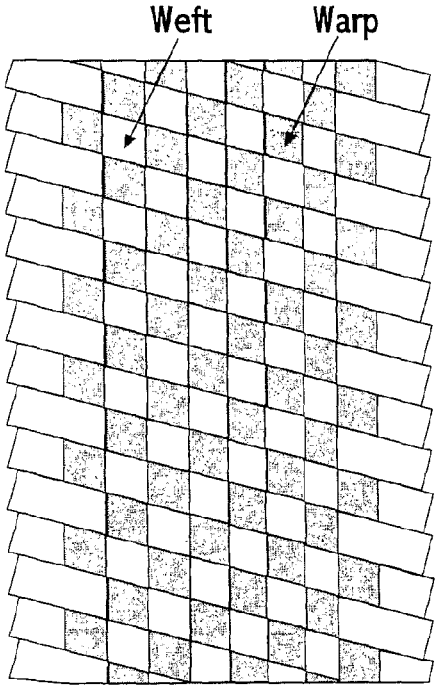
FIG. 27 exemplifies different woven constructions comprising oblique/slanted wefts.
Figure 27:
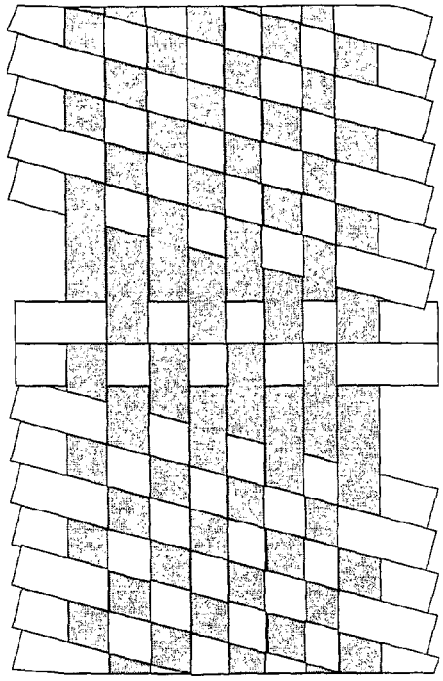
Figure 27:
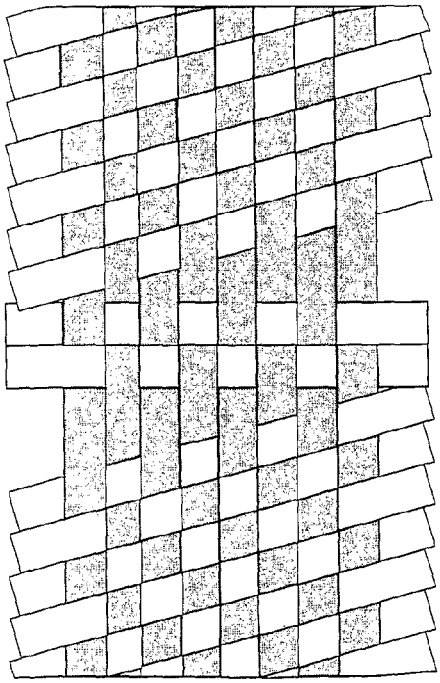
Figure 27:
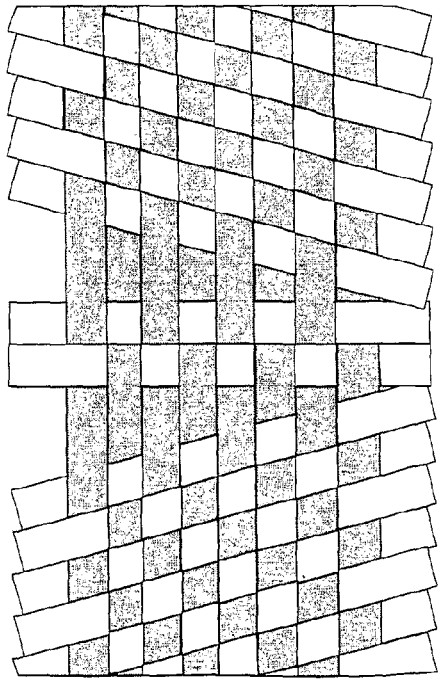

Apart from the described woven constructions wherein the weft tapes occur at about 90° relative to the warp tapes, the present invention enables production of yet another novel fabric wherein the weft tapes are incorporated slant/oblique, i.e. in a substantially different angle from 90° relative to the warp tapes. To obtain such a new material, as shown in FIG. 27, the described weft depositing device can be employed advantageously. As mentioned earlier, the main things that need to be modified are: (a) the stroke lengths of the devices (54*a*) of the pair of units (50) located at the two selvedge sides should be made unequal, (b) the clamps (52*a*, 52*b*) should be made to swivel about its axes supported by the devices (53*a*, 53*b*), and (c) the units (50) should be made to move laterally (away from and closer to each other). The weaving operations of this new material remain as before. The inserted weft tape is gripped and brought to the fabric-fell position just as described earlier (FIG. 12). Now, due to the unequal stroke lengths of the two devices (54*a*), each of which is located at the selvedge sides, the gripped weft is deposited slant or obliquely. The swivelling action of the clamps (52*a*, 52*b*) will allow the weft tape to remain slanted while the weft is moving vertically down to the fabric-fell position. The units (50) will move laterally to compensate for the varying distances: when the weft is to be gripped they will move away from each other and when the weft is being deposited in slant at fabric-fell they will move closer to each other. The distance by which the units (50) have to move laterally will depend on the slant angle of the weft. The length of weft to be inserted will also depend on the slant angle. It may be noted that the line of fabric-fell during the production of such fabrics will also be slant/oblique. The described weaving procedure will remain same because the warp is fed positively in a tensionless condition and the fabric can be taken-up in conjunction with the warp let-off device. Thus the fabric comprising slanted wefts can be woven satisfactorily.

Figure 28:
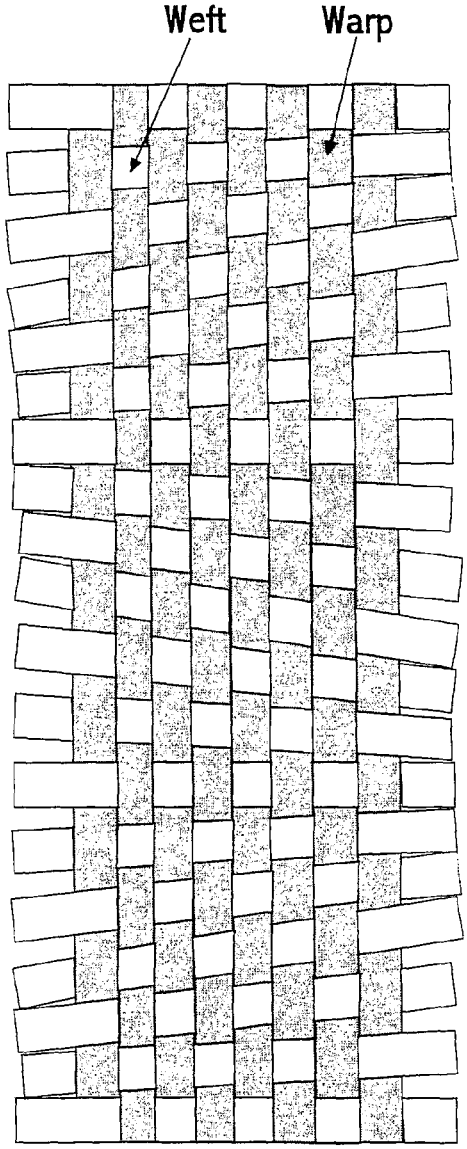
FIG. 28 exemplifies a woven construction comprising a combination of different oblique/slanted wefts.

A woven material can comprise oblique/slant weft tapes in different ways. As shown in FIG. 27(*a*) a fabric can have all the weft tapes that are slant/oblique at the same angle and sloping direction. By making the stroke lengths of devices (54*a*) equal as and when required it is possible to incorporate weft tapes at 90° to warp as indicated in FIG. 27(*b*) along with slant wefts. The slant angles and sloping direction of the weft tapes in a fabric are possible to be reversed by suitably altering the stroke length of one of the devices (54*a*). Such a fabric is shown in FIG. 27(*c*). It is also possible to have weft tapes at two different slant angles and reversed sloping directions within the same fabric as indicated in FIG. 27(*d*). It will be apparent now that variable slant/obliqueness of the weft tapes and also relatively reversed sloping directions can be combined as and when desired within a fabric as exemplified in FIG. 28 by employing the described weft depositing device. An important advantage of this novel woven material is that when suitably combining such materials by plying or stacking, it becomes possible to obtain a multi-directional orientation of the fibrous tapes in the plied/stacked structure. Another benefit of such materials is that, objects like cones, pyramids, barrels etc. could be easily formed by displacing and adjusting the required tapes in the directions desired. Needless to say that the described constructions could be as well produced using single and doubled warps and wefts.

Figure 29:
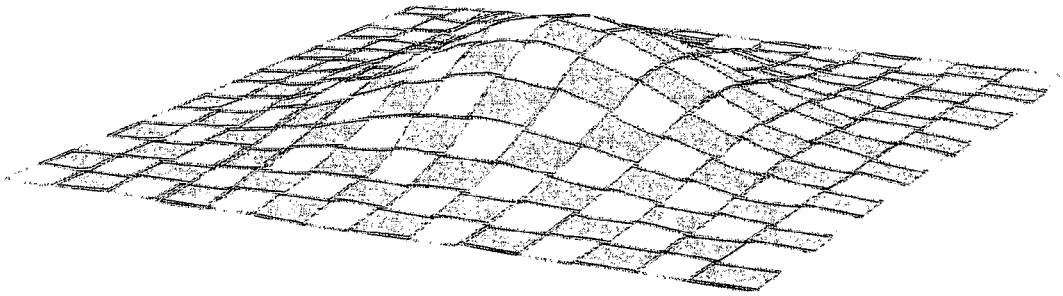
FIG. 29 exemplifies a woven material that has a formed shape within its body.
Figure 30A:
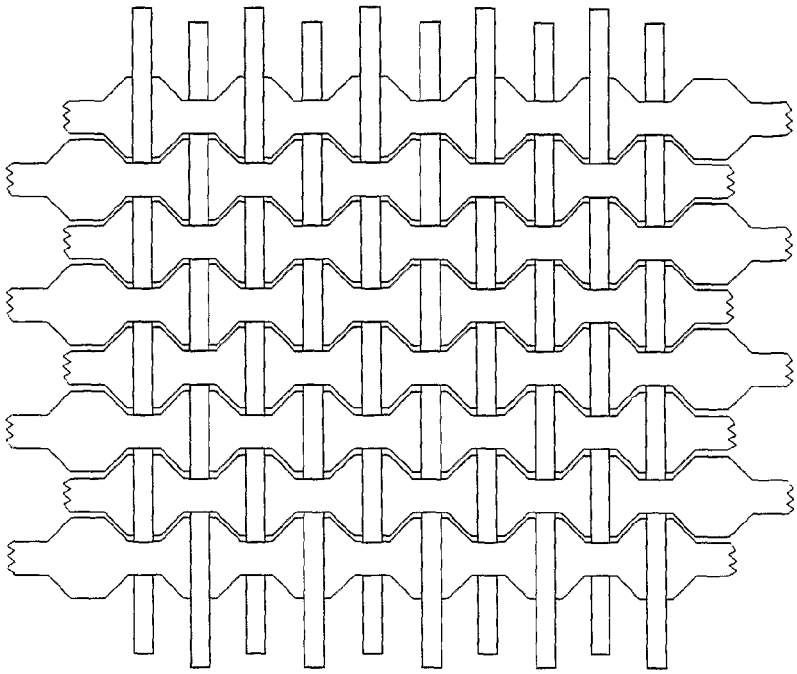
FIG. 30 exemplifies woven materials comprising weft and/or warp tapes of shaped edges.
Figure 30B:
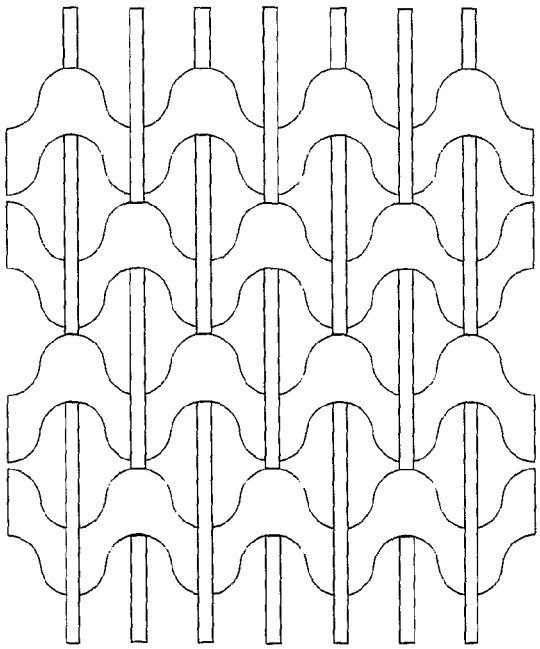
Figure 30C:
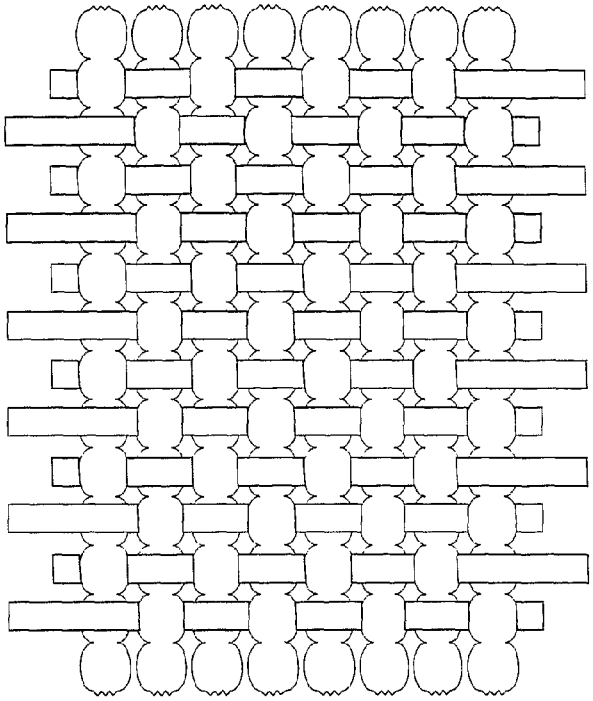
Figure 30D:
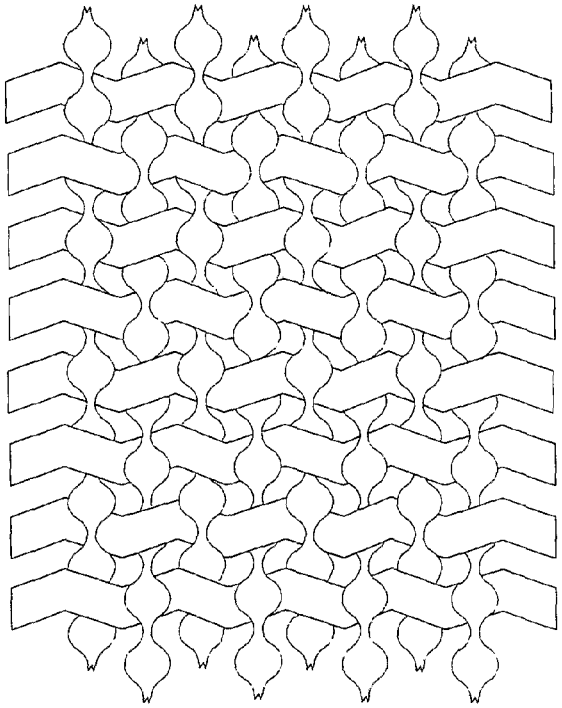

The possibility of overfeeding tensionless warps and wefts, either single or doubled, also makes possible direct production of a fabric material that has a formed shape within its body such as that exemplified in FIG. 29. To obtain such a woven material the required contours of the desired shape can be generated by selectively overfeeding the warp and weft tapes concerned. As can be understood, a variety of contoured shapes could be produced at different parts, in different sizes and numbers within the body. Use of doubled warps and wefts in such constructions would enable the constituent tapes to be laterally displaced after fabric production for obtaining a better fibre distribution to close gaps/openings that may arise. Production of many other forms could be similarly carried out together with selective partial shedding and taking-up, and excluding and including select warps and wefts in a manner that is outside the scope of the present invention.

In the foregoing description the warp and weft tapes have their long edges straight and parallel or constantly spaced apart. However, the described method also makes it possible to weave tapes the edges of which are variable resulting in a variety of shapes. The ability of the weft depositing device (50) to move laterally (as described for deposition of oblique/slant weft tapes) could be advantageously exploited to produce for the first time novel woven materials comprising warp and weft tapes with shaped edges such as those exemplified in FIG. 30 through their controlled lateral movements. Deposition of such shaped tapes at fabric fell may not be possible using a reed, especially if the contours of the adjacent tapes with shaped edges are to be matched in a close fit fashion as shown in FIG. 30(*a*). Apparently it would be also possible to deposit shaped weft tapes in an open fit fashion as shown in FIG. 30(*b*). It may be added here that the fabric could as well comprise shaped warp tapes. FIG. 30(*c*) shows a material comprising shaped warp tapes and normal weft tapes. It would be also possible to produce a fabric wherein both warp and weft tapes are shaped as exemplified in FIG. 30(*d*) and in close fit matching configuration. The production of such fabrics would remain same as with the processing of normal tapes. Fabrics comprising shaped warp and weft tapes accords improved shaping capability and new opportunities in material designing. Warp or weft tapes in shapes somewhat resembling isosceles triangle or trapezium could be also considered to produce shaped products like cones. Such shaped warp and weft tapes could be made from all materials mentioned earlier, including fibrous. Tapes made of wood, such as veneer, could also be woven to produce decorative materials.

While the above description gives the impression that the warp and weft tapes are flat, even if their edges are shaped, it is possible for the described method to process tapes that are flat on one side and have a projection on the other side. Such tapes may be referred to here as profiled in their cross-section. To enable processing of such profiled tapes certain modifications would be required. For processing profiled warp tapes, it would be preferable to have the clamping units (5*a*, 5*b*) made to receive the projecting part of the tape. Such a clamp would thus press onto the tape without causing distortion of the projecting part. Similarly, by employing the guiding-driving rolls (34*a*, 34*b*) in matching profiles corresponding profiled weft tapes could be processed. Also, if required, the under side (22*b*) of gripper (22) could be made to correspond with a profile, although this is considered unnecessary because the distortion to the projecting part at the fore part of the profiled tape would any way occur outside of the selvedges. The same could be also said about the clamps (52*a*, 52*b*) of the weft depositing unit (50) and the clamps (62*a*, 62*b*) of the selvedge binding device (60).

Additional Possibilities

Apart from the described method's ability to process rigid and flexible types of warp and weft tapes, either as singles or doubled, it is also possible to employ it for laminating the woven material directly with a sheet of suitable material, for example polyethylene or other polymeric materials, which can be of either adhesive or plain types. This can be achieved by feeding the desired laminating material's sheet to the take-up device (70). The roll (75) shown in FIG. 18 would supply the sheet of selected adhesive material and the guide-press roll (77) would press it onto the fabric directly and cause adherence of the sheet to the fabric. This arrangement could be further modified according to needs to laminate the woven material on both surfaces of the fabric by feeding two sheets of the desired materials. Another further desirable modification could be to arrange heating of the guide-press roll (77), which could be either single or paired, to apply required heat and pressure on the combined laminates of woven and polymeric materials. Direct production of a laminated material on a weaving machine as described would be beneficial because the laminating process does not have to be performed in a separate step on another set-up.

Yet another possibility is that the described take-up device (70) could also be employed to produce a woven pre-preg material directly by suitably spreading or applying evenly an uncured matrix or thermoplastic matrix on the paper/film (75) so that the uncured matrix or thermoplastic matrix gets transferred from the paper/film (75) to the woven material when being rolled. The preferred conditions of temperature and pressure for efficient transference of uncured matrix from paper/film (75) could be achieved by having heat-able guide-press roll (77) with variable pressure control, for example by springs, through the supporting arms (78). Alternatively, it is also possible to apply the uncured matrix or thermoplastic matrix to the woven material directly before being rolled, for example by passing the paper/film (75) and the woven material through a matrix bath. The possibility of spraying a desired chemical formulation cannot be ruled out. As can be seen, this way a woven pre-preg material can be produced during weaving.

Yet another possibility is to apply the matrix to the woven material through the guide-press roll (77), which is made from a suitable tube with suitable perforations so that the matrix can be fed into it under pressure from one or both ends whereby the matrix gets applied onto the woven material. Here also the guide-press roll (77) could be of the heat-able type with possibility to vary pressure through supporting arms (78). Needless to say that the choice of paper/film (75) to be used will be compatible with the tackiness of the uncured matrix employed and capable of withstanding the temperature and pressure involved. This approach will enable direct production of a composite material sheet reinforced by a woven material during weaving.

Yet another possibility is that due to the possibility of achieving relative slipping of the constituent tapes of doubled warps and wefts, weaving of very delicate, fragile and brittle materials can be carried out by having tapes of such materials between tapes of two suitable protective materials. After weaving is accomplished, the outer protective tapes can be drawn out and thereby woven materials of very delicate, fragile and brittle materials obtained.

It will be apparent now to those skilled in the art that various details of this invention can be modified without departing from its spirit. Therefore, the foregoing description does not limit the claims listed below.

The invention claimed is:

1. A woven material comprising warps and wefts of tapes, wherein at least one of the warp and weft is a partially stabilized fibrous tape where fibers are discontinuously connected by a binding agent in such a way that only some fibers across the tape width are held while leaving some fibers free, whereby the warps and the wefts are held together via interfacing thereof in such a way that the warps and the wefts are configured to slip and slide or slide laterally and longitudinally in relation to each other.

2. The woven material of claim 1, wherein the at least one partially stabilized fibrous tape includes fibers orientating non-linearly in the tape's length direction, whereby said non-linear fibers are able to be straightened without altering a weave structure or pattern.

3. The woven material of claim 2, wherein most of the fibers in the at least one partially stabilized fibrous tape orientates non-linearly in the tape's length direction.

4. The woven material of claim 2, wherein most of the warp and weft tapes have fibers orientating non-linearly in the tape's length direction.

5. The woven material of claim 1, wherein at least one of the warp and weft tapes is a doubled tape including at least two separate tape layers being loosely arranged on top of each other in a thickness direction of the woven material.

6. The woven material of claim 1, wherein at least some of the warp and weft tapes occur in a slanted disposition with an obtuse angle therebetween.

7. The woven material of claim 6, wherein at least some of the warp and weft tapes occur in different angular dispositions, with different angles therebetween.

8. The woven material of claim 1, wherein the woven material has at least one contoured shape within a body of the woven material.

9. The woven material of claim 1, wherein at least some of the warp and weft tapes have edges selected from non-linear longitudinal edges, non-parallel edges and a combination of such edges.

10. The woven material of claim 1, wherein some of the partially stabilized fibrous tapes have different thicknesses relative to each other.

11. The woven material of claim 1, wherein at least one of the partially stabilized fibrous tapes is a doubled tape including two separate tape layers being loosely arranged on top of each other in a thickness direction of the woven material.

12. The woven material of claim 1, wherein at least some of the warp and weft tapes are of different widths.

13. The woven material of claim 1, wherein at least some of the warp and weft tapes have different thicknesses.

14. The woven material of claim 12, wherein the warp and weft tapes of different widths occur in a regular pattern in the woven material.

15. The woven material of claim 1, wherein at least one loosely arranged tape layer of a doubled warp and weft tape is slideable relative to the other without altering a weave pattern of the woven material.

16. The woven material of claim 1, wherein the woven material has a variable weight per unit area.

17. The woven material of claim 1, wherein a material of the warp and weft tapes is selected from at least one of thermoplastic, polymeric, synthetic, thermoset, metallic, organic, inorganic, impregnated fibers, natural, vegetable and animal fibers, aramid fibers, carbon fibers, boron fibers, ceramic fibers, glass fibers, optical fibers and a combination of at least some of them.

18. The woven material of claim 1, wherein the construction of the warp and weft tapes are at least one of flat, solid, profiled on one side and flat on the other, shaped at edges, perforated, embossed, corrugated, tapered, smooth, rough, transparent, opaque, translucent, colored, colorless, stabilized fibers, non-stabilized fibers, adhesive bearing and a combination of them.

19. The woven material of claim 1, wherein the woven material includes at least one of an thermoplastic and a uncured matrix to form a prepreg material.

20. The woven material of claim 1, wherein at least one loosely arranged tape layer of a doubled warp and weft tape is removable relative to the other without altering a weave pattern of the woven material.

* * * * *